US007119770B2

(12) United States Patent
Moon

(10) Patent No.: US 7,119,770 B2
(45) Date of Patent: Oct. 10, 2006

(54) DRIVING APPARATUS OF ELECTROLUMINESCENT DISPLAY DEVICE AND DRIVING METHOD THEREOF

(75) Inventor: Seong Hak Moon, Yongin (KR)

(73) Assignee: LG Electronics Inc., Seoul (KR)

( * ) Notice: Subject to any disclaimer, the term of this patent is extended or adjusted under 35 U.S.C. 154(b) by 227 days.

(21) Appl. No.: 10/214,720

(22) Filed: Aug. 9, 2002

(65) Prior Publication Data

US 2003/0034939 A1 Feb. 20, 2003

(30) Foreign Application Priority Data

| | | |
|---|---|---|
| Aug. 17, 2001 | (KR) | 2001/49686 |
| Aug. 20, 2001 | (KR) | 2001/49924 |
| Sep. 19, 2001 | (KR) | 2001/57870 |
| Sep. 19, 2001 | (KR) | 2001/57871 |
| Sep. 19, 2001 | (KR) | 2001/57872 |

(51) Int. Cl.
*G09G 3/30* (2006.01)
*G09G 5/00* (2006.01)
*G09G 3/10* (2006.01)

(52) U.S. Cl. ..... 345/79; 345/209; 315/169.3

(58) Field of Classification Search ..... 345/36, 345/76–81, 690, 208–214, 92, 94, 96, 100; 315/169.1–169.3

See application file for complete search history.

(56) References Cited

U.S. PATENT DOCUMENTS

| | | | | |
|---|---|---|---|---|
| 3,818,484 | A * | 6/1974 | Nakamura et al. | 368/204 |
| 4,839,563 | A * | 6/1989 | Boudreau et al. | 315/169.3 |
| 5,227,696 | A * | 7/1993 | Asars | 315/169.3 |
| 5,235,253 | A * | 8/1993 | Sato | 315/169.3 |
| 5,838,289 | A * | 11/1998 | Saito et al. | 345/79 |
| 5,999,150 | A * | 12/1999 | Nighan et al. | 345/79 |
| 6,064,158 | A * | 5/2000 | Kishita et al. | 315/169.3 |
| 6,097,365 | A * | 8/2000 | Makino | 345/99 |
| 6,121,943 | A * | 9/2000 | Nishioka et al. | 345/76 |
| 6,144,357 | A * | 11/2000 | Jeong | 345/100 |
| 6,271,812 | B1 * | 8/2001 | Osada et al. | 345/76 |
| 6,317,107 | B1 * | 11/2001 | Ninoyu et al. | 345/76 |

* cited by examiner

*Primary Examiner*—Henry N. Tran
(74) *Attorney, Agent, or Firm*—Fleshner & Kim, LLP

(57) ABSTRACT

A driving apparatus of an electroluminescent display device includes: a scan driving unit for receiving a voltage from a single voltage source and sequentially supplying a scan pulse of which polarity is reversed by the frame unit to scan lines; and a data driving unit for receiving the voltage and sequentially supplying a data pulse with an opposite polarity to the polarity of the scan pulse to data lines. An optimum voltage to a pixel cell can be supplied by completely removing electric charges charged in the pixel cell by reversing a positive pulse or a negative pulse generated by a single power source by the frame unit and supplying it to each data line and scan line.

36 Claims, 28 Drawing Sheets

DRIVING APPARATUS OF ELECTROLUMINESCENT DISPLAY DEVICE AND DRIVING METHOD THEREOF

BACKGROUND OF THE INVENTION

1. Field of the Invention

The present invention relates to an electroluminescent (EL) display, and more particularly, to a data driving unit and a scan driving unit that supply a data pulse and a scan pulse to a pixel cell of a panel.

2. Description of the Background Art

Recently, various flat type display devices are being developed to reduce a weight and a volume of a cathode ray tube. The panel display devices include a field emission display (FED), a plasma display panel (PDP) and an electroluminescent (EL) display.

The EL display utilizes an EL phenomenon that a light is generated by a voltage applied to a phosphor layer. Thanks to its rapid response speed, low DC drive voltage and capability of being ultra-thin compared to such an LCD, the EL display can be adaptable to wall-mounting type products or portable products.

The EL displays are classified into an inorganic EL display and an organic EL display depending on its material and structure.

FIG. 1 is a drawing illustrating the cell structure of the inorganic EL panel in accordance with a conventional art.

As shown in FIG. 1, the cell 100 of the inorganic EL panel includes: an upper insulation layer 4 and a lower insulation layer 2, a phosphor layer 3 formed between the lower and upper insulation layers 2 and 4, a back electrode 1 formed on the lower insulation layer 2, and a clear electrode 5 formed on the upper insulation layer 4. The clear electrode 5 is formed at a rear surface of a glass substrate 6.

The upper and lower insulation layers 2 and 4 are made of a dielectric material. Thus, when a voltage is applied to the cell 100, the upper and lower insulation layers 2 and 4 have a certain capacitance.

The phosphor layer 3 is excited by electrons to emit a visible light. The phosphor layer 3 is made of an inorganic substance such as Zns or Mn.

The back electrode 1 is made of a conductive material such as Al. The back electrode 1 receives a scan pulse from a gate driving unit (not shown). That is, the back electrode 1 is used as a scan electrode for supplying the scan pulse to the cells 10.

The clear electrode 5 is made of a clear conductive material such as Indium-Tin-Oxide (ITO). The clear electrode 5 receives a data pulse from a data driving unit (not shown). That is, the clear electrode 5 is used as a data electrode for supplying the data pulse to the cells.

When the scan pulse is supplied to the back electrode 1 and the data pulse is applied to the clear electrode 5 (that is, a voltage is applied between the back electrode 1 and the clear electrode 5), holes are accelerated toward the back electrode 1 and electrons are accelerated toward the clear electrode 5. The electrons and the hole collide at the central portion of the phosphor layer 3. When the electrons and the hole collide, the phosphor layer 3 generates a visible light to display a certain image.

FIG. 2 is a block diagram showing a driving apparatus of the EL panel in accordance with a conventional art.

As shown in FIG. 2, a driving apparatus of an EL display device in accordance with the conventional art includes: pixel cells 100 positioned at cross points between data lines D1~Dn and scan lines (S1~Sm) formed on a panel 10; a data driving unit 12 for supplying a data pulse to the data lines D1~Dn; and a scan driving unit 14 for supplying a scan pulse to the scan lines (S1~Sm).

The operation of the driving apparatus of the EL display device in accordance with the conventional art will now be described.

First, the data driving unit 12 supplies a data pulse to the data lines D1~Dn. The scan driving unit 14 supplies a scan pulse and a reset pulse to the scan lines S1~Sm.

The pixel cell 100 performs an ON/OFF operation by an electric field between the scan electrode receiving a negative (−) scan pulse from the scan driving unit 14 and the data electrode receiving a positive (+) data pulse from the data driving unit 12.

Each pixel cell 100 is equivalently connected to a capacitor (not shown).

The positive (+) pulse is supplied to the data lines D1~Dn and the negative (−) pulse is supplied to the scan lines S1~Sm. In this respect, in order to remove the electric charge charged in the pixel cell 100 due to the negative scan pulse, a positive pulse is supplied to the second scan line S1 after the last scan line Sm.

That is, the scan driving unit 14 receives two power sources in order to output a positive (+) pulse and a negative (−) pulse.

FIG. 3 is a circuit diagram showing the scan driving unit of FIG. 2

As shown in FIG. 3, the scan driving unit 14 of the EL display device includes: a scan pulse supply unit 20 for generating a scan pulse and a scan drive IC (Integrated Circuit) 22 for supplying the scan pulse (SP) supplied from the scan pulse driving unit 20 to one scan line (S1) of the scan lines S1~Sm.

The scan pulse supply unit 20 includes: first and second switching devices (SW1 and SW2) installed in parallel between a ground voltage (GND) and a scan drive IC 22; a third switching device (SW3) installed between scan pulse voltage source (−Vs) and the scan driver IC 22; and a fourth switching device (SW4) installed between a reset pulse voltage source (Vr) and a scan drive IC 22.

The operation of the scan driving unit will now be described.

The second to fourth switching devices SW1~SW4 are turned on/off in response to a control signal supplied from a timing controller (not shown).

The first switching device SW1 and the third switching device SW3 supply a scan pulse SP to corresponding scan lines S1~Sm alternately in response to the control signal supplied from the timing controller.

The second switching device SW2 and the fourth switching device SW4 supply a reset pulse (RP) to every scan line S1~Sm in response to the control signal supplied from the timing controller.

The first switching device SW1 increases a voltage of the negative (−) scan pulse (SP) up to a ground voltage (GND), and the third switching device SW3 supplies a negative scan pulse (SP).

The second switching device SW2 is operated reversely to the fourth switching device SW4 and lowers down the scan pulse (SP) to a negative polarity.

The fourth switching device SW4 supplies a reset pulse RP to every scan line S1~Sm.

A resistor (R) is a resistance device for reducing a peak current when an instantaneous voltage is applied to the scan drive IC 22.

A driving method of the EL display device of FIG. 2 will now be described.

FIG. 4 shows waveforms for driving the EL display device of FIG. 2.

As shown in FIG. 4, when third switching device SW3 and second switching device SW2 are turned on in a state that first through fourth switching devices SW1~SW4 are turned off, the negative (−) scan pulse SP is supplied from the scan pulse voltage source (−Vs) to the first scan line S1 through an internal diode of the scan drive IC 22. Synchronized with the negative scan pulse SP, the data pulse DP is supplied to the data electrodes D1~Dn.

Thereafter, at the same time when the third switching device SW3 is turned off, the first switching device SW1 is turned on. Accordingly, the first scan line S1 is provided with a ground voltage (GND) by the first switching device SW1.

As the first and the third switching devices SW1 and SW3 are alternately turned on/off, the scan pulse is sequentially supplied to every scan line S1~Sm.

When the scan pulse SP is supplied to every scan line S1~Sm, the second switching device SW2 is turned off whereas the fourth switching device SW4 is turned on, so that a positive reset pulse RP is supplied from the reset pulse voltage source Vr to every scan line S1~Sm.

This process is repeatedly performed to sequentially apply the scan pulse SP and the data pulse DP up to the mth scan line Sm to drive the pixel cell 100 and display a picture.

After the picture is displayed, the positive reset pulse RP is applied to the first~mth scan lines S1~Sm. When the reset pulse RP is applied to the first~mth scan lines S1~Sm, the electric charges charged in the pixel cell 100 are removed.

As stated above, in order for the scan driving unit 14 to supply the negative (−) scan pulse (−Vs) and the positive (+) reset pulse (RP) to the scan lines S1~Sm, two power sources, that is, the reset pulse voltage source (Vr) and the scan pulse voltage source (−Vs) are required.

In addition, a circuit construction of the scan driving unit 14 requires a high voltage to satisfy both the positive polarity (+) and the negative polarity (−).

As the high voltage is required, a power consumption is increased, and a switching noise is generated in alternately switching two power sources.

FIG. 5 shows electric charges accumulated in the data electrode and the scan electrode of the EL panel in accordance with the conventional art.

As shown in FIG. 5, in the EL display device of the conventional art, a bias voltage of the same polarity is applied between the data electrode and the scan electrode.

That is, negative electric charges are charged in the data electrode, and positive (+) electric charges are charged in the scan electrode, resulting in that uneven luminance phenomenon takes place in the pixel cell or line. This phenomenon causes a cross talk, and thus, an afterimage remains in implementing a fast mobile picture, degrading a picture quality.

In addition, as for the EL display device, since a threshold voltage differs depending on red/green/blue fluorescent materials (R, G, B) in terms of the characteristics of a fluorescent material, if each fluorescent material is omitted by driving the pixel cell with the same voltage, luminance characteristics are degraded.

In this respect, the threshold voltage is a voltage required for emitting light from each fluorescent material, and each fluorescent material has different threshold voltage.

For example, the red (R) and the green (G) fluorescent materials are omitted by a threshold voltage between approximately 150~240V, and the blue (B) fluorescent material is omitted by a threshold voltage between approximately 120~200V.

That is, if the fluorescent materials (R, G, B) are omitted with the 240V, since the threshold voltages of each fluorescent material (R, G, B) are different from each other, each fluorescent material has different luminance value.

SUMMARY OF THE INVENTION

Therefore, an object of the present invention is to provide a driving apparatus and method of an electroluminescent display device that are capable of supplying an optimum voltage to a pixel cell by completely removing electric charges charged in the pixel cell by reversing a positive pulse or a negative pulse generated by a single power source by the frame unit and supplying it to each data line and scan line.

Another object of the present invention is to provide a driving apparatus and method of an electroluminescent display device that are capable of enhancing a luminance of a pixel cell, color coordinates and color uniformity by supplying an optimum scan pulse/data pulse to the pixel cell emitting light from red, green and blue fluorescent materials.

Still another object of the present invention is to provide a driving apparatus and method of an electroluminescent display device that are capable of reducing a power consumption by generating a positive or a negative pulse by using a single power source.

To achieve these and other advantages and in accordance with the purpose of the present invention, as embodied and broadly described herein, there is provided a driving apparatus of an electroluminescent display device including: a scan driving unit for receiving a voltage from a single scan voltage source and sequentially supplying a scan pulse of which a polarity has been reversed by a certain unit to scan lines; and a data driving unit for receiving a voltage from a single data voltage source and supplying a data pulse to data lines.

To achieve the above objects, there is also provided a driving apparatus of an electroluminescent display device including: a scan driving unit for receiving a voltage from a single power source and sequentially supplying a scan pulse of which a polarity has been reversed by a certain unit to scan lines, and at the same time, reversing the scan pulse by the frame unit and supplying the reversed scan pulse to scan lines; and a data driving unit for receiving a voltage from a single power source and sequentially supplying a data pulse of which a polarity has been reversed by a certain unit to data lines, and at the same time, reversing the data pulse by the frame unit and supplying it to the data lines.

The scan driving unit of the driving apparatus of an electroluminescent display device of the present invention includes: a doubler circuit for doubling the voltage supplied from the signal voltage source by integer times; a first capacitor for charging the doubled voltage; a scan pulse supply unit for shifting a polarity of the voltage charged in the first capacitor to be the opposite and reversing it by the frame unit to generate a scan pulse; and a scan drive IC for supplying the scan pulse to each scan line.

To achieve the above objects, there is also provided a driving apparatus and method of an electroluminescent display device including: a data driving unit for supplying a data pulse with a voltage corresponding to a threshold voltage of each pixel cell to each pixel cell emitting light from red, green and blue fluorescent materials; and a scan driving unit for supplying a scan pulse synchronized with the data pulse to a scan line.

To achieve the above objects, there is also provided a driving apparatus and method of an electroluminescent display device including the steps of: sequentially supplying a scan pulse with a polarity reversed by the frame unit to a scan line; and supplying a data pulse with a polarity opposite to a polarity of the scan pulse to data lines.

To achieve the above objects, there is also provided a driving apparatus and method of an electroluminescent display device including the steps of: doubling a scan pulse supplied from a single power source by integer times; reversing the polarity of the doubled scan pulse by the frame unit and supplying it to scan lines; doubling a data pulse supplied from the single power source by integer times; and synchronizing the doubled data pulse with an opposite polarity to the polarity of the scan pulse, reversing it by the frame unit and supplying it to the data line.

To achieve the above objects, there is also provided a driving apparatus and method of an electroluminescent display device including the steps of: supplying a data pulse with a voltage corresponding to a threshold voltage of each pixel cell to data lines connected to each pixel cell emitting light from the red, green and blue fluorescent materials; and supplying a scan pulse synchronized with the data pulse to scan lines.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
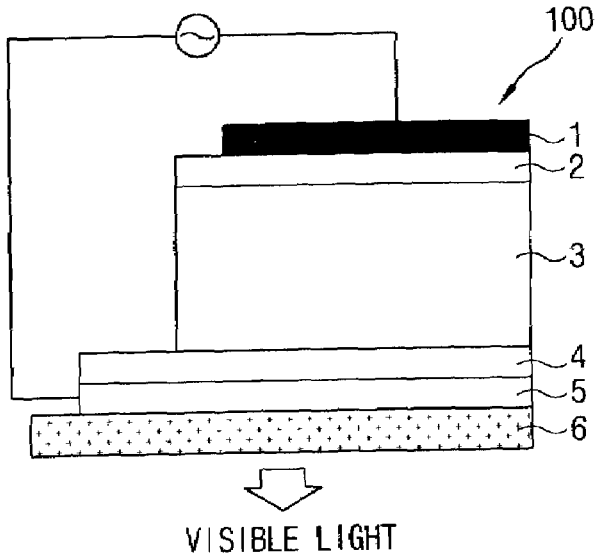
FIG.1 CONVENTIONAL ART
FIG. 1 is a view showing a cell structure of an EL panel in accordance with a conventional art.
Figure 2:
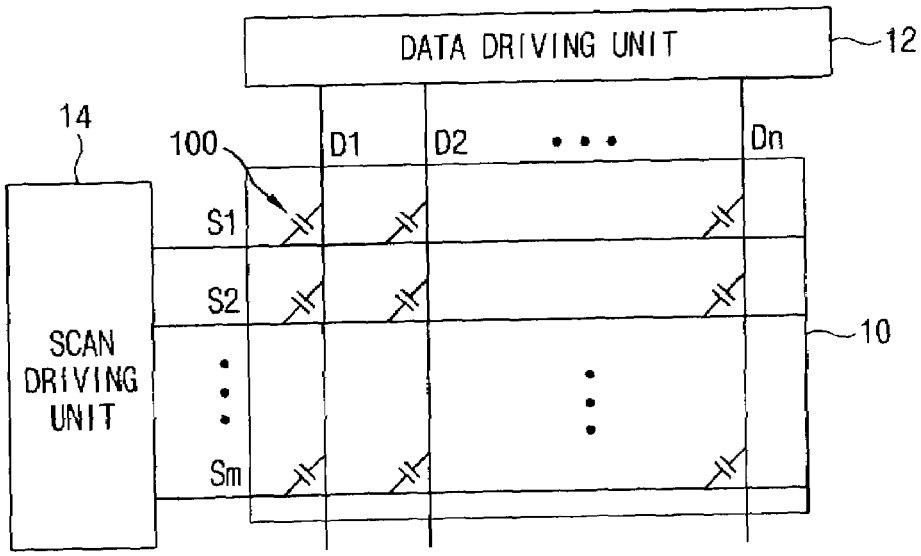
FIG.2 CONVENTIONAL ART
FIG. 2 is a block diagram of a driving apparatus of the EL panel in accordance with the conventional art.
Figure 3:
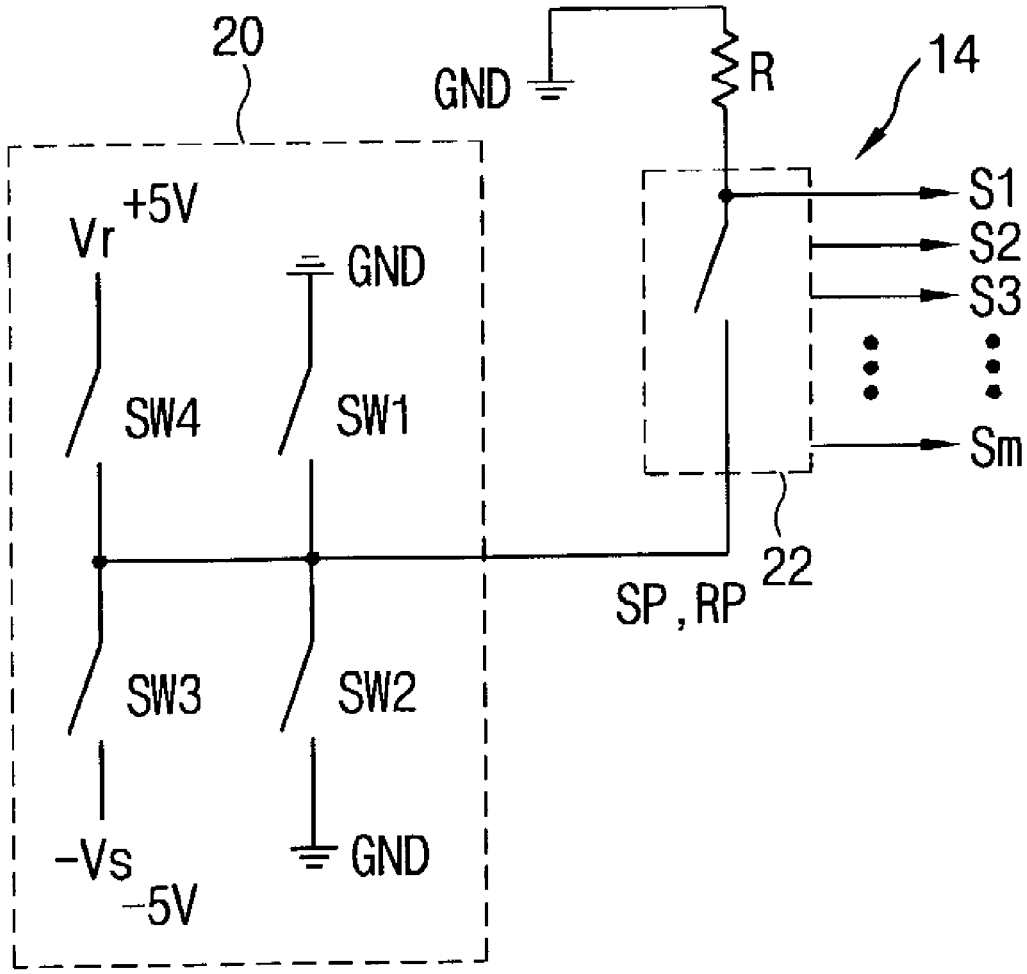
FIG.3 CONVENTIONAL ART
FIG. 3 is a circuit diagram of a scan driving apparatus of FIG. 2.
Figure 4:
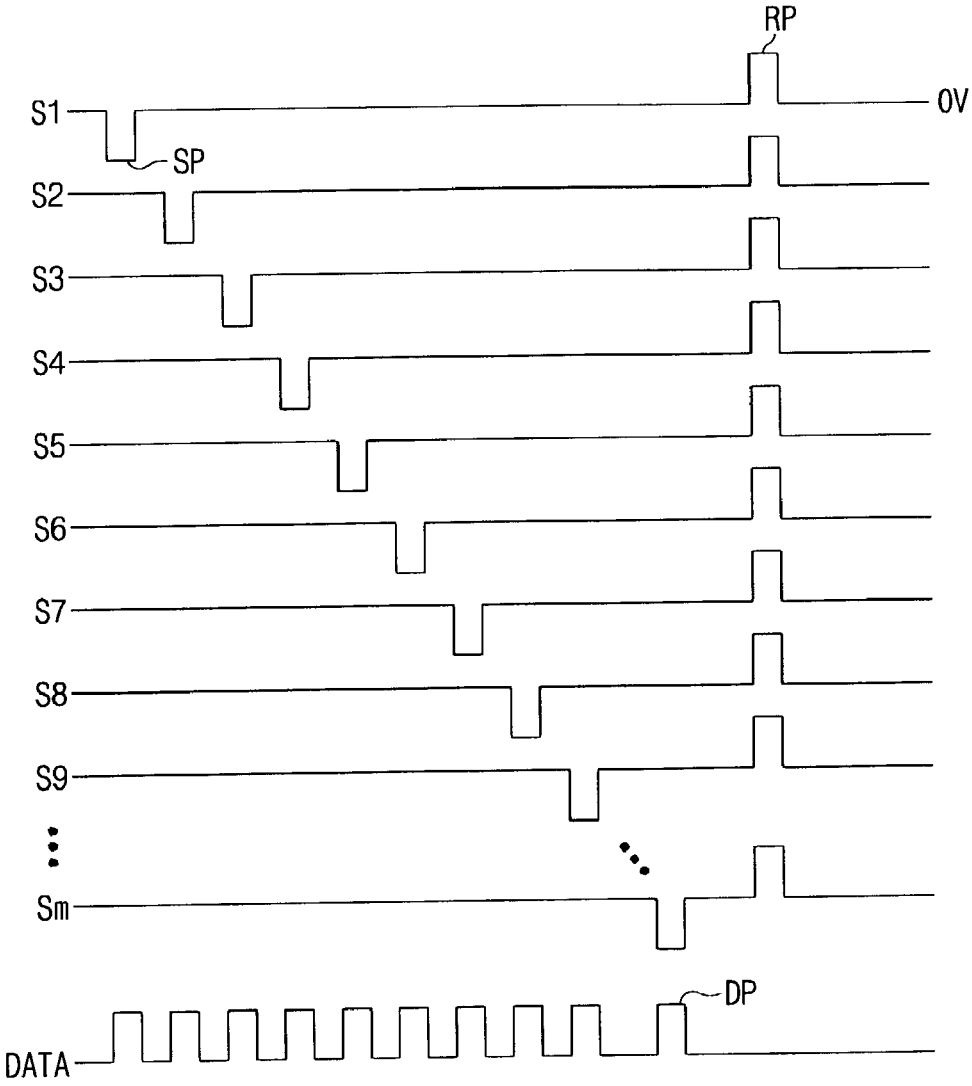
FIG.4 CONVENTIONAL ART
FIG. 4 is a view showing waveforms for driving an EL display device of FIG. 2.
Figure 5:
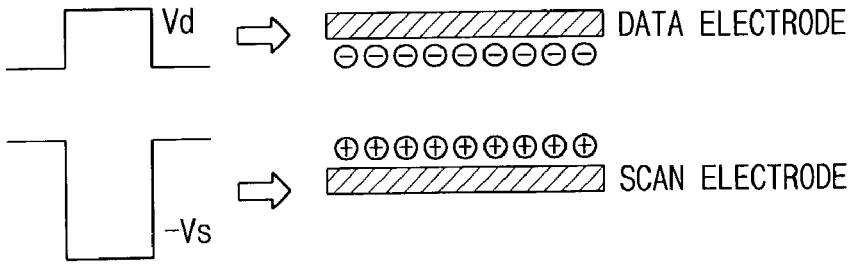
FIG.5 CONVENTIONAL ART
FIG. 5 shows electric charges accumulated in a data electrode and a scan electrode of the EL panel in accordance with the conventional art.

Reference will now be made in detail to the preferred embodiments of the present invention, examples of which are illustrated in the accompanying drawings.

A driving apparatus and method of an electroluminescent display device, in which a positive or a negative data/scan pulse generated by a single power source is reversed by the frame unit and a threshold voltage (scan pulse/data pulse) corresponding to a pixel cell emitting light from red, green and blue fluorescent materials is supplied to each data line and scan line, so that an optimum voltage can be supplied to the pixel cell by completely removing electric charges charged in the pixel cell, a luminance, color coordinates, and a chromaticity of the pixel cell can be enhanced, and a power consumption can be reduced. In accordance with preferred embodiments of the present invention will now be described with reference to FIGS. 6 and 38.

Different reference numerals are given to the same elements in each of the first to the six embodiments in terms of detailed descriptions.

Figure 6:
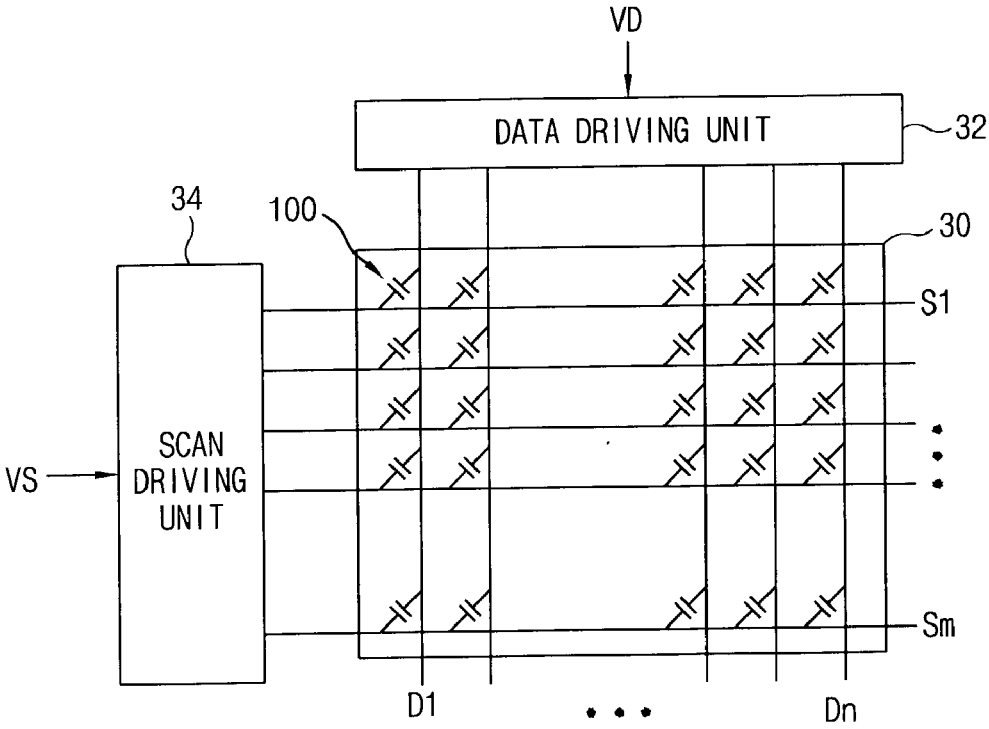
FIG. 6 is a block diagram of a driving apparatus of an EL display device in accordance with a first embodiment of the present invention.

FIG. 6 is a block diagram of a driving apparatus of an EL display device in accordance with a first embodiment of the present invention.

As shown in FIG. 6, a driving unit of an EL display device includes: a scan driving unit 34 for supplying a positive or a negative scan pulse (+Vs, −Vs) reversed by the frame unit to scan lines S1~Sm; and a data driving unit 32 for supplying a positive or a negative data pulse (+Vd, −Vd) with the opposite polarity to the positive or the negative scan pulse (+Vs, −Vs) supplied to the scan lines S1~Sm, to the data lines D1~Dn.

The operation of the EL display device in accordance with the first embodiment of the present invention will now be described.

First, the scan driving unit 34 receives a single voltage from a single voltage source VS, generates a positive or a negative scan pulse (+Vs, −Vs) reversed per frame and sequentially supplies it to the scan lines S1~Sm.

The data driving unit 32 supplies a positive or a negative data pulse (+Vd, −Vd) opposite to the positive or the negative scan pulse (+Vs, −Vs) supplied to the scan lines S1~Sm to data lines D1~Dn in synchronization with the positive or negative scan pulse (+Vs, −Vs), which will now be described in detail with reference to FIG. 7.

Figure 7:
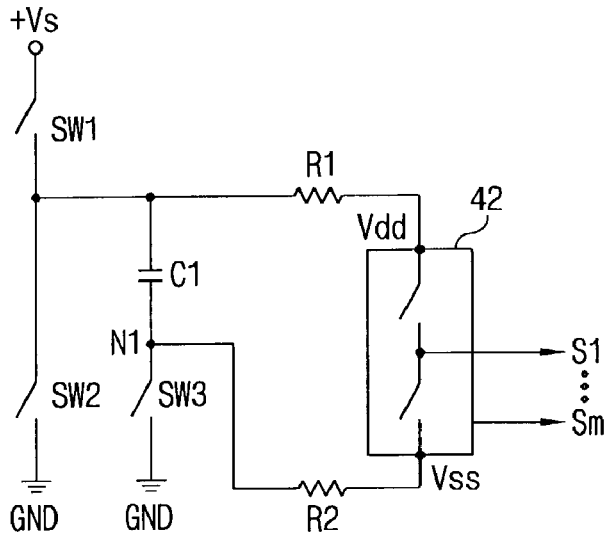
FIG. 7 is a circuit diagram of a scan driving unit of FIG. 6

FIG. 7 is a circuit diagram of a scan driving unit of FIG. 6

As shown in FIG. 7, the scan driving unit 34 includes: a single voltage source (+VS); a first capacitor C1 for charging a voltage supplied from the voltage source (+VS); a first switching device SW1 installed between the voltage source (+VS) and the first capacitor C1 and switching a voltage supplied to the first capacitor C1; a second switching device SW2 installed between the first switching device SW1 and a ground voltage source (GND) and selectively grounding the first capacitor C1. A scan drive IC 42 connected to both ends of the first capacitor C1 and sequentially supplying a positive or a negative scan pulse supplied from the first capacitor C1 to the scan lines S1~Sm; and a third switching device SW3 installed between the ground voltage source (GND) and the first capacitor C1 and selectively floating a ground terminal (VSS) of the scan drive IC 42.

The first capacitor C1 and the first through the third switching devices (SW1~3) are scan pulse supplying parts.

The operation of the scan driving unit 34 will now be described.

First, the first capacitor C1 charges a voltage supplied from the single voltage source (+VS).

The first switching device SW1 is turned on when supplying a positive pulse to the scan lines S1~Sm. The second switching device SW2 is turned on when supplying a negative pulse to the scan lines S1~Sm.

The third switching device SW3 is turned on when a positive pulse is supplied to the scan lines S1~Sm and turned off when a negative pulse is supplied to the scan lines S1~Sm, thereby floating the ground terminal VSS of the scan drive IC 42.

The scan drive IC 42 includes a plurality of switching devices (not shown), and sequentially switches the switching devices according to a control signal (not shown) outputted from a controller (not shown) to supply a positive pulse or a negative pulse supplied from the first capacitor C1 to the scan lines S1~Sm.

First and second resistances R1 and R2 are installed between both ends of the scan drive IC 42 and the first capacitor C1. The first and second resistances R1 and R2 are protecting resistance devices for reducing a peak current when an instantaneous voltage is applied to the scan drive IC 42.

Thereafter, in case that a negative scan pulse (−Vs) is supplied to the scan lines S1~Sm, the second switching device SW2 is turned on and the first switching device SW1 and the third switching device SW3 are turned off.

At this time, a power supply terminal Vdd of the scan drive IC 42 is connected to the ground voltage source GND through the second switching device SW2 and receives a ground voltage.

A voltage charged in the first capacitor c1 flows to the ground terminal VSS of the scan drive IC 42.

Since the third switching device SW3 is in an OFF state, the voltage of the ground terminal (VSS) is floated, so that the polarity level of the voltage charged in the first capacitor C1 is shifted to a negative polarity so as to be a negative voltage.

At this time, the negative scan pulse (−Vs) is supplied to the scan drive IC 42, and the negative scan pulse (−Vs) is sequentially supplied to the scan lines S1~Sm by the sequential switching operations of the internal switching devices.

Meanwhile, in case that a positive scan pulse (+Vs) is supplied to the scan lines S1~Sm, the first and third switching devices SW1 and SW3 are turned on and the second switching device SW2 is turned off.

At this time, power supplied from the single voltage source +VS is charged in the first capacitor C1, so that the power is supplied to the power supply terminal Vdd of the scan drive IC 42.

At this time, the ground terminal VSS of the scan drive IC 42 is connected to the ground voltage source GND through the third switching device SW3 and receives the ground voltage.

A positive scan pulse +Vs is supplied to the scan drive IC 42 and the positive scan pulse +Vs is sequentially supplied to the scan lines S1~Sm by the sequential switching operation of the internal switching devices.

The data driving unit will now be described in detail with reference to FIG. 8.

Figure 8:
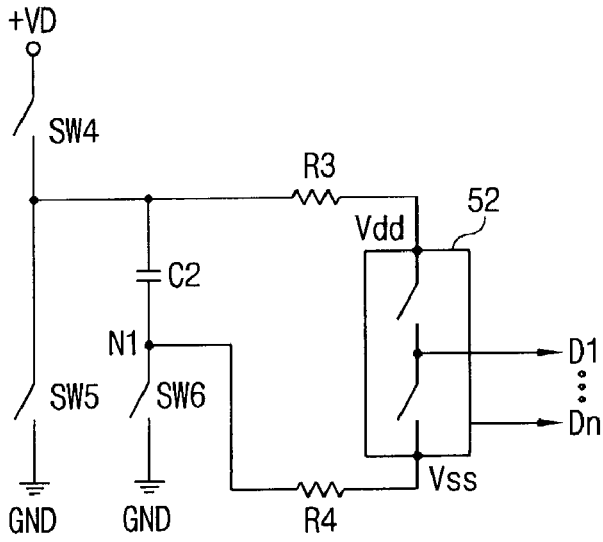
FIG. 8 is a circuit diagram of a data driving unit of FIG. 6.

FIG. 8 is a circuit diagram of a data driving unit of FIG. 6.

As shown in FIG. 8, the data driving unit 32 includes: a single voltage source +VD; a second capacitor C2 for charging a voltage supplied from the single voltage source +VD; a fourth switching device SW4 installed between the single voltage source +VD and the second capacitor C2 and switching a voltage supplied to the second capacitor C2; a fifth switching device SW5 installed between th fourth switching device SW4 and a ground voltage source GND and selectively grounding the second capacitor C2; a data drive IC 52 connected to both ends of the second capacitor C2 and supplying a positive or a negative data pulse supplied from the second capacitor C2 to the data lines S1~Sm; and a sixth switching device SW6 installed between the ground voltage source GND and selectively floating a ground terminal VSS of the data drive IC 52.

The second capacitor C2 and the fourth through the sixth switching devices SW4~SW6 are data pulse supplying parts.

The operation of the data driving unit 32 will now be described in detail.

First, the second capacitor C2 charges a voltage supplied from the single voltage source +VS.

The fourth switching device SW4 is turned on when supplying a positive pulse to the data lines D1~Dn, and the fifth switching device SW5 is turned on when supplying a negative pulse to the data lines D1~Dn.

The sixth switching device SW6 is turned on when a positive pulse is supplied to the data lines (D1~Dn) and turned off when a negative pulse is supplied to the data lines D1~Dn, thereby floating the ground terminal VSS of the data drive IC 52.

The data drive IC 52 includes a plurality of switching devices, and sequentially switches the switching devices upon receiving a control signal (not shown) outputted from a controller (not shown) to supply a positive pulse or a negative pulse supplied from the second capacitor C2 to the data lines D1~Dn.

Third and fourth resistances R3 and R4 are installed between both ends of the data drive IC 52 and the second capacitor C2. The third and fourth resistances R3 and R4 are resistance devices for reducing a peak current when an instantaneous voltage is applied to the data drive IC 52.

For example, when a negative pulse (−Vd) is supplied to the data lines D1~Dn, the fifth switching device SW5 is turned on and the fourth switching device SW4 and the sixth switching device SW6 are turned off.

That is, a power supply terminal Vdd of the data drive IC 52 is connected to the ground voltage source GND through the fifth switching device SW5 and receives a ground voltage.

At this time, the ground terminal VSS of the data drive IC 52 receives the voltage charged in the second capacitor C2 as it is, and since the sixth switching device SW6 is in an OFF state, the voltage flowing at the ground terminal VSS is floated and the polarity level of the voltage charged in the second capacitor C2 is shifted to a negative polarity to become a negative voltage.

Thereafter, the negative data pulse (−Vd) is supplied to the data drive IC 52, and the negative data pulse (−Vd) is simultaneously supplied to every data line D1~Dn by the switching operations of the internal switching devices.

Meanwhile, in case that a positive data pulse (+Vd) is supplied to the data lines S1~Sm, the fourth and sixth switching devices SW4 and SW6 are turned on and the fifth switching device SW5 is turned off.

At this time, power supplied from the single voltage source +VS is charged in the second capacitor C2, so that the charged power is supplied to the power supply terminal Vdd of the data drive IC 52.

At this time, the ground terminal VSS of the data drive IC 52 is connected to the ground voltage source GND through the sixth switching device SW6 and receives the ground voltage.

A positive data pulse +Vd is supplied to the data drive IC 52 and the positive data pulse +Vd is simultaneously supplied to every data line D1~Dn by the switching operation of the internal switching devices.

Figure 9:
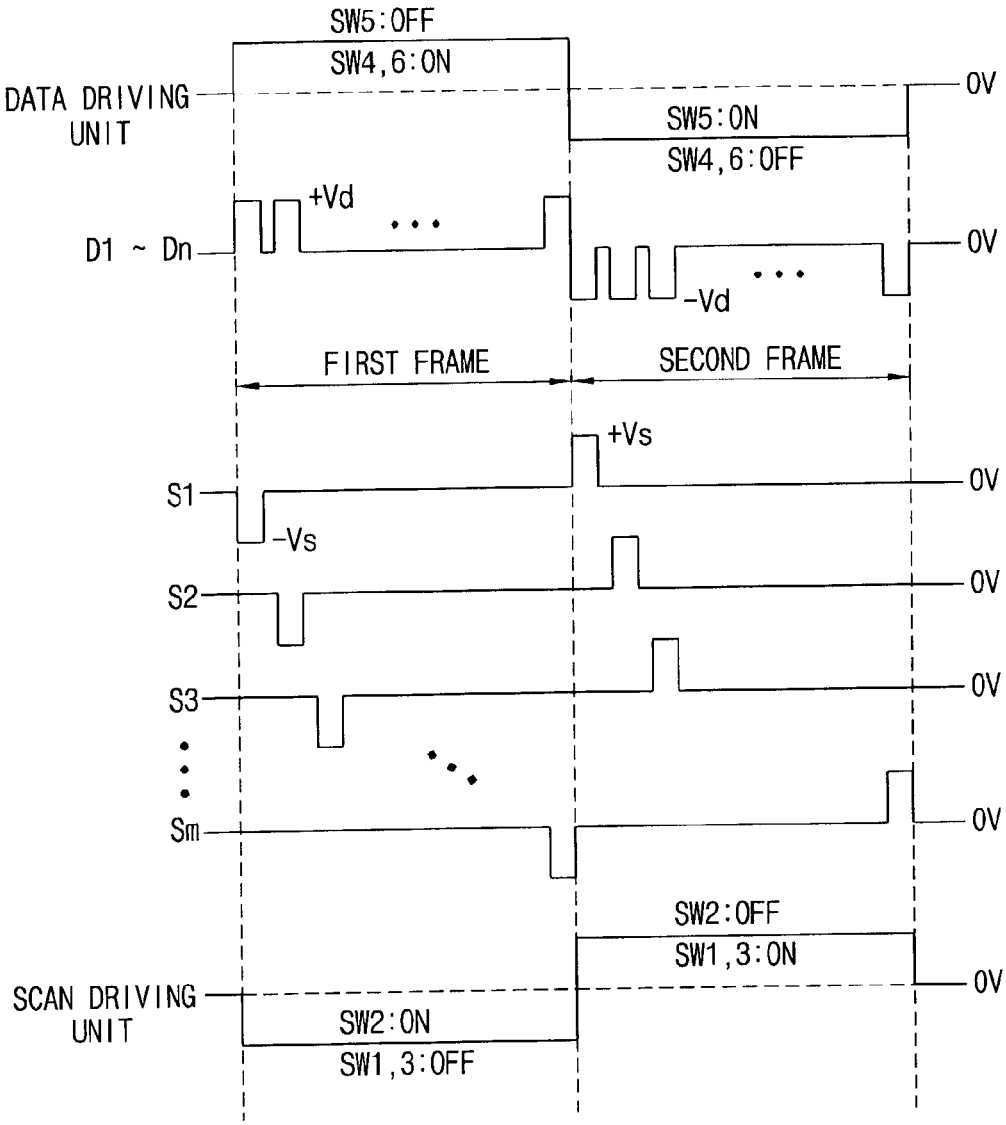
FIG. 9 shows waveforms applied to a panel by a drive timing of the scan driving unit and the data driving unit of FIG. 6.

FIG. 9 shows waveforms applied to a panel by a drive timing of the scan driving unit and the data driving unit of FIG. 6.

As shown in FIG. 9, in a first frame, a negative scan pulse (−Vs) and a positive data pulse (+Vd) are respectively supplied to each scan line S1~Sm and data line D1~Dn, and in a second frame, a positive scan pulse (+Vs) and a negative data pulse (−Vd) are respectively supplied to each scan line S1~Sm and data line D1~Dn.

That is, the positive or negative scan pulse (+Vs, −Vs) or a negative or a positive data pulse (−Vd, +Vd) are reversed by the frame unit and supplied to the scan lines S1~Sm and the data lines D1~Dn.

In other words, the positive or negative data/scan pulses are oppositely supplied to the scan lines S1~Sm and the data lines D1~Dn in the odd number frames and even number frames First, in the first frame (the odd number frame), a negative scan pulse (−Vs) is sequentially supplied from the scan driving unit 34 to the scan lines S1~Sm.

That is, the second switching device SW2 of the scan driving unit 34 is turned on and the first and third switching devices SW1 and SW3 are turned off, the negative scan pulse (−Vs) is sequentially supplied to the scan lines S1~Sm.

At this time, the fifth switching device SW5 of the data driving unit 32 is turned off and the fourth and sixth switching devices SW4 and SW6 are turned on, so that the positive data pulse (+Vd) synchronized with the negative scan pulse (−Vs) is simultaneously supplied to every data lines D1~Dn. In this respect, the data pulse and the scan pulse can be supplied according to the control signal.

In the second frame (the even number frame), a positive scan pulse (+Vs) is sequentially supplied from the scan driving unit 34 to the scan lines S1~Sm.

That is, the second switching device SW2 of the scan driving unit 34 is turned off and the first and third switching devices SW1 and SW3 are turned on, so that the positive scan pulse (+Vs) is sequentially supplied to the scan lines (S1~Sm).

At this time, the fifth switching device SW5 of the data driving unit 32 is turned on and the fourth and sixth switching devices SW4 and SW6 are turned off, so that the negative data pulse (−Vd) synchronized with the positive scan pulse (+Vs) is simultaneously supplied to every data line D1~Dn. In this respect, the data pulse and the scan pulse can be supplied according to the control signal.

Accordingly, in the EL display device in accordance with the first embodiment of the present invention, each polarity of the scan pulse (Vs) and the data pulse (Vd) is reversed to be supplied to the pixel cell 100 per frame.

Or, each polarity of the scan pulse (Vs) and the data pulse (Vd) is reversed to be supplied to the pixel cell 100 at every field That is, the electric charge charged in the pixel cell 100 in the previous frame/field is neutralized by the pulse with the opposite polarity to the polarity of the charged electric charge.

In other words, even if the negative electric charges have been charged in the data electrode and the positive electric charges have been charged in the scan electrode in the previous frame/field, the positive electric charges are charged in the data electrode and the negative electric charges are charged in the scan electrode in the next frame/field. Thus, the uniform voltage can be supplied to each pixel cell 100.

In addition, since the positive and negative scan/data pulse (Vs, Vd) are generated by using the single power source, a power consumption can be reduced.

The power consumption (P) is in proportion to $CV^2$, so that the power consumption can be reduced as the supply voltage (V) of the single power source becomes small. 'C' is a capacitance and 'V' is a voltage.

Namely, the driving units of the present invention uses a half driving voltage of the driving voltage used in the conventional units, so that its power consumption can be reduced to ¼.

Accordingly, in the driving apparatus and method of an electroluminescent display device in accordance with the first embodiment of the present invention, since the positive or negative pulse is generated by using the single power source, its power consumption can be reduced.

In addition, by supplying the positive or negative scan pulse and data pulse are mutually reversed and supplied per frame to the pixel cell, so that the electric charges charged in the pixel cell can be completely removed, and thus, a uniform voltage can be supplied to each pixel cell 100.

Figure 10:
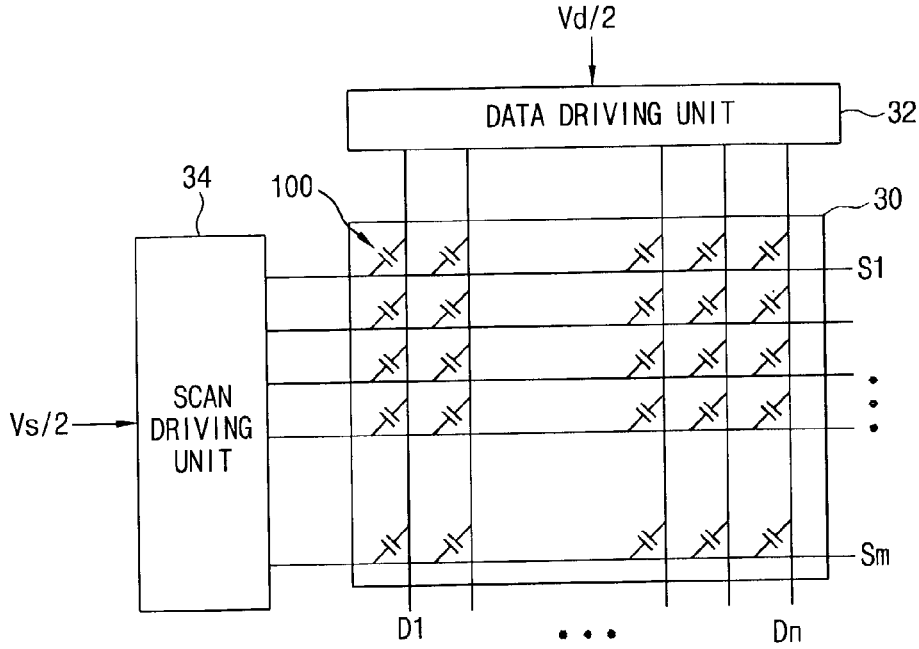
FIG. 10 is a block diagram of a driving apparatus of an EL display device in accordance with a second embodiment of the present invention.

FIG. 10 is a block diagram of a driving apparatus of an EL display device in accordance with a second embodiment of the present invention.

As shown in FIG. 10, an EL display device in accordance with the second embodiment of the present invention includes: a pixel cell 100 positioned at a cross point of data lines D1~Dn and scan lines S1~Sm on a panel 30; a scan driving unit 34 for receiving a single low voltage (Vs/2) and supplying a doubled positive and negative scan pulses (+Vs, −Vs); and a data driving unit 32 supplying a data pulse in synchronization with a scan pulse to the data lines D1~Dn.

The data driving unit 32 supplies a positive or a negative data pulse (+Vd, −Vd) to the data lines D1~Dn. The scan driving unit 34 supplies a negative or a positive scan pulse (−Vs, +Vs) to the scan lines S1~Sm.

The pixel cell 100 is positioned at the cross point of the data lines D1~Dn and the scan lines S1~Sm and turned on/off by an electric field between a scan electrode which receives a positive or a negative scan pulse (+Vs, −Vs) from the scan driving unit 34 and a data electrode which receives a positive or a negative data pulse (+Vd, −Vd) from the data driving unit 32.

Each pixel cell 100 has a certain capacitance value.

The positive or the negative scan pulse (+Vs, −Vs)/data pulse (+Vd, −Vd) supplied to the data lines D1~Dn and scan lines S1~Sm is supplied from the scan driving unit 34 and the data driving unit 32, which will now be described in detail with reference to FIG. 11.

Figure 11:
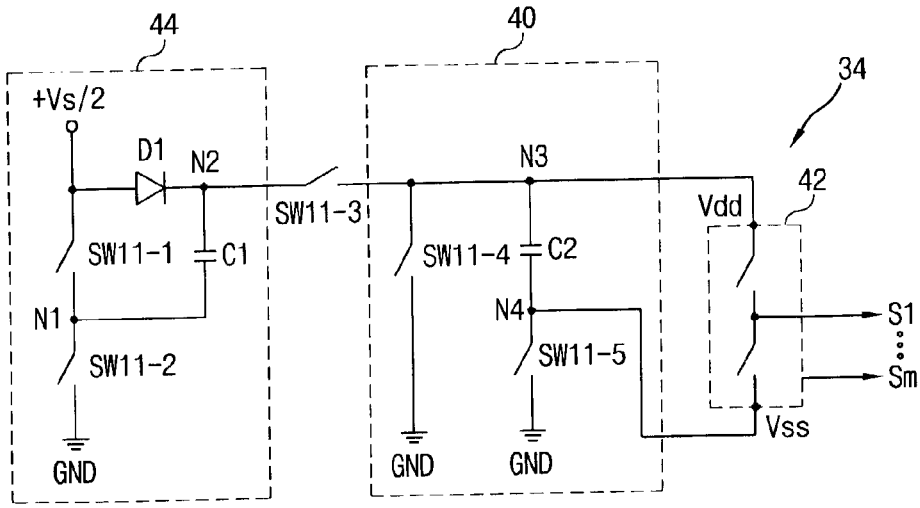
FIG. 11 is a circuit diagram of a scan driving unit of FIG. 10 in accordance with the second embodiment of the present invention.

FIG. 11 is a circuit diagram of the scan driving unit of FIG. 10 in accordance with the second embodiment of the present invention.

As shown in FIG. 11, a scan driving unit 34 of the second embodiment of the present invention reverses a positive or a negative scan pulse (+Vs, −Vs) per frame and supplies it to the scan lines S1~Sm.

That is, the scan driving unit 34 includes: a doubler circuit 44 for receiving a low voltage (Vs/2) and doubling it by integer times; a scan pulse supply unit 40 for selectively shifting a polarity level of the doubled voltage and generating a positive or a negative scan pulse (+Vs, −Vs), and a scan drive IC 42 for supplying one of the positive and negative scan pulses (+Vs, −Vs) supplied from the scan pulse supply unit 40 to the scan lines S1~Sm.

The doubler circuit 44 includes a single low voltage source (Vs/2); first and second switching devices SW11-1 and SW11-2 installed between the single low voltage source (Vs/2) and the ground voltage (GND); a first capacitor C1 installed between first node N1 and second node N2 between the first and second switching devices SW11-1 and SW11-2; and a diode D1 installed between the single low voltage source Vs/2 and the capacitor C1.

The single low voltage source Vs/2 supplies Vs/2, a half of the voltage supplied in the conventional art.

The first and second switching devices SW11-1 and SW11-2 are alternately switched by a control signal to supply the single voltage source (Vs/2) to the first capacitor C1.

The first capacitor C1 doubles the voltage Vs/2 supplied from the single low voltage source (Vs/2) after being alternately switched by the first and second switching devices SW11-1 and SW11-2.

The diode D1 cuts off a reverse voltage supplied to the single low voltage source (Vs/2).

The operation of the scan driving unit in accordance with the second embodiment of the present invention will now be described.

First, as for a doupling process of the doubler circuit, when the second switching device SW11-1 is turned on by the control signal, the low voltage Vs/2 supplied from the single low voltage source Vs/2 is charged into the first capacitor C1, so that Vs/2 voltage flows on the second node N2.

Thereafter, when the second switching device SW11-2 is turned off and the first switching device SW11-1 is turned on, the Vs/2 voltage supplied from the single low voltage source (Vs/2) and the Vs/2 voltage charged in the first capacitor C1 are added and doubled voltage Vs flows on the second node N2.

After the voltage supplied from the single low voltage source Vs/2 is doubled, the doubled voltage Vs is supplied to the scan pulse supply unit 40.

At this time, the third switching device SW11-3 is installed between the doubler circuit 44 and the scan pulse driving unit 40 in order to supply the voltage Vs doubled by the doubler circuit 44 to the scan pulse supply unit 40.

As the third switching device SW11-3 is turned on, the doubled voltage Vs is supplied to the scan pulse supply unit 40.

The scan pulse supply unit 40 reverses the polarity of the doubled voltage Vs by the frame unit and supplies it to the scan drive IC 42.

That is, the scan pulse supply unit 40 includes fourth and fifth switching devices SW11-4 and SW11-5 respectively installed in parallel between the ground voltage source (GND) and the third switching device SW11-3; and a second capacitor C2 installed between the fourth switching device SW11-4 and the fifth switching device SW11-5.

The fourth switching device SW11-4 is turned on when supplying a negative scan pulse to the scan lines S1~Sm, and the fifth switching device SW11-5 is turned on when supplying a positive scan pulse to the scan lines S1~Sm.

The second capacitor C2 charges the doubled voltage Vs supplied from the doubler circuit 44 through the third switching device SW11-3.

The operation of the scan pulse supply unit 40 will now be described.

First, when a negative scan pulse (−Vs) is supplied to the, scan drive IC 42, the fourth switching device SW11-4 is turned on and the fifth switching device SW11-5 are turned off.

At this time, the voltage flowing at the third node N3 flows to the ground voltage source (GND) through the fourth switching device SW11-4 and becomes a ground voltage.

The voltage flowing at the fourth node N4 is the same as the voltage charged in the second capacitor C2.

A polarity (level) of the voltage flowing at the fourth node N4 is shifted to a negative polarity. Accordingly, a negative scan pulse (−Vs) is supplied to the scan drive IC 42.

In case that a positive scan pulse (+Vs) is supplied to the scan drive IC 42, the fourth switching device SW11-4 is turned off and the fifth switching device SW11-5 is turned on. At this time, the doubled voltage Vs is charged in the second capacitor C2 and flows on the third node N3.

The fourth node N4 is connected to the ground voltage source GND through the fifth switching device SW11-5, so that the voltage flowing at the fourth node becomes a ground voltage. Accordingly, the positive scan pulse (+Vs) is supplied to the scan drive IC 42.

The scan drive IC 42 sequentially supplies the positive or negative scan pulse (+Vs, −Vs) supplied after being reversed by the frame unit from the scan pulse supply unit 40, to the scan lines S1~Sm, for which the scan drive IC 42 includes a plurality of switching devices (not shown) which are sequentially turned on by a control signal.

Figure 12:
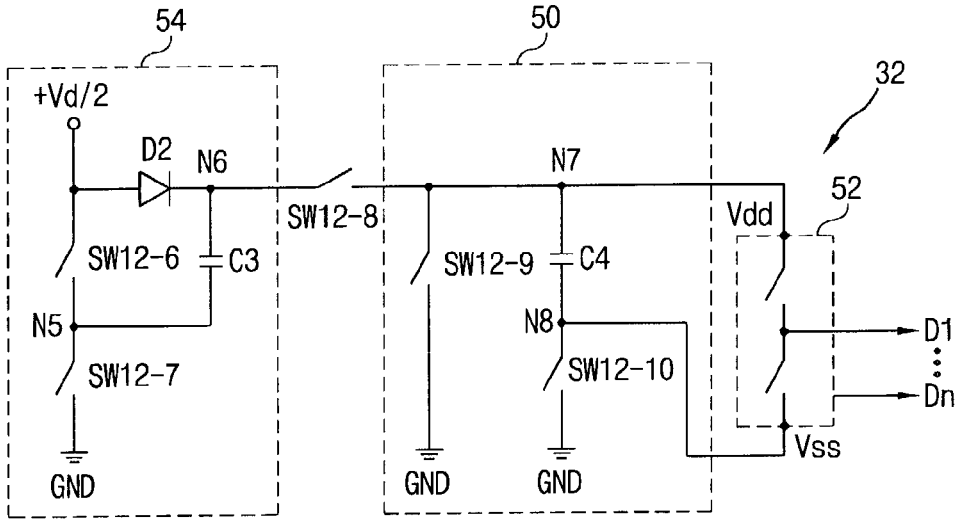
FIG. 12 is a circuit diagram of a data driving unit of FIG. 10 in accordance with the second embodiment of the present invention.

FIG. 12 is a circuit diagram of a data driving unit of FIG. 10 in accordance with the second embodiment of the present invention.

As shown in FIG. 12, a data driving unit 32 in accordance with the second embodiment of the present invention supplies a data pulse with the opposite polarity to a positive or negative scan pulse (+Vs, −Vs) supplied to the scan lines S1~Sm after being reversed by the frame unit.

The data driving unit 32 includes: a doubler circuit 54 for receiving a single low voltage Vd/2 and doubling it; a data pulse supply unit 50 for shifting a polarity of the doubled voltage Vd by the frame unit and generating a positive or a negative data pulse (+Vd, −Vd); and a data drive IC 52 for simultaneously supplying one of the positive and negative data pulse (+Vd, −Vd) supplied from the data pulse supply unit 50, to the data lines D1~Dn.

The doubler circuit 54 includes sixth and seventh switching devices SW12-6 and SW12-7 installed between the single low voltage source Vd/2 and the ground voltage source GND; a third capacitor C3 installed between a fifth node N5 and a sixth node N6 between sixth and seventh switching devices SW12-6 and SW12-7; and a diode D2 installed between the single low voltage source Vd/2 and the third capacitor C3.

The single low voltage source Vd/2 supplies a voltage as much as Vd/2, the half of the voltage supplied in the conventional art.

The sixth and seventh switching devices SW12-6 and SW12-7 are alternately switched by a control signal and supplies a low voltage Vd/2 to the third capacitor C3.

The third capacitor C3 doubles the voltage Vs/2 supplied from the single low voltage source (Vs/2) after being alternately switched by the sixth and seventh switching devices SW12-6 and SW12-7.

The diode D2 cuts off a reverse voltage supplied to the single low voltage source (Vs/2).

The doubling process of the doubler circuit 54 will now be described in detail.

First, when the seventh switching device SW12-7 is turned on by the control signal, the low voltage Vd/2 supplied from the single low voltage source Vd/2 is charged into the third capacitor C3, so that the voltage as much as Vd/2 flows on the sixth node N6.

Thereafter, when the seventh switching device SW12-7 is turned off and the sixth switching device SW12-6 is turned on, the Vd/2 voltage supplied from the single low voltage source (Vd/2) and the Vd/2 voltage charged in the third capacitor C3 are added and doubled voltage Vs flows on the sixth node N6.

After the voltage supplied from the single low voltage source Vd/2 is doubled, the doubled voltage Vd is supplied to the data pulse supply unit 50.

At this time, the eighth switching device SW12-8 is installed between the doubler circuit 54 and the data pulse driving unit 50 in order to supply the voltage Vd doubled by the doubler circuit 54 to the data pulse supply unit 50.

That is, as the eighth switching device SW12-8 is turned on, the doubled voltage Vd is supplied to the data pulse supply unit 50.

The data pulse supply unit 50 reverses the polarity of the doubled voltage Vd by the frame unit and supplies it to the data drive IC 52.

That is, the data pulse supply unit 50 includes ninth and tenth switching devices SW12-9 and SW12-10 respectively installed in parallel between the ground voltage source (GND) and the eighth switching device SW12-8; and a fourth capacitor C4 installed between the ninth switching device SW12-9 and the tenth switching device SW12-10.

The ninth switching device SW12-9 is turned on when supplying a negative data pulse to the data lines D1~Dn, and the tenth switching device SW12-10 is turned on when supplying a positive data pulse to the data lines D1~Dn.

The fourth capacitor C4 charges the doubled voltage Vd supplied from the doubler circuit 54 through the eighth switching device SW12-8.

The operation of the data pulse supply unit 50 will now be described.

First, when a negative data pulse (−Vd) is supplied to the data drive IC 52, the ninth switching device SW12-9 is turned on and the tenth switching device SW12-10 are turned off.

At this time, the voltage flowing at the seventh node N7 flows to the ground voltage source (GND) through the ninth switching device SW12-9 and becomes a ground voltage.

The voltage flowing at the eighth node N8 is the same as the voltage charged in the fourth capacitor C4.

A polarity (level) of the voltage flowing at the eighth node N8 is shifted to a negative polarity. Accordingly, a negative data pulse (−Vd) is supplied to the data drive IC 52.

In case that a positive data pulse (+Vd) is supplied to the data drive IC 52, the ninth switching device SW12-9 is turned off and the tenth switching device SW12-10 is turned on. At this time, the doubled voltage Vd is charged in the fourth capacitor C4 and flows on the seventh node N7.

The voltage flowing at the eighth node N8 is connected to the ground voltage source GND through the tenth switching device SW12-10 and becomes a ground voltage. Accordingly, the positive data pulse (+Vd) is supplied to the data drive IC 52.

The data drive IC 52 simultaneously supplies the positive or negative data pulse (+Vd, −Vd) supplied after being reversed by the frame unit from the data pulse supply unit 50, to the data lines D1~Dn. In this respect, the data drive IC 52 includes a plurality of switching devices (not shown) which are simultaneously turned on by a control signal.

A driving method of an EL display device in accordance with the second embodiment of the present invention will now be described with reference to FIG. 13.

Figure 13:
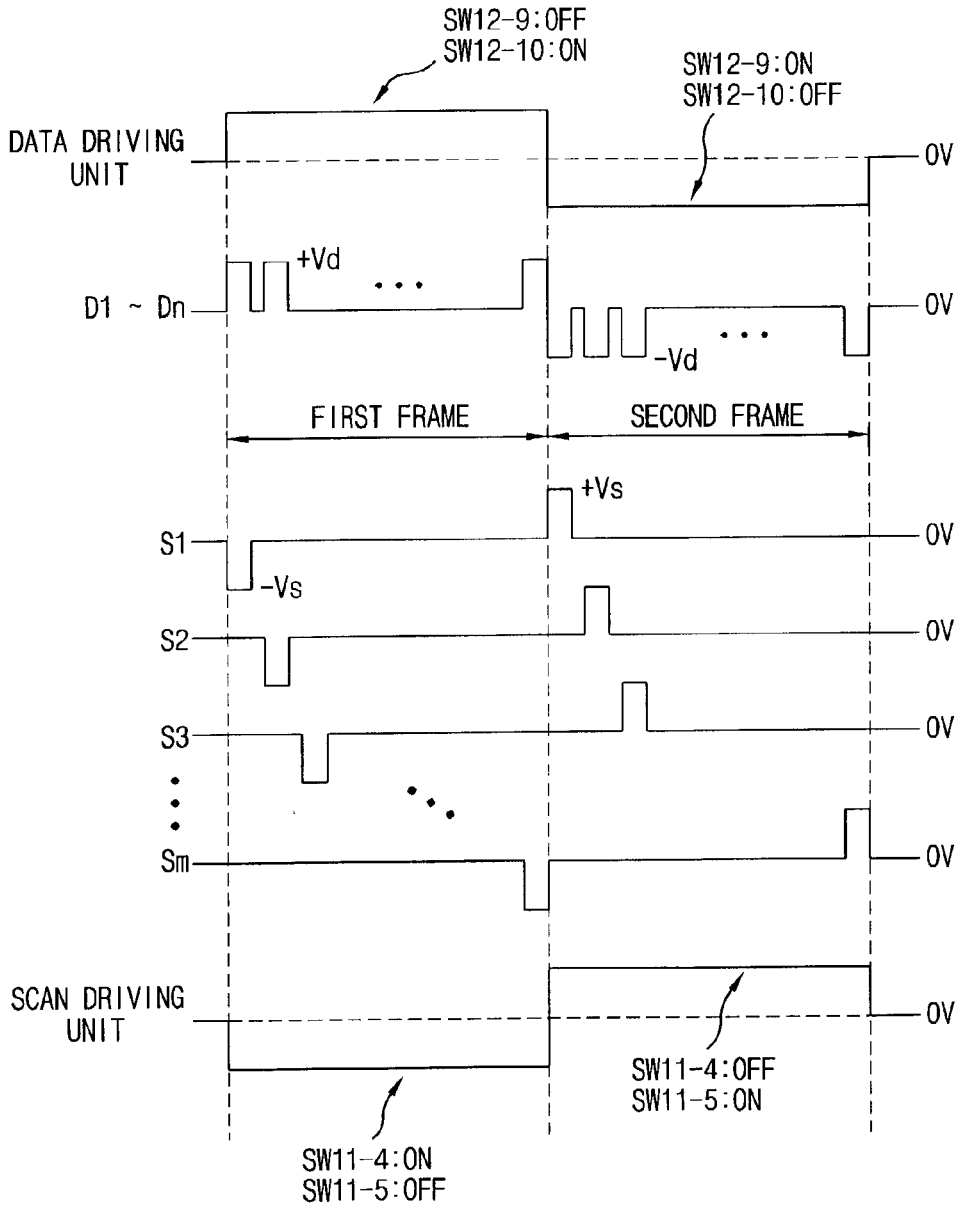
FIG. 13 shows waveforms applied to a panel by a drive timing of the scan driving unit and the data driving unit of FIG. 10.

FIG. 13 shows waveforms applied to a panel by a drive timing of the scan driving unit and the data driving unit of FIG. 10.

As shown in FIG. 13, scan and data pulse with mutually opposite polarity in the frame and second frame are supplied to the scan lines S1~Sm and data lines D1~Dn.

First, in the first frame, a negative scan pulse Vs is sequentially supplied from the scan driving unit 34 to the scan lines S1~Sm, and a positive data pulse +Vd is supplied from the data driving unit 32 to the data lines D1~Dn.

At this time, the data pulse is synchronized with the scan pulse. That is, the doubled voltage outputted from the doubler circuit 44 is received through the switching device SW11-3 to turn on the fourth switching device SW11-4 of the scan driving unit 34 and turn off the fifth switching device SW11-5, so that the negative scan pulse (−Vs) is sequentially supplied to the scan lines S1~Sm.

At this time, the doubled voltage (Vd) supplied from the doubler circuit 54 is received through the switching device SW12-8, so as to turn off the ninth switching device SW 12-9 and turn on the tenth switching device SW12-10, so that the positive data pulse (+Vd) in synchronization with the negative scan pulse (−Vs) is simultaneously outputted to every data line D1~Dn.

In the second frame, the positive scan pulse (+Vs) is sequentially supplied from scan driving unit 34 to the scan lines S1~Sm, and the negative data pulse (−Vd) in synchronization with the scan pulse is supplied from the data driving unit 32 to the data lines D1~Dn.

That is, the doubled voltage (Vs) outputted from the doubler circuit 44 is received through the switching device SW11-3 to turn off the fourth switching device SW11-4 and turn on the fifth switching device SW11-5, so that the positive scan pulse (+Vs) is sequentially supplied to the scan lines S1~Sm.

At this time, the doubled voltage (Vd) supplied from the doubler circuit 54 is received through the switching device SW12-8 to turn on the ninth switching device SW12-9 of the data driving unit 32 and turn off the tenth switching device SW12-10, so that the negative data pulse (−Vd) in synchronization with the positive scan pulse (+Vs) is simultaneously outputted to every data line (D1~Dn).

Accordingly, the EL display device in accordance with the second embodiment of the present invention reverses each polarity of the scan pulse (Vs) and the data pulse (Vd) by frame unit and supplies the scan pulse and a data pulse with mutually opposite polarity to the pixel cell 100.

Or, the scan pulse (Vs) and the data pulse (Vd) are reversed to have the mutually opposite polarity at every field and supplied to the pixel cell 100.

As a result, the polarity of the electric charge charged in the previous frame/field is reversed and neutralized (a state that there is no electric charge), so that the pixel cell 100 receives the constantly uniform voltage.

That is, even if a negative electric charge is charged in the data electrode and a positive electric charge is charged in the scan electrode in the previous frame/field, since the positive electric charge is charged in the data electrode and a negative electric charge is charged in the scan electrode in the next frame/field, the electric charge charged in the pixel cell 100 can be completely removed.

In addition, since the positive and negative scan/data pulse (Vs, Vd) is generated by using the low voltage single power source and the doubler circuit, a power consumption can be reduced.

The power consumption (P) is in proportion to CV2, the power consumption can be reduced as the supply voltage (V) of the single low power source becomes small. That is, the driving units of the present invention use a half of the driving voltage of the conventional units, so that a power consumption can be reduced to ¼.

Figure 14:
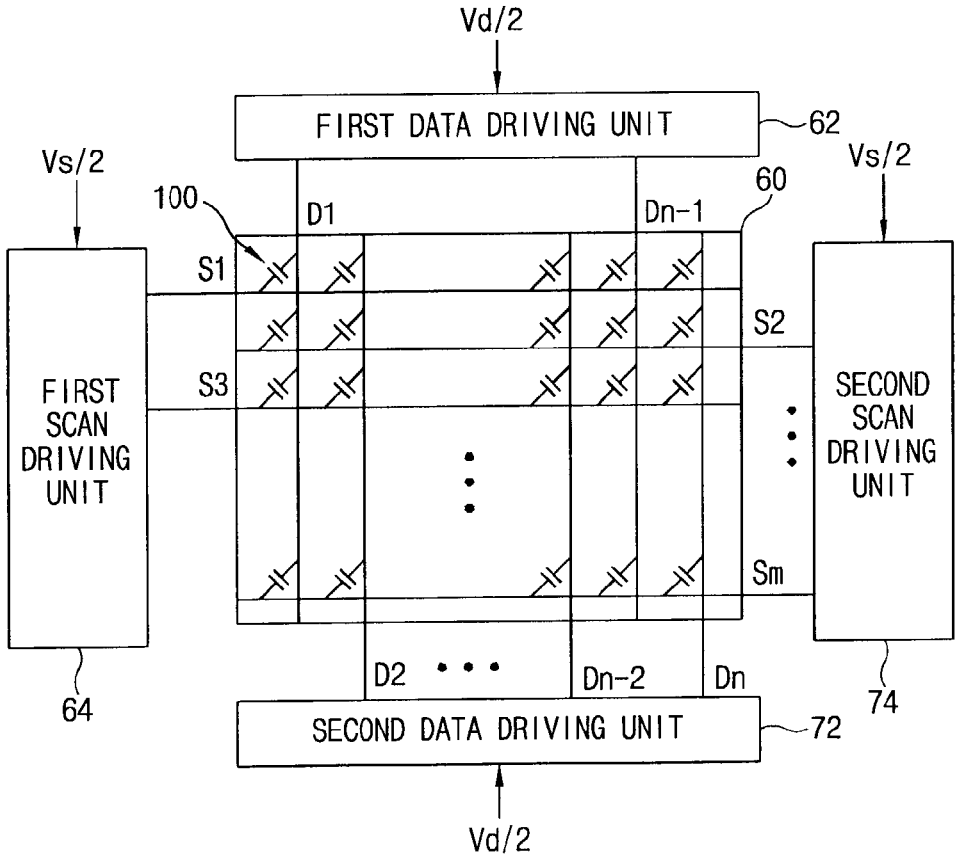
FIG. 14 is a block diagram of a driving apparatus of an EL display device in accordance with a third embodiment of the present invention.

FIG. 14 is a block diagram of a driving apparatus of an EL display device in accordance with a third embodiment of the present invention.

As shown in FIG. 14, an EL display device in accordance with the third embodiment of the present invention includes: a pixel cell 100 positioned at a cross point of the data lines D1~Dn and the scan lines S1~Sm on a panel 60; first and second scan driving units 64 and 74 for supplying a positive or negative scan pulse to odd number or even number scan lines S1~Sm; and first and second data driving units 62 and 72 for supplying a data pulse to odd number and even number data lines D1~Dn.

The operation of the EL display device in accordance with the third embodiment of the present invention will now be described.

First, the first scan driving unit 64 supplies a positive or negative scan pulse (+Vs, −Vs) to the odd number scan lines S1~Sm-1).

The second scan driving unit 74 supplies a positive or negative scan pulse (+Vs, −Vs) to the even number scan lines S2~Sm.

The first data driving unit 62 supplies a positive or a negative data pulse (+Vd, −Vd) to the odd number data lines D1~Dn-1.

The second data driving unit 72 supplies a positive or a negative data pulse (+Vd, −Vd) to the even number data lines D2~Dn.

The pixel cell 100 is positioned at a cross point of the data lines D1~Dn and the scan lines S1~Sm and turned on/off by an electric field between a scan electrode (not shown) which receives a positive or a negative scan pulse (+Vs, −Vs) from the first and second scan driving units 64 and 74 and a data electrode (not shown) which receives a positive or a negative data pulse (+Vd, −Vd) from the first and second data driving units 62 and 72.

Each pixel cell 100 has a certain capacitance value.

Figure 15A:
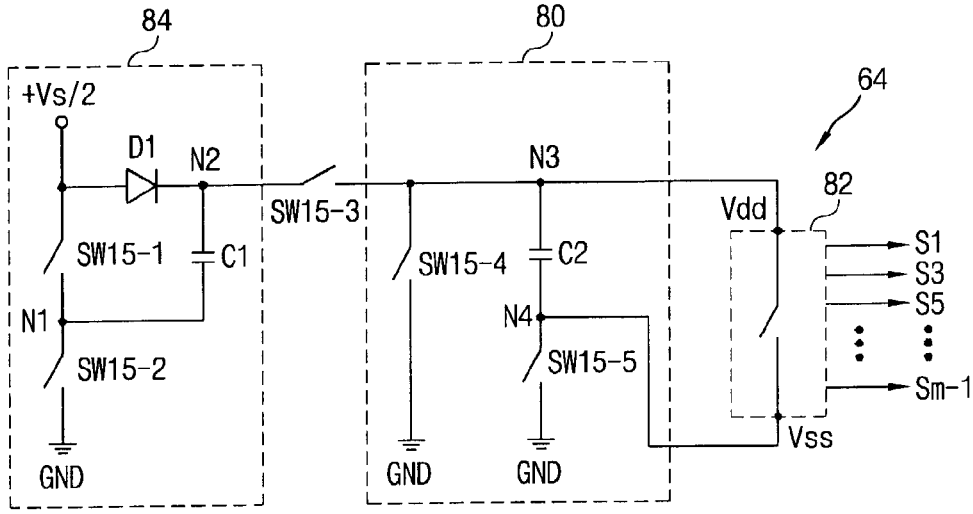
FIG. 15A is a circuit diagram of a first scan driving unit of FIG. 14.

FIG. 15A is a circuit diagram of the first scan driving unit of FIG. 14.

As shown in FIG. 15A, the first scan driving unit 64 includes: a first doubler circuit 84 for receiving a single low voltage (Vs/2) and doubling it; a first scan pulse supply unit 80 for shifting a polarity level of the doubled voltage Vs by the scan line unit and generating a positive and a negative scan pulse (+Vs, −Vs); and a first scan drive IC 82 for supplying the positive and negative scan pulse (+Vs, −Vs) supplied from the first scan pulse supply unit 80, to the odd number scan lines S1~Sm-1).

The first doubler circuit 84 includes the single low voltage source (Vs/2), first and second switching devices (SW15-1, SW15-2) installed between the single low voltage source (Vs/2) and the ground voltage source (GND); a first capacitor (C1) installed between the first node N1 and the second node N2 between the first and second switching devices SW15-1 and SW15-2; and a diode D1 installed between the single low voltage source (Vs/2) and the first capacitor (C1).

The single low voltage source (Vs/2) supplies the voltage Vs/2, the half of the voltage supplied in the conventional art.

The first and second switching devices SW15-1 and SW15-2 are alternately switched to supply the low voltage Vs/2 to the first capacitor C1.

The first capacitor C1 doubles the voltage Vs/2 supplied by the switching operation of the first and second switching devices SW15-1 and SW15-2.

The diode D1 cuts off an reverse voltage supplied to the single low voltage source (Vs/2).

The doubling process by the first doubler circuit will now be described.

First, when the second switching device SW15-2 is turned on by the control signal, the voltage Vs/2 supplied from the single low voltage source is charged in the first capacitor C1 and the Vs/2 voltage flows on the second node N2.

Thereafter, when the second switching device SW15-2 is turned off and the first switching device SW15-1 is turned on, the Vs/2 voltage supplied from the single low voltage source Vs/2 and the Vs/2 voltage charged in the first capacitor C1 are added so that the doubled voltage Vs flows on the second node N2.

The voltage supplied from the single low voltage source Vs/2 is doubled and the doubled voltage Vs is supplied to the first scan pulse supply unit 80.

At this time, the third switching device SW15-3 is installed between the doubler circuit 40 and the first scan pulse supply unit 80 in order to supply the voltage Vs doubled by the doubler circuit 84 to the first scan pulse supply unit 80.

As the third switching device SW15-3 is turned on, the doubled voltage Vs is supplied to the first scan pulse supply unit 80.

The first scan pulse supply unit 80 reverses a polarity level of the doubled voltage Vs to be the opposite at every scan line, reverses it by the frame unit and supplies it to the scan drive IC 82.

That is, the first scan pulse supply unit 80 includes fourth and fifth switching devices SW15-4 and SW15-5 installed in parallel between the ground voltage source GND and the third switching device SW15-3, and the second capacitor C2 installed between the fourth switching device SW15-4 and the fifth switching device SW15-5.

The fourth switching device SW15-4 is turned on when a negative scan pulse (−Vs) is supplied to the odd number scan lines S1~Sm-1, and the fifth switching device SW15-5 is turned on when a positive scan pulse (+Vs) is supplied to the odd number scan lines S1~Sm-1.

The second capacitor C2 charges the voltage Vs supplied from the first doubler circuit 84 through the third switching device SW15-3.

The operation of the first scan pulse supply unit 80 in accordance with the third embodiment of the present invention will now be described.

First, when a negative scan pulse (−Vs) is supplied to the first scan drive IC 82, the fourth switching device SW15-4 is turned on and the fifth switching device SW15-5 is turned off.

At this time, the voltage on the third node N3 becomes a ground voltage as it flows to the ground voltage source GND through the fourth switching device SW15-4.

Meanwhile, the voltage strength of the fourth node N4 is the same as the strength of the voltage charged in the second capacitor C2. The voltage level on the fourth node N4 is shifted to a negative polarity. Accordingly, the negative scan pulse (−Vs) is supplied to the first scan drive IC 82.

In case that a positive scan pulse (+Vs) is supplied to the first scan drive IC82, the fourth switching device SW15-4 is turned off and the fifth switching device SW15-5 is turned on. At this time, the voltage Vs supplied from the first doubler circuit 84 is charged in the second capacitor C2 and flows on the third node N3.

The voltage on the fourth node N4 is connected to the ground voltage source GND through the fifth switching device SW15-5 and becomes a ground voltage. Accordingly, the positive scan pulse (+Vs) is supplied to the first scan drive IC 82.

The first scan drive IC 82 reverses the scan pulse supplied from the first scan pulse supply unit 80 to be the opposite at every scan line as well as reverses the scan pulse by the frame unit and supplies a positive or a negative scan pulse (+Vs, −Vs) to the odd number scan lines S1~Sm-1.

The scan drive IC 42 includes a plurality of switching devices (not shown) which are sequentially turned on by a control signal.

The second scan driving unit 74 supplies a positive or a negative scan pulse (+Vs, −Vs) to the even number scan line (S2~Sm) and is operated in the same manner as that of the first scan driving unit 64.

The second scan drive IC 92 supplies a positive and a negative scan pulse (+Vs, −Vs) supplied from the second doubler circuit 94 and the second scan pulse supply unit 90, to the even number scan lines S2~Sm.

Figure 15B:
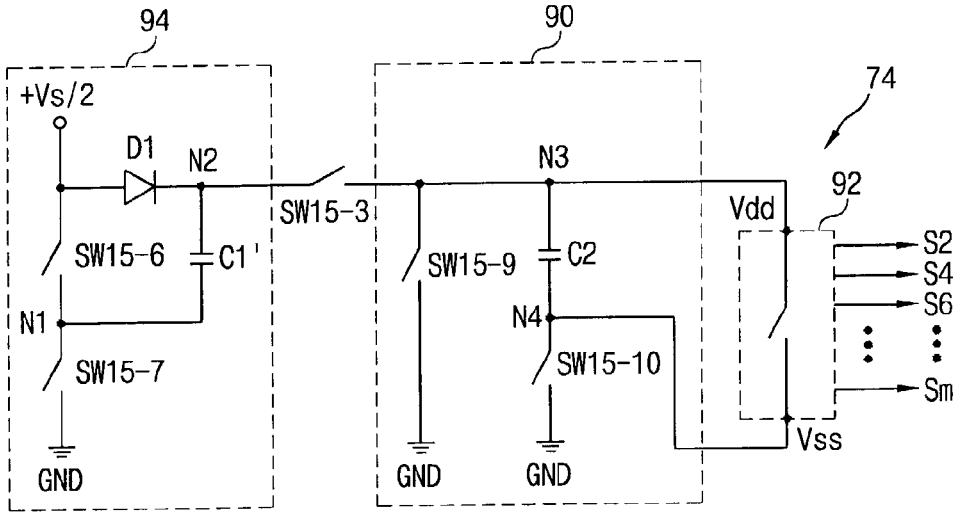
FIG. 15B is a circuit diagram of a second scan driving unit of FIG. 14.

FIG. 15B is a circuit diagram of the second scan driving unit of FIG. 14.

As shown in FIG. 15B, the second scan driving unit 74 reverses a positive or a negative scan pulse (+Vs, −Vs) to be the opposite at every even number scan line S2~Sm as well as reverses it by the frame unit to supply.

For example, in case that a negative scan pulse (−Vs) is supplied to the odd number scan lines S1~Sm-1 in one frame, a positive scan pulse (+Vs) is supplied to the even number scan lines S2~Sm.

In case that a positive scan pulse (+Vs) is supplied to the odd number scan lines S1~Sm-1 in the second frame, a negative scan pulse (−Vs) is supplied to the even number scan lines (S2~Sm).

At this time, the first and second data driving units 62 and 72 are synchronized with the scan pulse (+Vs, −Vs) of which polarities are reversed at every adjacent scan line, and supplies a negative or a positive data pulse (−Vd, +Vd) with the polarity opposite to the polarity of the scan pulse, to the data lines D1~Dn.

Figure 16A:
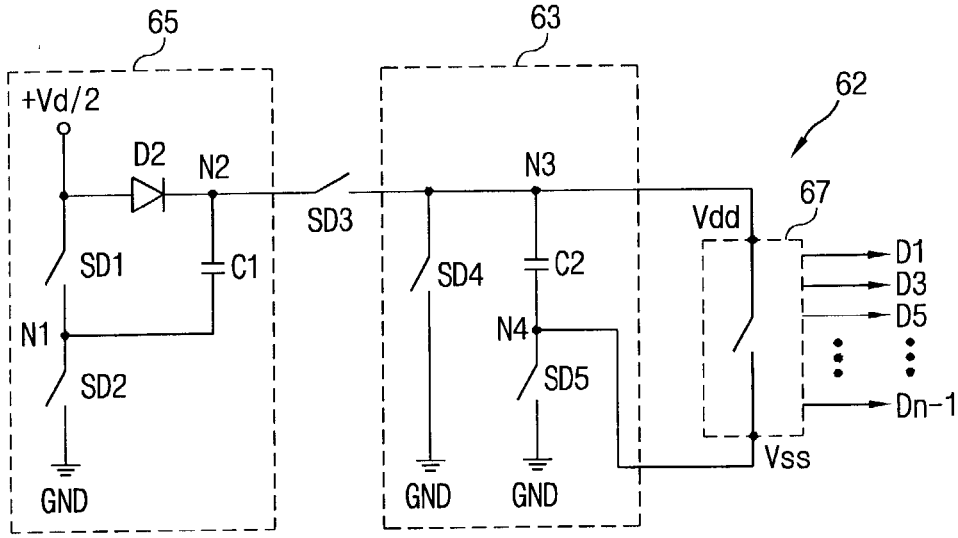
FIG. 16A is a circuit diagram of a first data driving unit of FIG. 14.

FIG. 16A is a circuit diagram of a first data driving unit of FIG. 14.

As shown in FIG. 16A, the first data driving unit 52 includes: a first doubler circuit 65 for receiving the single low voltage Vd/2 and doubling it; a first data pulse supply unit 63 for shifting a polarity level of the doubled voltage Vd at every data line and generating a positive and a negative data pulses (+Vd, −Vd); and a first data drive IC 67 for simultaneously supplying the positive and negative data pulses (+Vd, −Vd) supplied from the firs data pulse supply unit 63, to the odd number data lines D1~Dn-1.

The first doubler circuit 54 includes a single low voltage source Vd/2; first and second switching devices SD1 and SD2 installed between the single low voltage source Vd/2 and the ground voltage source GND; a first capacitor C1 installed between the first node N1 and the second node N2 between the first and second switching devices SD1 and SD2; and a diode D1 installed between the single voltage source Vd/2 and the first capacitor C1.

The first and second switching devices SD1 and SD2 are alternately switched by a control signal and supplies the single low voltage Vd/2 to the first capacitor C1.

The first capacitor C1 doubles the voltage Vs/2 supplied from the single low voltage source Vd/2 after being alternately switched by the first and second switching devices SD1 and SD2. The diode D1 cuts off a reverse voltage supplied to the single low voltage source Vs/2.

The doubling process by the first doubler circuit will now be described.

First, when the second switching device SD2 is turned on by the control signal, the low voltage Vd/2 supplied from the single low voltage source is charged in the first capacitor C1 and Vd/2 voltage flows on the second node N2.

Thereafter, when the second switching device SD2 is turned off and the first switching device SD1 is turned on, the Vd/2 voltage supplied from the single low voltage source (Vd/2 and the Vd/2 voltage charged in the first capacitor C1 are added and doubled voltage Vs flows on the second node N2.

The low voltage supplied from the single low voltage source Vd/2 is doubled, and the doubled voltage Vd is supplied to the first data pulse supply unit 63.

At this time, the third switching device SD3 is installed between the first doubler circuit 65 and the first data pulse supply unit 63 in order to supply the voltage Vd doubled by the first doubler circuit 65, to the first data pulse supply unit 63.

As the third switching device SD3 is turned on, the doubled voltage Vd is supplied to the first data pulse supply unit 63.

The first data pulse supply unit 63 receives the voltage Vd supplied from the first doubler circuit 65 and supplies a positive or a negative data pulse (+Vd, −Vd) to the data drive IC 67, for which the first data pulse supply unit 63 includes fourth and fifth switching devices SD4 and SD5 respectively installed in parallel between the ground voltage source GND and the third switching device SD3 and a second capacitor C2 installed between the fourth switching device SD4 and the fifth switching device SD5.

The fourth switching device SD4 is turned on when a negative data pulse (−Vd) is supplied to the odd number data lines D1~Dn-1, and the fifth switching device SD5 is turned on when a positive data pulse (+Vd) is supplied to the odd number data lines D1~Dn-1.

The second capacitor C2 charges the voltage Vd supplied from the first doubler circuit 65 through the third switching device SD3.

The operation of the first data pulse supply unit 63 will now be described in detail.

First, when the negative data pulse (−Vd) is supplied to the first data drive IC 67, the fourth switching device SD4 is turned on and the fifth switching device SD5 is turned off. Accordingly, the voltage on the third node N3 flows to the ground voltage source GND through the fourth switching device SD4 and becomes the ground voltage.

The voltage of the fourth node N4 is the same as the voltage charged in the second capacitor C2.

The voltage level on the fourth node N4 is shifted to a negative polarity. Accordingly, the negative data pulse −Vd is supplied to the first data drive IC67.

In case that the positive data pulse (+Vd) is supplied to the first data drive IC 67, the fourth switching device SD4 is turned off and the fifth switching device SD5 is turned on. Accordingly, the voltage Vd supplied from the first doubler circuit 65 is charged in the second capacitor C2 and flows on the third node N3.

The voltage flowing on the fourth node N4 is connected to the ground voltage source GND through the fifth switching device SD5 and becomes a ground voltage. Accordingly the positive data pulse (+Vd) is supplied to the first data drive IC 67.

The first data drive IC 67 simultaneously supplies a positive or a negative data pulse (+Vd, −Vd) to the odd number data lines D1~Dm-1 per frame and data line, for which the first data drive IC 67 includes a plurality of switching devices (not shown) which are turned on by a control signal.

The second data driving unit 72 supplies a positive or a negative data pulse (+Vd, −Vd) to the even number data lines D2~Dn has the same operation as that of that of the first data driving unit 62. The second data drive IC 77 supplies a positive or a negative data pulse (+Vd, −Vd) supplied from the second doubler circuit 75 and the second data pulse supply unit 73 to the even number data lines D2~Dn.

Figure 16B:
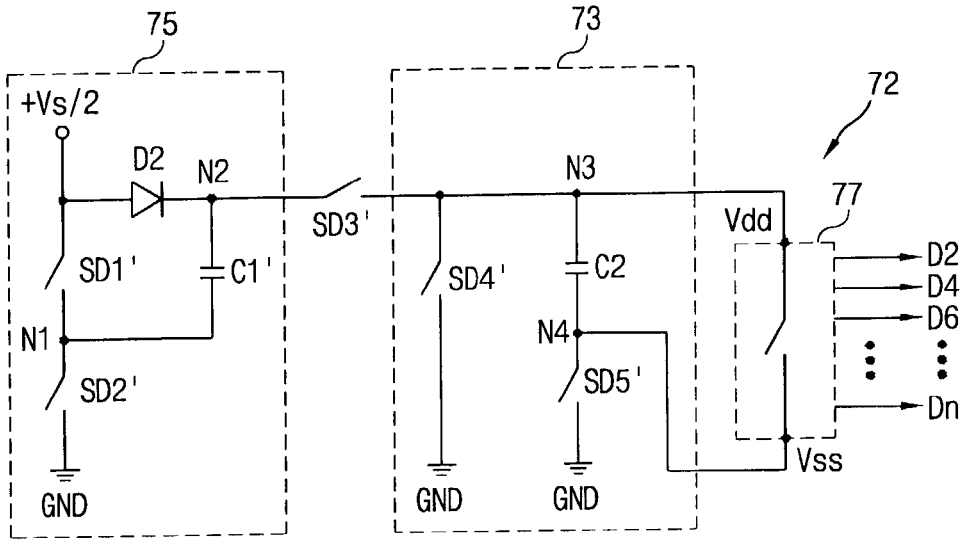
FIG. 16B is a circuit diagram of a second data driving unit of FIG. 14.

FIG. 16B is a circuit diagram of a second data driving unit of FIG. 14.

As shown in FIGS. 16A and 16B, in the second data driving unit 72, a positive or a negative data pulse (+Vd, −Vd) supplied to even number data lines D2~Dn is reversed per frame/field so as to be supplied with the opposite polarity to a positive or a negative data pulse (+Vd, −Vd) which are reversed per frame/field and supplied to the odd number data lines D1~Dn-1.

For example, in the first frame, in case that a positive data pulse (+Vd) is supplied to the odd number data lines D1~Dn-1, a negative data pulse (−Vd) is supplied to the even number data lines D2~Dn. In the second frame, if a negative data pulse (−Vd) is supplied to the odd number data lines D1~Dn-1, a positive data pulse (+Vd) is supplied to the even number data lines D2~Dn, which will now be described in detail with reference to FIG. 17.

Figure 17:
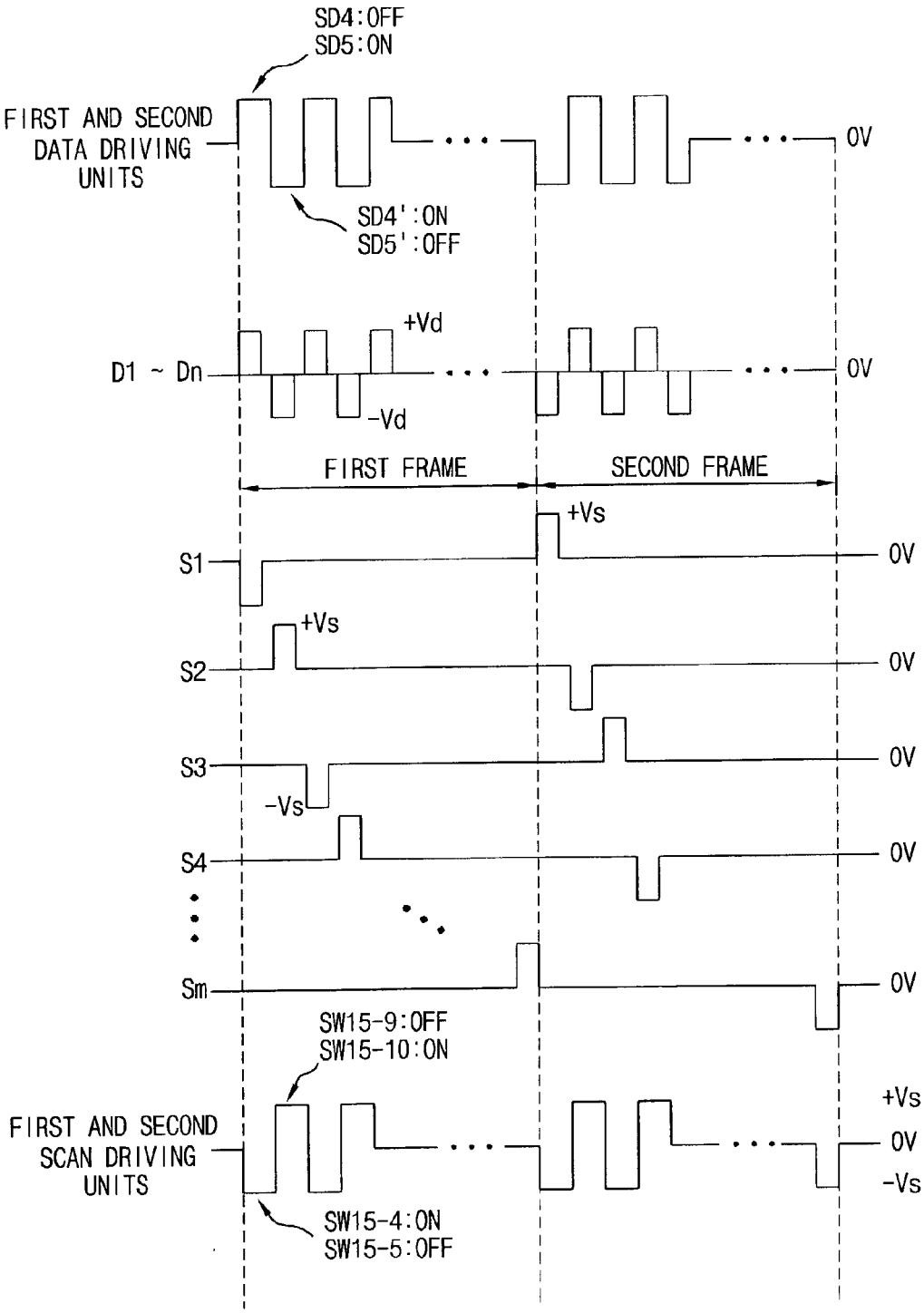
FIG. 17 shows waveforms applied to a panel by a drive timing of the first and second scan/data driving unit and the data driving unit of FIG. 14.

FIG. 17 shows waveforms applied to a panel by a drive timing of the first and second scan/data driving unit and the data driving unit of FIG. 14.

As shown in FIG. 17, in the driving method of an EL display device in accordance with the third embodiment of the present invention, a scan pulse and a data pulse supplied to mutually adjacent scan lines and data lines in the first and second frames are reversed to be opposite to each other and supplied.

In the first frame, a negative scan pulse (−Vs) is supplied from the first scan driving unit 64 to the first scan line S1, and a positive scan pulse (+Vs) is supplied from the second scan driving unit 74 to the second scan line S2.

That is, the negative scan pulse (−Vs) is supplied from the first scan driving unit 64 to the odd number scan lines S1~Sm-1 and the positive scan pulse (+Vs) is supplied from the second scan driving unit 74 to the even number scan lines S2~Sm.

A positive data pulse (+Vd) in synchronization with a positive or a negative scan pulse (+Vs, −Vs) is supplied from the first data driving unit 62 to the first data line D1, and a negative data pulse (−Vd) is supplied from the second data driving unit 72 to the second data line D2.

That is, the positive data pulse (+Vd) supplied from the first data driving unit 72 is supplied to the odd number data lines D1~Dn and the negative data pulse (−Vd) supplied from the second data driving unit 72 is supplied to the even number data lines D2~Dn, which will now be described in detail.

First, the negative scan pulse (−Vs) is supplied to the odd number scan lines S1~Sm-1 in the first frame.

That is, as shown in FIG. 15, the doubled voltage outputted from the doubler circuit 84 is received through the switching device SW15-3 to turn on the fourth switching device SW15-4 of the first scan driving unit 64 and turn off the fifth switching device SW15-5, so that the negative scan pulse (−Vs) is sequentially supplied to the odd number scan lines S1~Sm-1.

Meanwhile, the positive scan pulse (+Vs) is supplied to the even number scan lines S2~Sm.

That is, as shown in FIG. 15B, the doubled voltage outputted from the doubler circuit 94 is received through the switching device SW15-3 to turn off the fourth switching device SW15-9 of the second scan driving unit 74 and turn on the fifth switching device SW15-10, so that the positive scan pulse (+Vs) is sequentially supplied to the even number scan lines S2~Sm.

The positive data pulse (+Vd) in synchronization with the negative scan pulse (−Vs) supplied to the odd number scan lines S1~Sm-1 is supplied to the odd number data lines D1~Dn-1.

That is, as shown in FIG. 16A, the doubled voltage outputted from the doubler circuit 65 is received through the switching device SD3 to turn off the fourth switching device SD4 of the first data driving unit 62 and turn on the fifth switching device SD5, so that the positive data pulse (+Vd) is simultaneously outputted to the odd number data lines D1~Dn-1 or the output is determined according to a control signal.

The negative data pulse (−Vd) in synchronization with the positive scan pulse (+Vs) supplied to the even number scan lines S2~Sm is supplied to the even number data lines D2~Dn.

That is, as shown in FIG. 16B, the doubled voltage outputted from the doubler circuit 75 is received through the switching device SD3' to turn on the fourth switching device SD4' and turn on the fifth switching device SD5', so that the negative data pulse (−Vd) is simultaneously outputted to the odd number data lines D1~Dn-1 or its output is determined according to a control signal.

In the second frame, each scan pulse (+Vs, −Vs) and each data pulse (+Vd, −Vd) with the polarity reversed so as to be the opposite to the polarity of the scan pulse and the data pulse in the first frame is supplied to each scan line and data line.

That is, in the second frame, the positive scan pulse (+Vs) is supplied to the odd number scan lines S1~Sm-1.

Namely, as shown in FIG. 15, the doubled voltage outputted from the doubler circuit 84 is received through the switching device SW15-3 to turn off the fourth switching device SW15-4 of the first scan driving unit 64 and turn on the fifth switching device SW15-5, so that the positive scan pulse (+Vs) is sequentially supplied to the odd number scan lines S1~Sm-1.

Meanwhile, the negative scan pulse (−Vs) is supplied to the even number scan lines S2~Sm.

Namely, as shown in FIG. 15B, the doubled voltage outputted from the doubler circuit 94 is received through the switching device SW15-3 to turn the fourth switching device SW15-9 of the second scan driving unit 74 and turn off the fifth switching device SW15-10, so that the negative scan pulse (−Vs) is sequentially supplied to the even number scan lines S2~Sm.

The negative data pulse (−Vd) in synchronization with the positive scan pulse (+Vs) supplied to the odd number scan lines S1~Sm-1 is supplied to the odd number data lines D1~Dn-1.

Namely, as shown in FIG. 16A, the doubled voltage outputted from the doubler circuit 65 is received through the switching device SD3 to turn on the fourth switching device SD4 of the first data driving unit 62 and turn off the fifth switching device SD5, so that the negative data pulse (−Vd) is simultaneously outputted to the odd number data lines D1~Dn-1 or its output is determined according to a control signal.

The positive data pulse (+Vd) in synchronization with the negative scan pulse (−Vs) supplied to the even number scan lines (S2~Sm) is supplied to the even number data lines D2~Sn.

Namely, as shown in FIG. 16B, the doubled voltage outputted from the doubler circuit 75 is received through the switching device SD3' to turn off the fourth switching device SD4' of the second data driving unit 72 and turn on the fifth switching device SD5', so that the positive data pulse (+Vd) is simultaneously outputted to the even number data lines D2~Dn or its output is determined according to a control signal.

Accordingly, in the driving apparatus and method of an EL display device in accordance with the second and third embodiments of the present invention, since scan lines S1~Sm and data lines D1~Dn are classified by odd and even numbers and a pulse with different polarity is supplied to the data electrode and the scan electrode (the positive pulse to the odd number electrode and negative pulse to the even number electrode) at every line and field, so that the voltage supplied to the pixel cell is uniformly maintained.

In addition, since the positive and negative scan/data pulses (Vs, Vd) are generated by using the low voltage single power source and the doubler circuit, a power consumption can be reduced.

In other words, in the present invention, since a half of the driving voltage as in the conventional art is used, a power consumption is reduced to ¼.

Figure 18:
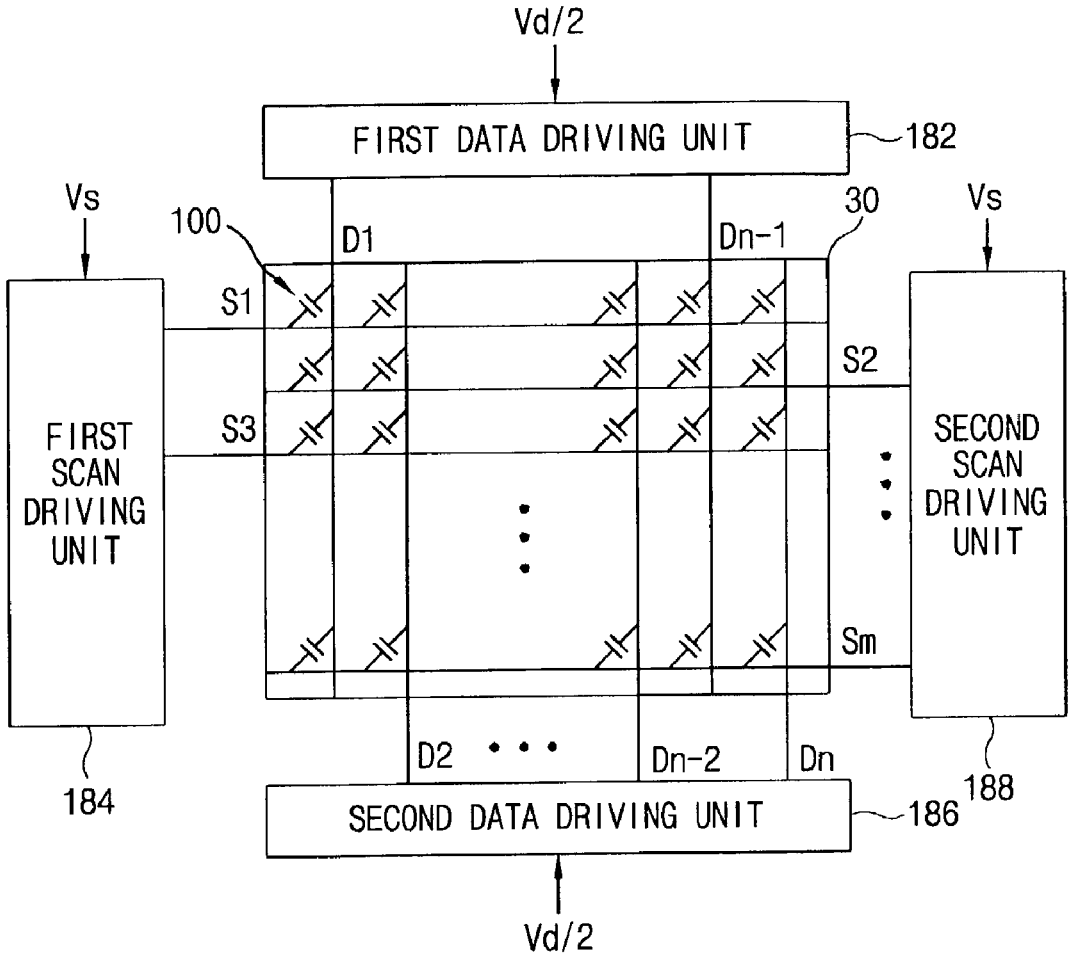
FIG. 18 is a block diagram of a driving apparatus of an EL display device in accordance with a fourth embodiment of the present invention.

FIG. 18 is a block diagram of a driving apparatus of an EL display device in accordance with a fourth embodiment of the present invention.

As shown in FIG. 18, a driving apparatus of an EL display device in accordance with the fourth embodiment of the present invention includes: a pixel cell 100 positioned at a cross point of data lines D1~Dn and scan lines S1~Sm formed on the panel 30; first and second scan driving units 184 and 188 for supplying a doubled positive scan pulse (+2Vs) and a non-doubled negative scan pulse (−Vs) to the scan lines S1~Sm; and first and second data driving units 182 and 186 for supplying a positive or a negative data pulse (+Vd, −Vd) in synchronization with the scan pulse to the data line D1~Dn.

The first scan driving unit 184 supplies the doubled positive scan pulse (+2Vs) and the non-doubled negative scan pulse (−Vs) to odd number scan lines S1 and S3~Sm-1.

The second scan driving unit 188 reverses the positive scan pulse +2Vs and the non-doubled negative scan pulse (−Vs) by the frame unit and supplies them to the even number scan lines S2, S4~Sm.

The first data driving unit 182 supplies a positive or a negative data pulse (+Vd, −Vd) to the odd number data lines D1 and D3~Dn-1.

The second data driving unit 186 supplies a positive or a negative data pulse (+Vd, −Vd) to the even number data lines D2 and D4~Dn.

The pixel cell 100 is positioned at the cross point of the data lines D1~Dn and the scan lines S1~Sm and is turned on/off by an electric field between the scan electrode which receives a positive or a negative scan pulse (+2Vs, −Vs) from the first and second scan driving units 184 and 188 and a data electrode which receives a positive or a negative data pulse (+Vd, −Vd) from the first and the second data driving units 62 and 72.

Each pixel cell 100 has a certain capacitance value.

Figure 19:
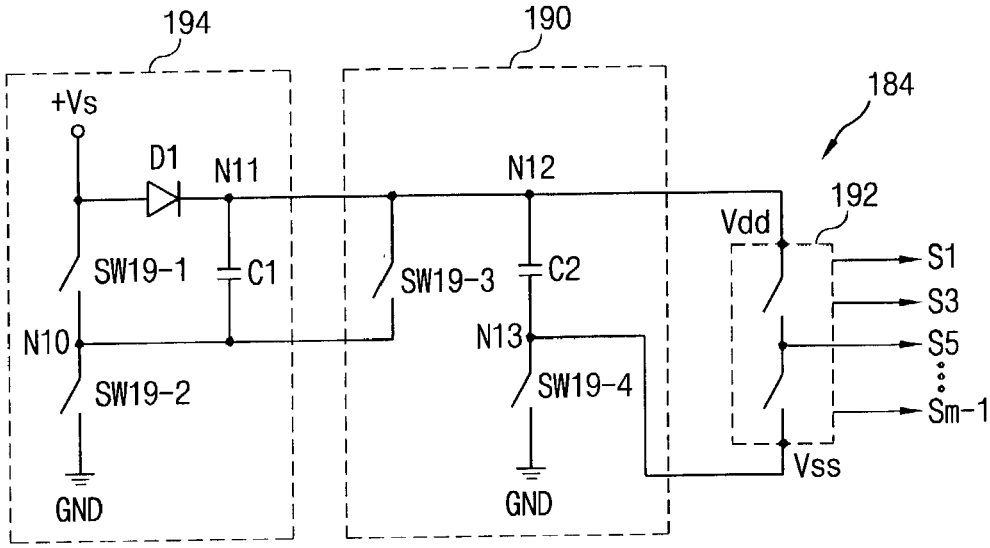
FIG. 19 is a circuit diagram of a first scan driving unit of FIG. 18.

FIG. 19 is a circuit diagram of a first scan driving unit of FIG. 18.

As shown in FIG. 19, the first scan driving unit 184 includes: a first doubler circuit 194 for receiving a single voltage (+Vs) and doubling it; a first scan pulse supply unit 190 for shifting a polarity level of the doubled voltage (+2Vs) by the line unit to generate the doubled positive scan pulse (+2Vs) and the non-doubled negative scan pulse (Vs); and a first scan drive IC 192 for supplying the doubled positive pulse (+2Vs) and the non-doubled negative scan pulse (−Vs) supplied from the first scan pulse supply unit 190 to the odd number scan lines S1, S3~Sm-1.

The first doubler circuit 194 includes: a first and second switching devices SW19-1 and SW19-2 installed between the single voltage source (+Vs) and the ground voltage source (GND); a first capacitor C1 installed between a first node N10 and a second node N11; and a diode D1 installed between the single voltage source (+Vs) and the first capacitor (C1).

The first and second switching devices SW19-1 and SW19-2 are alternately switched by a control signal in order to supply the single voltage (+Vs) to the first capacitor C1.

The first capacitor C1 doubles the voltage (+Vs) by integer times supplied from the single voltage source (+Vs) as the first and second switching devices SW19-1 and SW19-2.

The diode D1 cuts off a reverse voltage supplied to the single voltage source (+Vs).

The doubling process by the first doubler circuit 194 will now be described in detail.

First, when the second switching device SW19-2 is turned on by the control signal, the voltage (+Vs) supplied from the single voltage source (+Vs) is charged in the first capacitor C1 and flows to the second node N11.

Thereafter, when the second switching device SW19-2 is turned off and the first switching device SW19-1 is turned on, the +Vs voltage supplied from the single voltage source (+Vs) and the +Vs voltage charged in the first capacitor C! are added and the double voltage +2Vs flows to the second node N11.

Meanwhile, the non-doubled negative scan pulse (−Vs) is generated by turning on the second switching device SW19-2 and turning off the first switching device SW19-1. At this time, the single voltage (+Vs) is supplied to the first scan pulse supply unit 190 and its polarity is reversed.

The first scan pulse supply unit 190 reverses the single voltage (+Vs) by the frame unit and supplies it to the first scan drive IC 192.

That is, the first scan pulse supply unit 190 shifts a polarity of the non-doubled voltage (+Vs) (scan pulse) to a negative scan pulse (−Vs) and supplies it to the first scan drive IC 192 and supplies the doubled voltage (+2Vs) to the first scan drive IC 192.

The first scan pulse supply unit 190 includes: a third switching device SW19-3 connected between an output of the first doubler circuit 194 and the second switching device SW19-2; a second capacitor C2 installed between the third switching device SW19-2 and the fourth node N13; and a fourth switching device SW19-4 installed between the second capacitor C2 and the ground voltage source GND.

The third switching device SW19-3 is turned on when the non-doubled negative scan pulse (−Vs) is supplied to the scan lines S1~Sm, and the fourth switching device SW19-4 is turned on when the doubled positive scan pulse (+2Vs) is supplied to the scan lines S1~Sm.

The second capacitor C2 charges the voltage +Vs supplied from the first doubler circuit 194.

The operation of the first scan driving unit 184 will now be described in detail.

First, in case that the negative scan pulse (−Vs) is supplied to the first scan drive IC 192, the third switching device SW19-3 and the second switching device SW19-2 are turned on and the fourth switching device SW19-4 is turned off.

At this time, a voltage value flowing at the third node N12 flows to the ground voltage source GND through the third switching device SW19-3 and the second switching device SW19-2 and becomes the same voltage value with a ground voltage value.

Meanwhile, the voltage of the fourth node N13 has the same voltage value as the voltage charged in the second capacitor C2.

The voltage level of the fourth node N13 is shifted to have a negative polarity. Accordingly, the non-doubled negative scan pulse −Vs is supplied to the first scan drive IC 192, and at this time, the first switching device SW19-1 is turned off.

Meanwhile, in case that the doubled positive scan pulse (+2Vs) to the first scan drive IC 192, the first and the second switching devices SW19-1 and SW19-2 of the doubler circuit 194 are alternately turned on and the generated doubled voltage (+2Vs) is charged in the second capacitor C2.

Thereafter, the third switching device SW19-3 is turned off and the fourth switching device SW19-4 is turned on. At this time, the voltage (+2Vs) charged in the second capacitor C2 is supplied to the power supply terminal Vdd of the first scan drive IC 192, and the ground terminal Vss is connected to the ground voltage source GND through the fourth switching device SW19-4 and receives a ground voltage. Accordingly, the doubled positive scan pulse (+2Vs) is supplied to the first scan drive IC192.

The first scan drive IC192 sequentially supplies the non-doubled negative scan pulse (−Vs) and the doubled positive scan pulse (+2Vs) which has been supplied after being reversed by the frame unit from the scan pulse supply unit 190, to the odd number scan lines S1 and S3~Sm-1, for which the first scan drive IC 192 includes a plurality of switching devices (not shown) which are sequentially turned on by a control signal.

The operation of the second scan driving unit 188 will now be described in detail with reference to FIG. 20.

Figure 20:
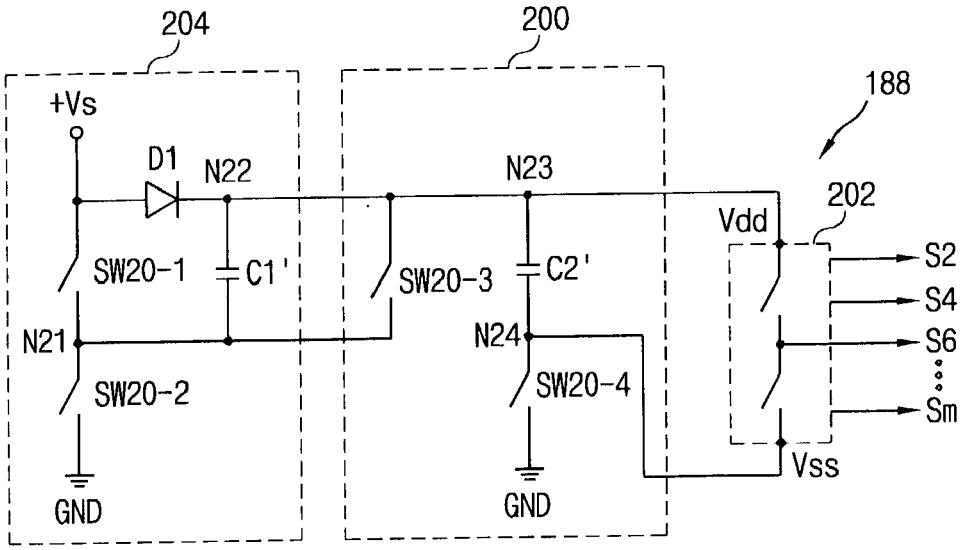
FIG. 20 is a circuit diagram of a second scan driving unit of FIG. 18.

FIG. 20 is a circuit diagram of a second scan driving unit of FIG. 18.

As shown in FIG. 20, the second scan driving unit 188 supplies a doubled positive pulse (+2Vs) and a non-doubled scan pulse (−Vs) according to the same construction and operation of the first scan driving unit 184, to the even number scan lines S2 and S4~Sm through the second scan drive IC 202.

First, in case that the negative scan pulse (−Vs) is supplied to the second scan drive IC 202, the third switching device SW20-3 and the second switching device SW20-2 are turned on and the fourth switching device SW20-4 is turned off.

At this time, the voltage at the seventh node N23 flows to the ground voltage source GND through the third switching device SW19-3 and the second switching device SW19-2, having the same voltage value with the ground voltage value.

Meanwhile, the voltage of the eighth node N24 has the same voltage value with the voltage charged in the second capacitor C2'.

The voltage level on the eighth node N24 is shifted to a negative polarity. Accordingly, the non-doubled negative scan pulse (−Vs) is supplied to the second scan drive IC 202, and at this time, the first switching device SW20-1 is turned off.

Meanwhile, in case that the doubled positive scan pulse (+2Vs) is supplied to the second scan drive IC 202, the first and second switching devices SW20-1 and SW20-2 of the second doubler circuit 204 are alternately turned on to generated the doubled voltage (+2Vs) and the generated doubled voltage (+2Vs) is charged in the second capacitor C2'.

Thereafter, the third switching device SW20-3 is turned off and the fourth switching device SW20-4 is turned on. Then, the voltage (+2Vs) charged in the second capacitor C2' is supplied to the power supply terminal Vdd of the second scan drive IC 202 and a ground voltage is supplied to the ground terminal Vss as the ground terminal Vss is connected to the ground voltage source GND through the fourth switching device SW20-4. Accordingly, the doubled positive scan pulse (+2Vs) is supplied to the second scan drive IC 202.

The second scan drive IC 202 sequentially supplies the non-doubled negative scan pulse (−Vs) and the doubled positive scan pulse (+2Vs) which are supplied after being reversed by the frame unit by the second scan pulse supply unit 200, to the even number scan lines S2 and S4~Sm, for which the second scan drive IC 202 includes a plurality of switching devices (not shown) which are sequentially turned on by the control signal.

The first data driving unit 182 will now be described in detail with reference to FIG. 21.

Figure 21:
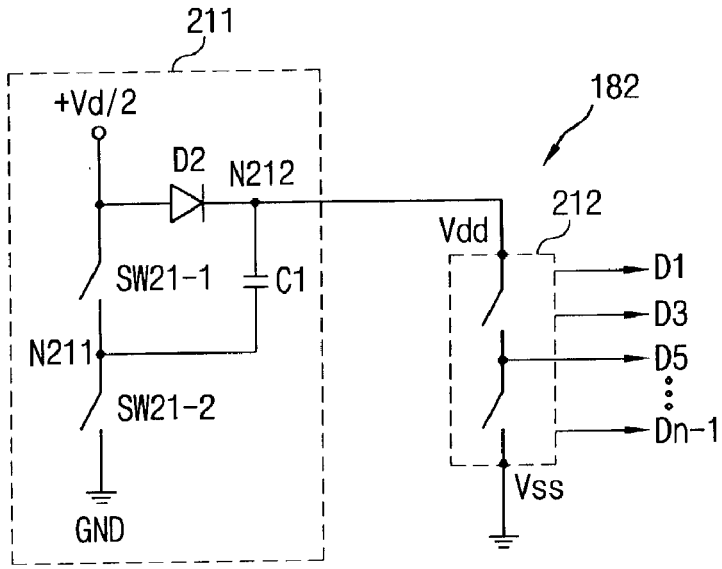
FIG. 21 is a circuit diagram of a first data driving unit of FIG. 18.

FIG. 21 is a circuit diagram of a first data driving unit of FIG. 18.

As shown in FIG. 21, the first data driving unit 182 includes: a first doubler circuit 211 for receiving the single low voltage (Vd/2) and doubling it; and a first data drive IC 212 for simultaneously supplying the doubled positive data pulse Vd supplied from the first doubler circuit 211 to the odd number data lines D1 and D3~Dn-1.

The first doubler circuit 211 includes: a single low voltage source Vd/2; first and second switching devices SW21-1 and SW21-2 installed between the single low voltage source Vd/2 and the ground voltage source GND; a first capacitor C1 installed between the first node N211 and the second node N212 between the first and second switching devices SW21-1 and SW 21-2; and a diode D1 installed between the single low voltage source (Vd/2) and the first capacitor (C1).

The first and second switching devices SW21-1 and SW21-2 are alternately switched by the control signal to supply the single low voltage source (Vd/2) to the first capacitor C1.

The first capacitor C1 doubles the low voltage (+Vd/2) supplied from the single low voltage source (Vd/2) as the first and second switching devices SW21-1 and SW21-2 alternately switched. The diode D1 cuts off a reverse voltage supplied to the single voltage source (+Vd/2).

The first data drive IC 212 includes a plurality of switching devices (not shown) in order to simultaneously supply the doubled data pulse (+Vd) supplied from the first doubler circuit 211 to the odd number data lines D1, D3~Dn-1.

The doubled data pulse (+Vd) supplied from the first doubler circuit 211 is supplied to the power supply terminal Vdd of the first data drive IC 212, and the ground terminal Vss is constantly connected to the ground voltage source GND.

The operation of the first data driving unit 182 will now be described in detail.

First, when the second switching device SW21-2 is turned on by the control signal, the voltage supplied from the single low voltage source (+Vd/2) is charged in the first capacitor C1 and +Vd/2 voltage flows on the second N212.

Thereafter, when the second switching device SW21-2 is turned off and the first switching device SW21-1 is turned on, the +Vd/2 voltage supplied from the single low voltage source (+Vd/2) and the +Vd/2 voltage charged in the first capacitor C1 are added and the doubled voltage (+Vd) flows to the second node N212.

The voltage generated by doubling the low voltage (+Vd/2) supplied from the single low voltage source is supplied to the power supply terminal Vdd of the first data drive IC 212.

The doubled data pulse (+Vd) supplied to the power supply terminal (Vdd) of the first data drive IC 212 is simultaneously supplied to the odd number data lines D! and D3~Dn-1 according to a switching operation.

The second data driving unit 186 will now be described in detail with reference to FIG. 22.

Figure 22:
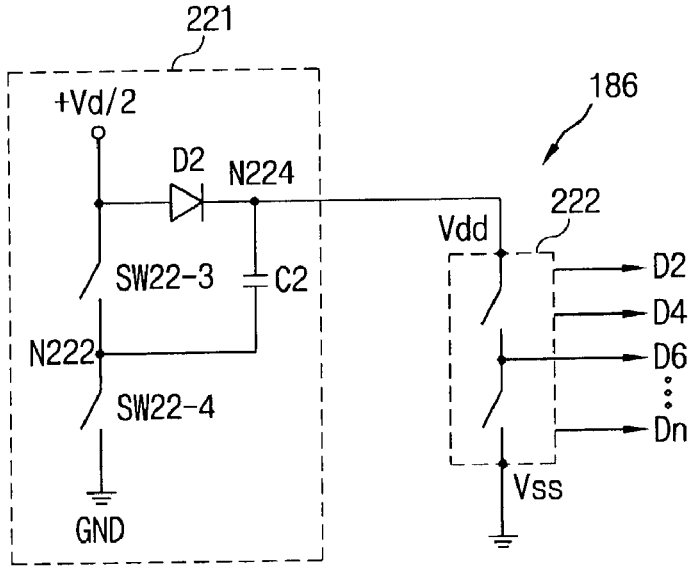
FIG. 22 is a circuit diagram of a second data driving unit of FIG. 18.

FIG. 22 is a circuit diagram of a second data driving unit of FIG. 18.

As shown in FIG. 22, the second data driving unit 186 supplies the doubled positive data pulse (+Vd) to the odd number data lines D2 and D4~Dn through the second drive IC 222 according to the same construction and operation with the first data driving unit 182.

The operation of the second data driving unit will now be described in detail.

First, when the fourth switching device SW22-4 is turned on by the control signal, the low voltage (+Vd/2) supplied from the single low voltage source (+Vd/2) is charged in the second capacitor C2 and flows to the fourth node N224.

Thereafter, when the fourth switching device SW22-4 is turned off and the third switching device SW22-3 is turned on, the voltage +Vd/2 supplied from the single low voltage source (+Vd/2) and the voltage +Vd/2 charged in the second capacitor C2 are added and the doubled voltage (+Vd) flows to the fourth node N224.

The voltage +Vd generated by doubling the voltage supplied from the single voltage source (+Vd/2) is supplied to the power supply terminal Vdd of the second data drive IC 22.

The doubled data pulse +Vd supplied to the power supply terminal Vdd of the second data drive IC 222 is simultaneously supplied to the even number data lines D2 and D4~Dn according to a switching operation of the second data drive IC 222.

Waveforms applied to a panel according to a driving timing of the scan driving and the data driving unit in accordance with the fourth embodiment of the present invention will now be described with reference to FIG. 23.

Figure 23:
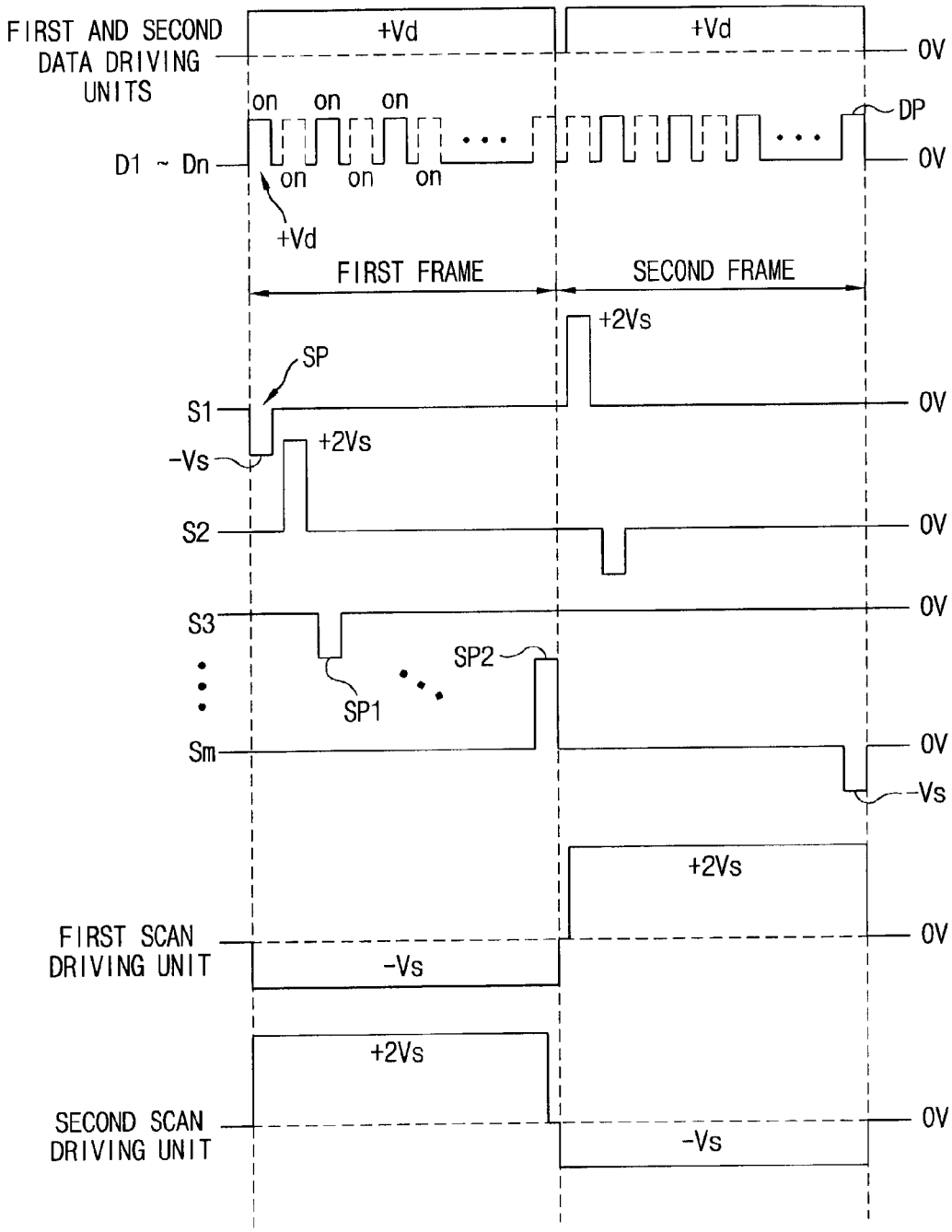
FIG. 23 shows waveforms applied to a panel by a drive timing of the first and second scan/data driving unit and the data driving unit of FIG. 18.

FIG. 23 shows waveforms applied to a panel by a drive timing of the first and second scan/data driving unit and the data driving unit of FIG. 18.

As shown in FIG. 23, the doubled positive scan pulse (+2Vs) and the non-doubled negative scan pulse (−Vs), which are reversed by the frame unit and have mutually different polarity at every adjacent scan line, are supplied to the scan lines S1~Sm, and a positive data pulse (+Vd) is supplied to the data lies D1~Dn.

For example, if the frame is an odd number frame (the first frame), the non-doubled negative scan pulse (−Vs) is supplied from the first scan driving unit 184 to the odd number scan lines S1 and S3~Sm-1, and the doubled positive scan pulse (+2Vs) is supplied from the second scan driving unit 188 to the even number scan lines S2 and S4~Sm.

If the frame is an even number frame (the second frame), the doubled positive scan pulse (+2Vs) is supplied from the first scan driving unit 184 to the odd number scan lines S1 and S3~Sm-1 and the non-doubled negative scan pulse (−Vs) is supplied from the second scan driving unit 188 to the even number scan lines S2 and S4~Sm. At this time, the positive data pulse (+Vd) in synchronization with the scan pulse is supplied to the data lines D1~Dn from the first and second data driving units 182 and 186.

A driving method of an electroluminescent display device in accordance with the fourth embodiment of the present invention is that the positive data pulse DP generated through the doubled circuit which receives a low voltage is supplied to the data lines D1~Dn, and scan pulses SP1 and SP2 which are reversed by the frame unit and different in their size at every adjacent line are supplied to the scan lines S1~Sm by using a single voltage source.

In detail, the positive data pulse (+Vd) is supplied to the data lines D1~Dn, and the doubled positive scan pulse (+2Vs) and the non-doubled negative scan pulse (−Vs) are repeatedly supplied to the scan lines S1~Sm, so that the pixel cell 100 is turned on/off by a difference of voltages being supplied.

For example, if the data pulse (+Vd) is supplied to the data lines D1~Dn and the non-doubled negative scan pulse (−Vs) is supplied to the scan lines (S1~Sm), the pixel cell 100 is turned on.

Meanwhile, if the doubled positive scan pulse (+2Vs) is supplied to the scan lines S1~Sm and the data pulse (+Vd) is supplied to the data lines D1~Dn, the pixel cell 100 is turned off.

In other words, the pixel cell 100 is turned on when the negative scan pulse (−Vs) and the data pulse (+Vd) in a high state are supplied thereto and when the positive scan pulse (+2Vs) and the data pulse (+Vd) in a low state are supplied thereto.

Meanwhile, for reference, the pixel cell is turned on when a voltage difference between the scan pulse SP and the data pulse DP is Vs+Vd (high level data pulse) or greater than +2Vs−Vd (low level data pulse), and turned off when the voltage difference is Vs+Vd (low level data pulse) or smaller than +2Vs−Vd (high level data pulse).

Consequently, in the driving apparatus and method of the EL display device in accordance with the fourth embodiment of the present invention, since the scan pulse SP is supplied with different size by the frame unit and by the line unit to the scan lines S1~Sm and the polarity of the scan pulse SP is reversed per frame, a phenomenon that the electric charges charged in the pixel cell between the line and the frame can be removed.

Accordingly, the EL panel can be stably driven, and since the voltage is equally supplied to the pixel cell, a flicker phenomenon can be prevented.

Figure 24:
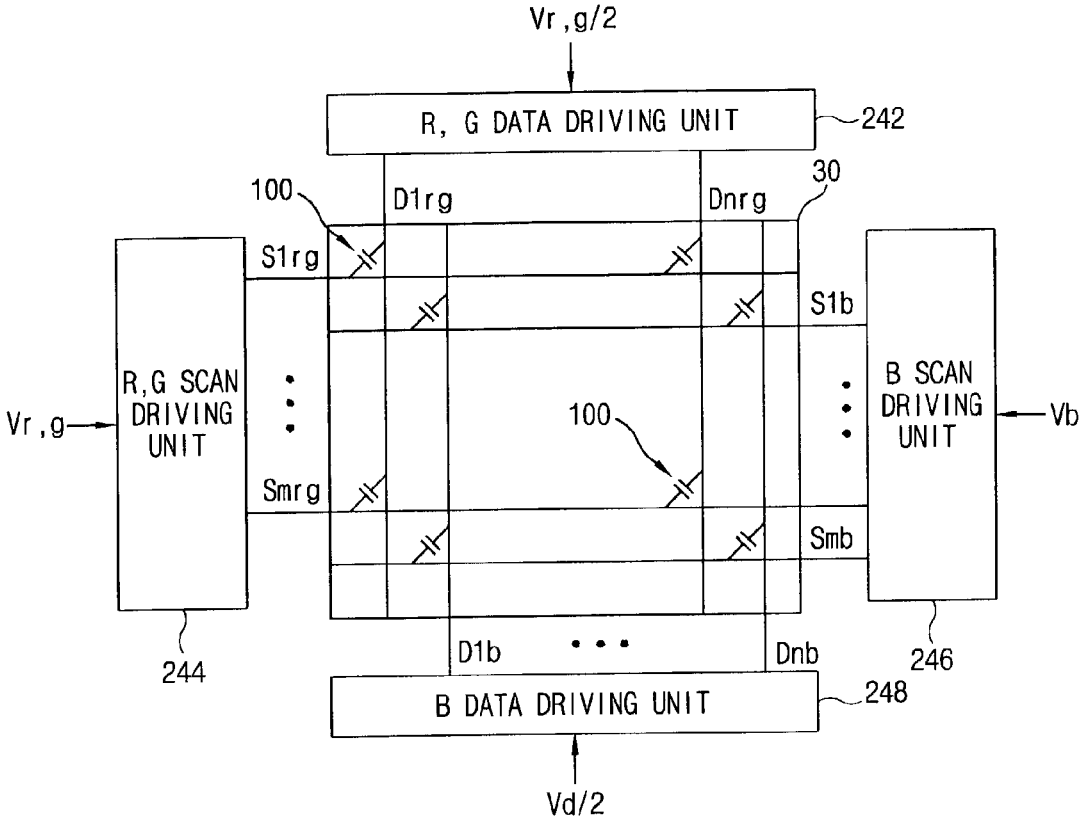
FIG. 24 is a block diagram of a driving apparatus of an EL display device in accordance with a fifth embodiment of the present invention.

FIG. 24 is a block diagram of a driving apparatus of an EL display device in accordance with a fifth embodiment of the present invention.

As shown in FIG. 24, a driving apparatus of an EL display device in accordance with a fifth embodiment of the present invention includes: RG and B scan driving units 244 and 246 for supplying scan pulses with different sizes to scan lines S1~Sm respectively connected to red (R), green (G) and blue (B) pixel cell; and RG and B data driving units 242 and 248 for supplying a data pulse to data lines D1~Dn.

The RG scan driving unit 244 supplies a scan pulse for emitting light from red and green fluorescent materials to the scan lines connected to the pixel cells for emitting light from the red and green fluorescent materials.

The B scan driving unit 246 supplies a scan pulse for emitting light from the blue fluorescent material to the scan line connected to a pixel cell for emitting light from the blue fluorescent material.

The RG data driving unit 242 supplies a data pulse to the data line connected to the pixel cell emitting light from the red and green fluorescent material.

The B data driving unit 248 supplies a data pulse to a data line connected to a pixel cell emitting light from the blue fluorescent material.

The pixel cell 100 formed on the panel 30 is turned on/off by the data pulse and the scan pulse of which polarities are reversed by the frame unit from the horizontally divided RG and B scan driving units 244 and 246 and the vertically divided RG and B data driving units 242 and 248.

The red (R) and green (G) data lines (D1*rg*~Dnrg) receives red (R) and green (G) data pulses (+Vdrg, −Vdrg) of which polarities are reversed by the frame unit from the RG data driving unit 242, and the blue (B) data lines D1*b*~Dnb receives the blue (B) data pulse (+Vdb, −Vdb) of which a polarity is reversed by the frame unit from the B data driving unit 248.

The red (R) and green (G) data lines (D1*rg*~Dnrg) signify data lines connected to pixel cells emitting light from the red (R) and the green (G) fluorescent materials.

The red (R) and green (G) data pulses (+Vdrg, −Vdrg) signify data pulses supplied to data lines connected to the pixel cells emitting light from the red (R) and green (G) fluorescent materials.

The blue (B) data lines (D1*b*~Dnb) signify data lines connected to pixel cells emitting light from the blue (B) fluorescent material.

The blue (B) data pulses (+Vdb, −Vdb) signify data pulses supplied to the data lines connected to pixel cells emitting light from the blue (B) fluorescent material.

The red (R) and green (G) scan lines (S1*rg*~Smrg) receive the red (R) and green (G) with a polarity reversed by the frame unit from the RG scan driving unit 64, and the blue (B) scan lines S1*b*~Smb receive the blue (B) scan pulse (_Vsb, −Vsb) with a polarity reversed by the frame unit from the B scan driving unit 74.

The red (R) and green (G) scan lines (S1*rg*~Smrg) signify scan lines connected to pixel cells emitting light from the red (R) and the green (G) fluorescent materials.

The red (R) and green (G) scan pulses (+Vsrg, −Vsrg) signify scan pulses supplied to scan lines connected to pixel cells emitting light from red (R) and green (G) fluorescent materials.

The blue (B) scan lines (S1*b*~Smb)signify scan lines connected to pixel cells emitting light from the blue (B) fluorescent material.

The blue (B) scan pulses (+Vsb, −Vsb) signify scan pulses supplied to scan lines connected to pixel cells emitting light from the blue (B) fluorescent material.

The RG scan driving unit 244 will now be described in detail with reference to FIG. 25.

Figure 25:
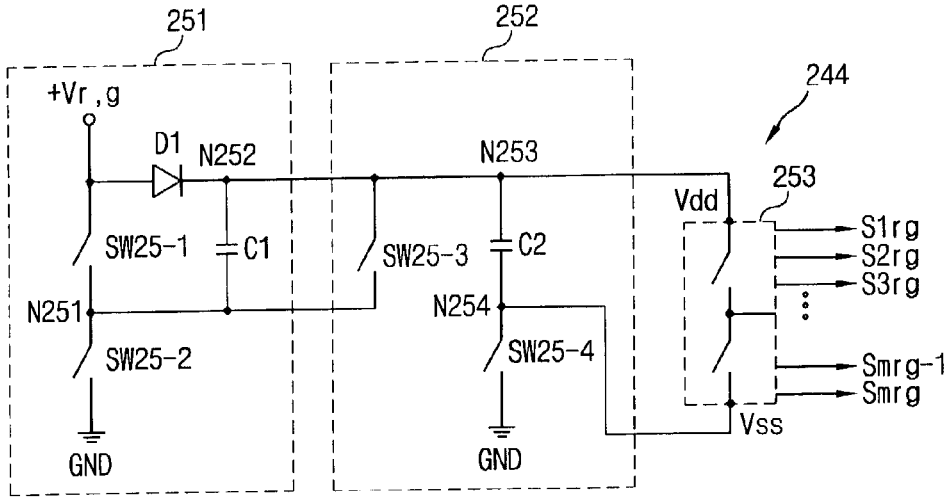
FIG. 25 is a circuit diagram showing an RG scan driving unit of FIG. 24.

FIG. 25 is a circuit diagram showing an RG scan driving unit of FIG. 24.

As shown in FIG. 25, the RG scan driving unit 244 includes: an RG doubler circuit 251 for receiving a single voltage (+Vr,g) and doubling it; an RG scan pulse supply unit 252 for shifting a polarity level of the doubled voltage (+Vr,g) by the frame and line units to generate a doubled positive scan pulse (+2Vr,g) and negative scan pulse (−2Vr,g); and an RG scan driving IC 253 for supplying the doubled positive scan pulse (+2Vr,g) and the negative scan pulse )=2Vr,g) supplied from the RG scan pulse supply unit 252 to the scan lines S1~Smrg.

The RG doubler circuit 251 includes: a single voltage source (+Vr,g); first and second switching devices SW25-1 and SW25-2 installed between the single voltage source (+Vr,g) and the ground voltage source GND; a first capacitor C1 installed between a first node N251 and a second node N252 between the first and the second switching devices SW25-1 and SW25-2; and a diode D1 installed between the single voltage source (+Vr,g) and the first capacitor C1.

The first and second switching devices SW25-1 and SW25-2 are alternately switched by a control signal and supplies a single voltage (+Vr,g) to the first capacitor C1.

The first capacitor C1 doubles the voltage (+Vr,g) supplied from the single voltage source (+Vr,g) as the first and second switching device SW25-1 and SW25-2 are alternately switched.

The diode D1 cuts off a reverse voltage supplied to the single voltage source (+Vr,g)

The doubling process by the RG doubler circuit 251 will now be described in detail First, when the second switching device SW25-2 is turned on by the control signal, the voltage (+Vr,g) supplied from the single voltage source (+Vr,g) is charged in the first capacitor C1 and flows to the second node N255.

Thereafter, when the second switching device SW25-2 is turned off and the first switching device SW25-1 is turned on, the voltage +Vr,g supplied from the single voltage source (+Vr,g) and the voltage +Vr,g charged in the first capacitor C1 are added and the doubled voltage +2Vr,g) flows on the second node N252.

The RG douber circuit 251 doubles the low voltage +Vrg and supplies the doubled voltage +2Vr,g to the RG scan pulse supply unit 252.

The RG scan pulse supply unit 252 reverses the polarity level of the doubled voltage +2Vr,g by the frame unit as well as the scan line unit, and supplies it to the RG scan driver IC 253.

The RG scan pulse supply unit 252 includes a third switching device SW25-3 connected between the output of the RG doubler circuit 251 and the second switching device SW25-2; a second capacitor C2 installed between the third switching device SW25-3 and the fourth node N254; and a fourth switching device SW25-4 installed between the second capacitor C2 and a ground voltage source GND.

The third switching device SW25-3 discharges the voltage charged in the second capacitor C2 to the ground voltage source GND through the second switching device SW25-2, so that it is turned when a negative scan pulse (−2Vr,g) is supplied to the RG scan lines S1*rg*~Smrg, and the fourth switching device SW25-4 is turned on when a positive scan pulse (+2Vr,g) is supplied to the scan lines S1*rg*~Smrg).

The second capacitor C2 charges the doubled voltage (+2Vr,g) supplied from the RG doubler circuit 251.

That is, in case that the negative scan pulse (−2Vr,g) is supplied to the RG scan drive IC 253, the third switching device SW25-3 and the second switching device SW25-2 are turned on and the fourth switching device SW25-4 is turned off.

At this time, the voltage flowing at the third node N253 flows to the ground voltage source GND through the third switching device SW25-3 and the second switching device SW25-2 and becomes a ground voltage.

Meanwhile, the voltage at the fourth node N254 is the same with the voltage charged in the second capacitor C2.

The level of voltage flowing at the fourth node N254 is shifted to a negative polarity. Accordingly, the negative scan pulse (−2Vr,g) is supplied to the RG scan drive IC 253 and at this time, the first switching device SW25-1 is turned off.

In case that the doubled positive scan pulse (+2Vr,g) is supplied to the RG scan drive IC 253, the first and second switching devices SW 25-1 and SW25-2 of the RG doubler circuit 251 are alternately turned on to generate a doubled voltage (+2Vr,g), and the generated voltage (+2Vr,g) is charged in the second capacitor C2.

Thereafter, the third switching device SW25-4 is turned off and the fourth switching device SW 25-4 is turned on. At this time, the voltage (+2Vr,g) charged in the second capacitor C2 is supplied to the power supply terminal Vdd of the RG scan drive IC 253, and the ground terminal Vss receives a ground voltage by being connected to the ground voltage source GND through the fourth switching device SW25-4. Accordingly, the doubled positive scan pulse (+2Vr,g) is supplied to the RG scan pulse supply unit 252.

The RG scan drive IC 253 supplies the positive scan pulse (+2Vr,g) and the negative scan pulse (−2Vr,g), which are supplied after being reversed by the frame unit as well as being reversed to be the opposite at every line from the RG scan pulse supply unit 252, to the RG scan lines S1*rg*~Smrg.

The RG scan drive IC 253 includes a plurality of switching devices (not shown) which are sequentially turned on by the control signal.

The B scan driving unit 246 will now be described in detail with reference to FIG. 26.

Figure 26:
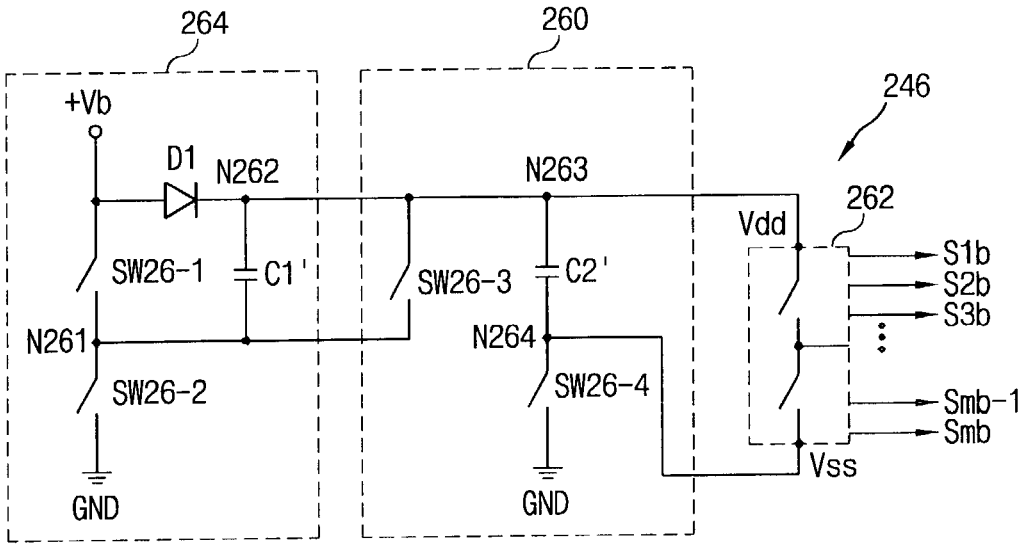
FIG. 26 is a circuit diagram of a 'B' scan driving unit of FIG. 24.

FIG. 26 is a circuit diagram of the B scan driving unit of FIG. 24.

As shown in FIG. 26, the B scan driving unit 246 supplies a positive and a negative scan pulses (+2Vb, −2Vb) doubled by the same construction and operation with the RG scan driving unit 244, to the B scan lines S1*b*~Smb connected to the blue (B) pixel cell through the B scan drive IC 262. In this respect, the B scan line is a scan line connected to the pixel cell generating a blue fluorescent material.

The size of the single voltage (+Vb) supplied to the B scan driving unit 74 is smaller than the single voltage (+Vr,g) supplied to the RG scan driving unit 64.

That is, since each threshold voltage is different depending on characteristics of each of the red (R), green (G) and blue (B) fluorescent materials, different voltage values are supplied to each pixel cell.

The red (R) and green (G) fluorescent materials use Zns:Mn, and the blue (B) fluorescent material uses Cas:Mn. Zns is a compound of Zinc and Sulfur, Mn is manganese, and Cas is a compound of Calcium and Sulfur.

Figure 27A:
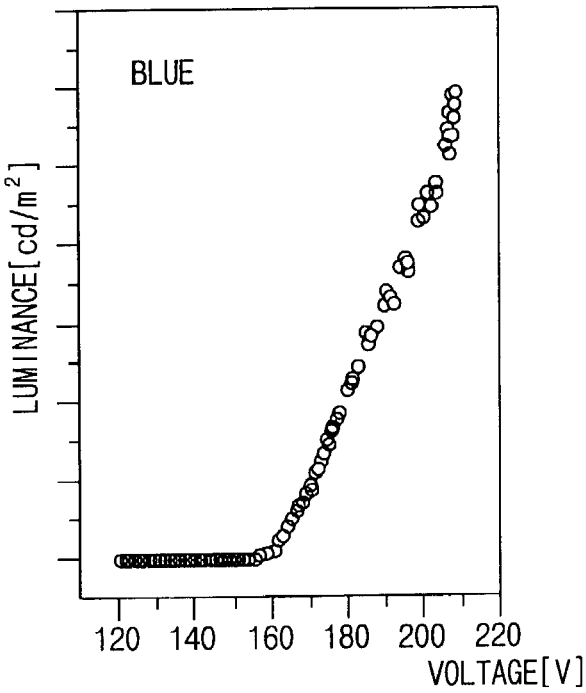
FIGS. 27A and 27B show threshold voltages of pixel cells emitting light from each fluorescent material of red (R), green (G) and blue (B)
Figure 27B:
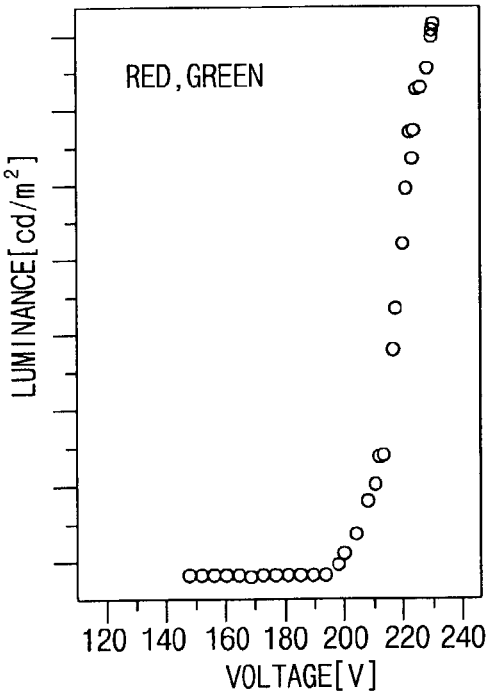

FIGS. 27A and 27B show threshold voltages of pixel cells emitting light from each fluorescent material of red (R), green (G) and blue (B);

As shown in FIGS. 27A and 27B, the threshold voltage of the pixel cell emitting light from each of the red (R), green (G) and blue (B) fluorescent materials are shown different.

In other words, as the voltage supplied to the pixel cell is changed, luminance characteristics for each fluorescent material is different. In this respect, the threshold voltage signifies a voltage required for implementing a maximum luminance by emitting light from each (R, G, B) fluorescent material.

First, though the threshold voltage for the blue (B) fluorescent material is changed according to luminance, it is generally about 120V~200V. And, the threshold voltage for the red (R) and the green (G) fluorescent materials is changed, it is generally about 150V~240V.

Accordingly, when the same voltage is supplied to the pixel cell emitting light from the red (R), green (G) and blue (B) fluorescent materials, a luminance difference takes place to cause an error for a difference of brightness and luminance, a purity of color and a chromaticity. In order to avoid the error, a high voltage than the voltage supplied to the blue (B) fluorescent material is supplied to the red (R) and green (G) fluorescent materials.

The operation of the B scan driving unit 246 will now be described in detail.

First, in case that a doubled positive scan pulse (+2Vb) is supplied to the B scan drive IC 262, the first and second switching devices SW26-1 and SW26-2 of the B doubler circuit 264 are alternately turned on to generate a doubled voltage (+2Vb) and the generated doubled voltage (+2Vb) is charged in the second capacitor C2'.

Thereafter, the third switching device SW26-4 is turned off and the fourth switching device SW26-4 is turned on.

At this time, the voltage (+2Vb) charged in the second capacitor C2' is supplied to the power supply terminal (Vdd) of the B scan drive IC 262, and a ground voltage is supplied to the ground terminal Vss as the ground terminal is connected to the ground voltage source GND through the fourth switching device SW26-4. Accordingly, the doubled positive scan pulse (+2Vb) is supplied to the B scan drive IC 262.

In case that a doubled negative scan pulse (−2Vb) is supplied to the B scan drive IC 262, the third switching device SW26-3 and the second switching device SW26-2 are turned on and the fourth switching device SW26-4 is turned off.

Accordingly, the voltage flowing at the seventh node N263 flows to the ground voltage source GND through the third switching device SW26-3 and the second switching device SW26-2 and becomes a ground voltage.

Meanwhile, the voltage value flowing at the eighth node N264 is the same as the value of voltage charged in the second capacitor C2'.

The voltage level of the eighth node N264 is shifted to a negative polarity. At this time, the negative scan pulse (−2Vb) is supplied to the B scan drive IC 262, and at this time, the first switching device SW26-1 is turned off.

The B scan drive IC 262 supplies the doubled positive scan pulse (+2Vb) and the doubled negative scan pulse (−2Vb), which are supplied after being reversed by the frame unit as well as being reversed to be the opposite at every line from the B scan pulse supply unit 260, to the B scan lines S1*b*~Smb.

In this respect, the B scan drive IC 262 includes a plurality of switching devices (not shown) which are sequentially turned on by a control signal.

The RG data driving unit will now be described in detail with reference to FIG. 28.

Figure 28:
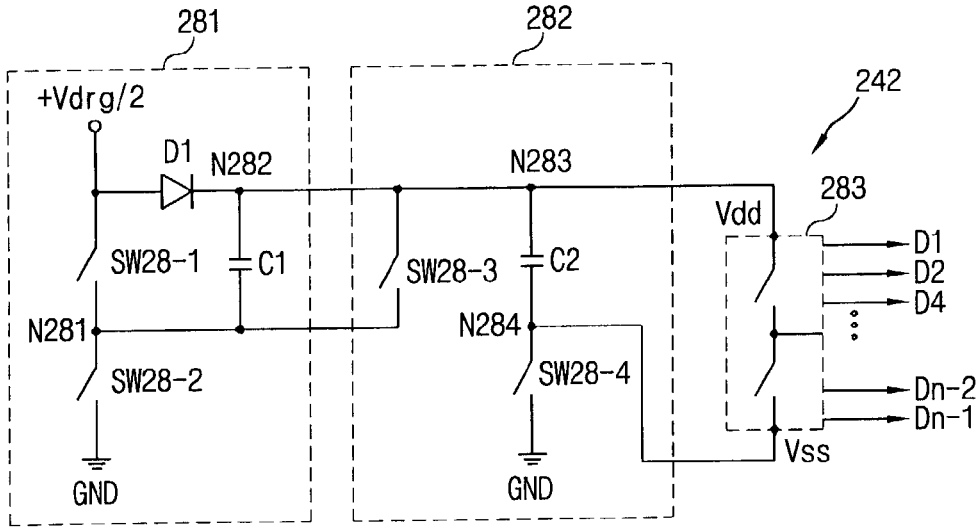
FIG. 28 is a circuit diagram of an RG data driving unit of FIG. 24.

FIG. 28 is a circuit diagram of an RG data driving unit of FIG. 24.

As shown in FIG. 28, the RG data driving unit 242 includes: an RG doubler circuit 281 for receiving a single low voltage (+Vdrg/2) and doubling it; an RG data pulse supply unit 282 for shifting a polarity level of the doubled voltage (+Vdrg/2) by the line unit to generate a doubled positive data pulse (+Vdrg) and a negative data pulse (−Vdrg); and an RG data drive IC 283 for supplying the doubled positive data pulse (+Vdrg) and the negative data pulse (−Vdrg) supplied from the RG data pulse supply unit 282, to the data lines D1, D2~Dn-1 and Dn-2 connected to the pixel cells emitting light from the red and green fluorescent materials.

The RG doubler circuit 281 includes: a single low voltage source (+Vdrg/2); first and second switching devices SW28-1 and SW28-2 installed between the single low voltage source (+Vdrg/2) and the ground voltage source GND; a first capacitor C1 installed between a first node N281 and a second node N282 between the first and second switching devices SW28-1 and SW28-2; and a diode D1 installed between the single voltage source (+Vdrg/2) and the first capacitor C1.

The first and second switching devices SW28-1 and SW28-2 are alternately switched by a control signal and supplies the single low voltage (+Vdrg/2) to the first capacitor C1.

The first capacitor C1 doubles the voltage (+Vdrg/2) supplied from the single low voltage source (+Vdrg/2) as the first and second switching devices SW28-1 and SW28-2 are alternately switched.

The diode D1 cuts off a reverse voltage supplied to the single low voltage source (+Vdrg/2).

The doubling process by the RG doubler circuit 281 will now be described.

First, when the second switching device SW28-1 is turned on by the control signal, the voltage (+Vdrg/2) supplied from the single low voltage source (+Vdrg/2) is charged in the first capacitor C1 and flows at the second node N282.

Thereafter, when the second switching device SW28-2 is turned off and the first switching device SW28-1 is turned on, the voltage +Vdrg/2 supplied from the single low voltage source (+Vdrg/2) and the voltage +Vdrg/2 charged in the first capacitor C1 are added and the doubled voltage +Vdrg flows at the second node N2.

The RG doubler circuit 281 doubles the low voltage (+Vdrg/2) and supplies the doubled voltage (+Vdrg) to the RG data pulse supply unit 282.

The RG data pulse supply unit 282 includes a third switching device SW28-3 connected between an output of the RG doubler circuit 281 and the second switching device SW28-2; a second capacitor C2 installed between the third switching device SW28-3 and the fourth node N284; and a fourth switching device SW28-5 installed between the second capacitor C2 and the ground voltage source GND.

The third switching device SW28-3 is turned in case that the negative data pulse (−Vdrg) is supplied to the data lines D1, D2~Dn-2 and Dn-1 by discharging the voltage charged in the second capacitor C2 to the ground voltage source GND through the second switching device SW28-2, and the fourth switching device SW28-4 is turned on in case that the positive data pulse (+Vdrg) is supplied to the data lines D1, D2~Dn-2 and Dn-1.

The data pulse (+Vdrg) is supplied to the data line connected to the pixel cells emitting light from the red and green fluorescent materials.

The second capacitor C2 charges the doubled voltage (+Vdrg) supplied from the RG doubler circuit 281.

The operation of the RG data driving unit 242 will now be described.

First, when the negative data pulse (−Vdrg) is supplied to the RG data drive IC 283, the third switching device SW28-3 and the second switching device SW28-2 are turned on and the fourth switching device SW28-4 is turned off.

Accordingly, the voltage flowing at the third node N283 flows to the ground voltage source GND through the third switching device SW28-3 and the second switching device SW28-2 and becomes the ground voltage source GND.

Meanwhile, the voltage charged in the second capacitor as it is flows at the fourth node N284. The polarity of the voltage flowing at the fourth node N284 is shifted to a negative polarity. Thus, the negative data pulse (−Vdrg) is supplied to the RG data drive IC 283, and at this time, the first switching device SW28-1 is turned off.

In case that the doubled positive data pulse (+Vdrg) is supplied to the RG data drive IC 283, the first and second switching devices SW28-1 and SW28-2 of the RG doubler circuit 281 are alternately turned on to generate a doubled voltage (+Vdrg), and the generated doubled voltage (+Vdrg) is charged in the second capacitor C2.

Thereafter, the third switching device SW28-4 is turned off and the fourth switching device SW 28-4 is turned on. Accordingly, the voltage (+Vdrg) charged in the second capacitor C2 is supplied to the power supply terminal (Vdd) of the RG data drive IC 283, and the ground terminal Vss receives a ground voltage as being connected to the ground voltage source GND through the fourth switching device SW28-4. Accordingly, the doubled positive data pulse (+Vdrg) is supplied to the RG data drive IC 283.

The RG data drive IC 283 supplies the positive data pulse (+Vdrg) and the negative data pulse (−Vdrg), which are supplied after being reversed to be the opposite at every line from the RG data pulse supply unit 282, to the RG data lines D1, D2~Dn-2 and Dn-1, for which the RG data drive IC 283 includes a plurality of switching devices (not shown) which are simultaneously turned on by a control signal.

The B data driving unit will now be described in detail with reference to FIG. 29.

Figure 29:
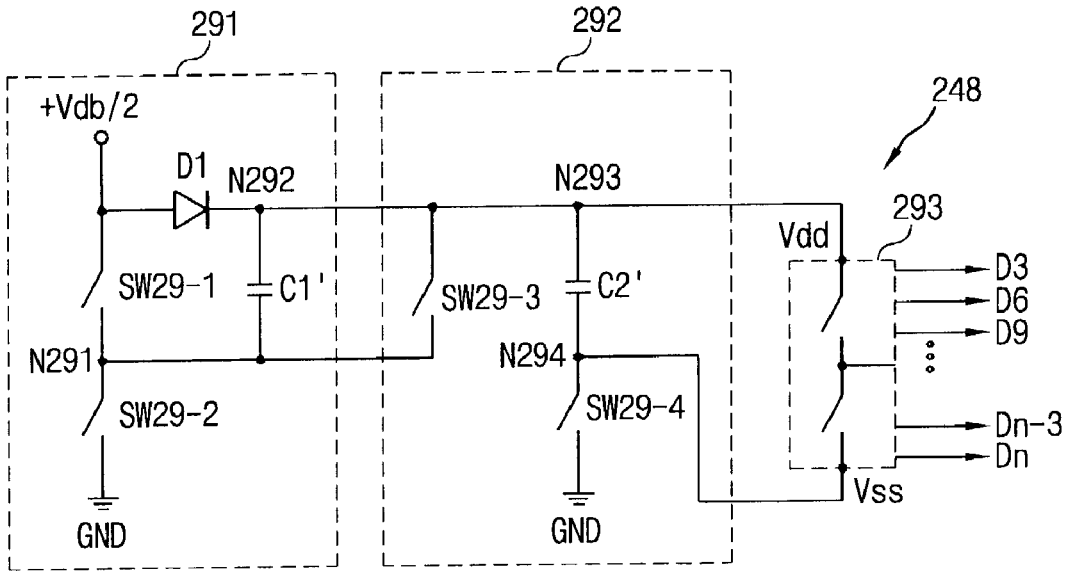
FIG. 29 is a circuit diagram of a 'B' data driving unit of FIG. 24.

FIG. 29 is a circuit diagram of a 'B' data driving unit of FIG. 24.

As shown in FIG. 29, the B data driving unit 248 supplies the doubled positive and negative scan pulses (+Vdb, −Vdb) according to the same construction and operation with the RG data driving unit 242 to the B data lines D3 and D6~Dn through the B data drive IC 293.

The B data drive IC 293 supplies the positive and negative pulses (+Vdb, −Vdb) to the B data lines D3 and D6~Dn connected to the pixel cell emitting light from the blue fluorescent material.

A value of the low voltage (+Vdb/2) supplied to the B data driving unit 248 is smaller than a value of the low voltage (+Vdrg/2) supplied to the RG data driving unit 242.

Namely, each threshold voltages for each of the red (R), the green (G) and the blue (B) fluorescent materials are different.

The operation of the B data driving unit will now be described in detail.

First, in case that the doubled positive data pulse (+Vdb) is supplied to the B data drive IC 293, the first and second switching devices SW29-1 and SW29-2 are alternately turned on to generate a doubled voltage (+Vdb), and the generated voltage (+Vdb) is charged in the second capacitor (C2').

Thereafter, the third switching device SW29-4 is turned off and the fourth switching device SW29-4 is turned on. At this time, the voltage (+Vdb) charged in the second capacitor C2' is supplied to the power supply terminal Vdd of the B data drive IC293, and the ground terminal receives a ground voltage as it is connected to the ground voltage source GND through the fourth switching device SW29-4. Accordingly, the doubled positive data pulse (+Vdb) is supplied to the B data drive IC 293.

Meanwhile, in case that the negative data pulse (−Vdb) is supplied to the B data drive IC 293, the third switching device SW29-3 and the second switching device SW29-2 are turned on and the fourth switching device SW29-4 is turned off.

At this time, the voltage flowing at the third node N293 flows to the ground voltage source GND through the third switching device SW29-3 and the second switching device SW29-2, becoming a ground voltage.

Meanwhile, the voltage charged in the second capacitor C2' as it is flows to the fourth node N294. The voltage flowing at the fourth node N294 is shifted to a negative polarity. Accordingly, the negative data pulse (−Vdb) is supplied to the B data drive IC 293, and at this time, the first switching device SW29-1 is turned off.

The B data drive IC 293 supplies the positive data pulse (+Vdb) and the negative data pulse (−Vdb) of which polarities are reversed by the frame unit at every line and supplied from the RG data pulse supply unit 292, to the B data lines D3, D6~Dn-3 and Dn), for which the B data drive IC 293 includes a plurality of switching devices (not shown) which are simultaneously turned on by a control signal.

A driving method of an EL display device in accordance with a fifth embodiment of the present invention will now be described in detail with reference to FIGS. 30 and 31.

Figure 30:
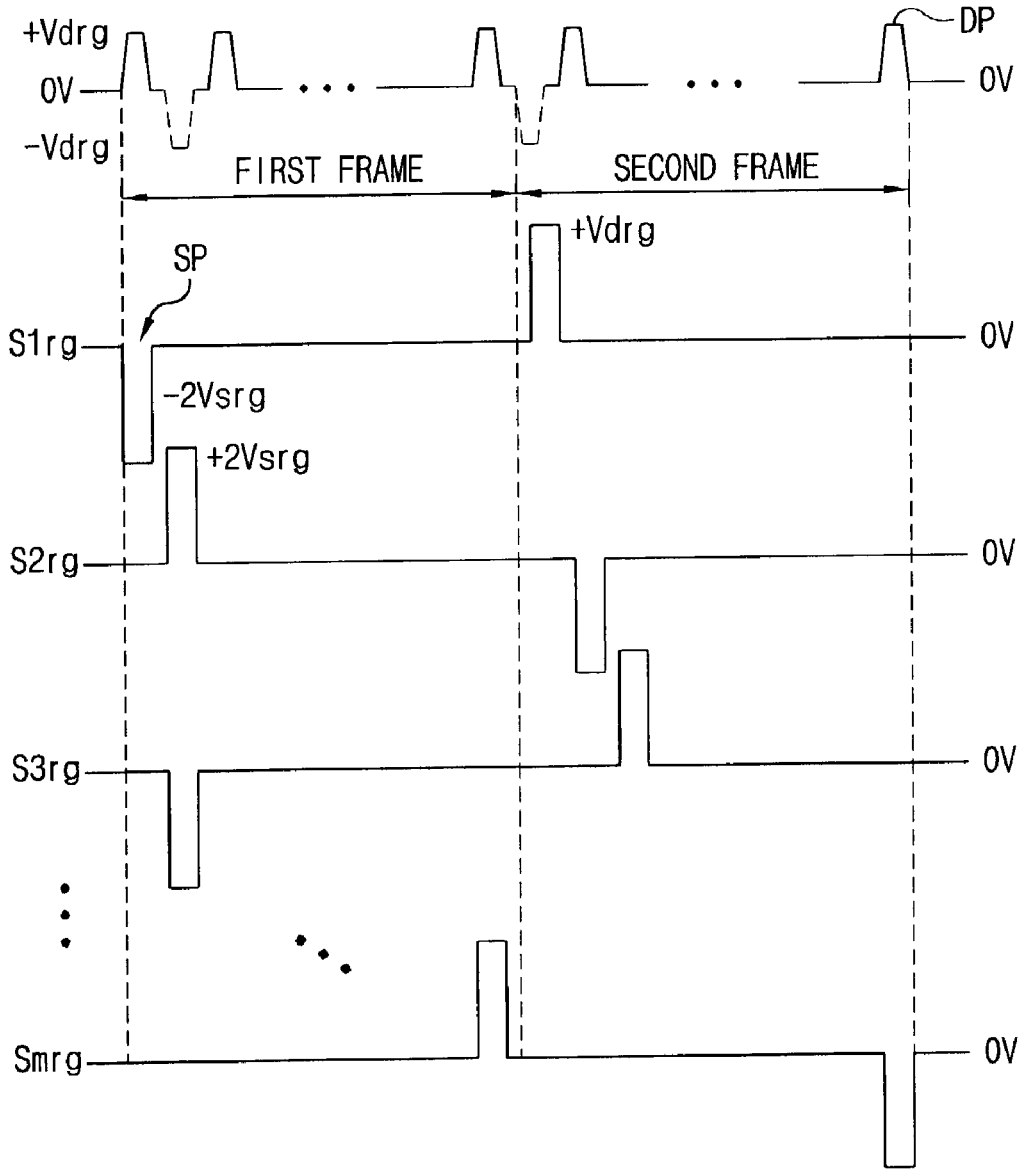
FIGS. 30 and 31 show waveforms for driving the EL display device of FIG. 24.
Figure 31:
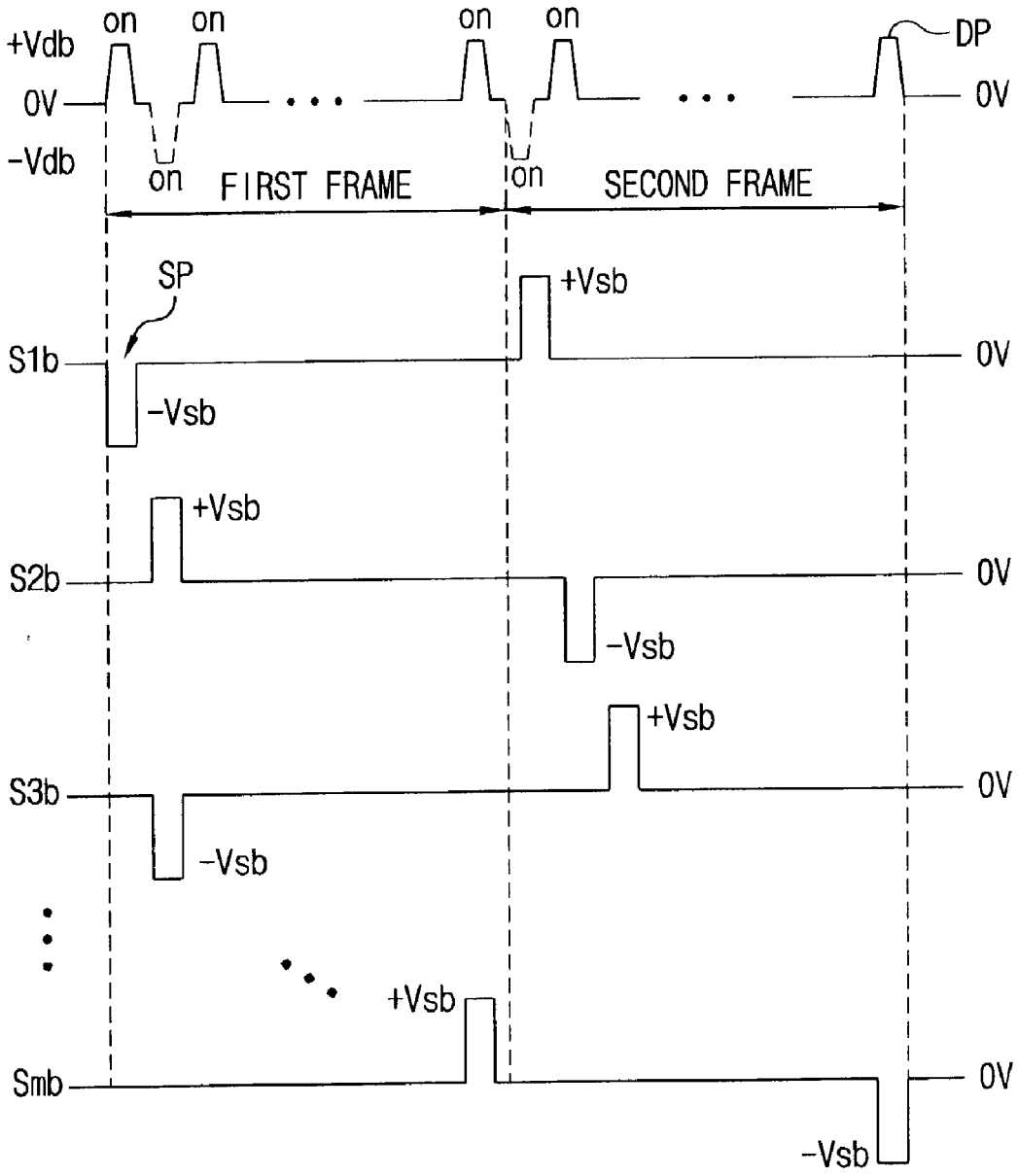

FIGS. 30 and 31 show waveforms for driving the EL display device of FIG. 24.

The driving method of an EL display device in accordance with the fifth embodiment of the present invention is that scan pulses (±2Vsrg, ±2Vsb) with different sizes of which polarities are reversed by the frame unit at every line are supplied to scan lines S1~Sm respectively connected to pixel cells emitting light from red (R), green (G) and blue (B) fluorescent materials, and data pulses (±Vdrg, ±Vdb) with different sizes, which is synchronized with the scan pulses (±2Vsrg, ±2Vsb) and of which polarities are reversed by the frame unit at every line, are supplied to data lines D1~Dn respectively connected to pixel cells emitting light from the red(R), green (G) and blue (B) fluorescent materials.

The scan pulse ±2Vsrg is supplied to scan lines connected to pixel cells emitting light from the red (R) and green (G) fluorescent materials, the scan pulse ±2Vsb is supplied to scan lines connected to pixel cells emitting light from the blue (B) fluorescent material, the data pulse ±Vdrg is supplied to data lines connected to pixel cells emitting light from the red (R) and the green (G) fluorescent materials, and the data pulse ±Vdb is supplied to data lines connected to pixel cells emitting light from the blue (B) fluorescent material.

As shown in FIGS. 30 and 31, a positive and a negative scan pulses (+2Vsrg, −2Vsrg), which are supplied after its polarity is reversed by the frame unit at every line from the RG scan driving unit 244, to scan lines S1*rg*~Smrg connected to the pixel cells emitting light from the red (R) and green (G) fluorescent materials.

Meanwhile, a positive and negative data pulses (+Vdrg, −Vdrg) supplied from the RG data driving unit 242 are supplied with the opposite polarities to the positive and negative scan pulses (+2Vsrg, −2Vsrg) to the data lines D1, D2~Dn-2 and Dn-1 connected to the pixel cells emitting light from the red (R) and green (G) fluorescent materials.

The positive and negative data pulses (+Vdrg, −Vdrg) are synchronized with the scan pulses (+2Vsrg, −2Vsrg).

The positive and negative scan pulses (+Vsb, −Vsb) (polarity is reversed by the frame unit at every line) supplied from the B scan driving unit 246 is supplied to the scan liens S1*b*~Smb connected to the pixel cell emitting light from the blue (B) fluorescent material.

The positive and negative data pulses (+Vdb, −Vdb), of which polarities are reversed by the frame unit at every line from the B data driving unit 248 and which is synchronized with the scan pulses (+Vsb, −Vsb), are supplied to the data lines D3, D6~Dn-3 and Dn) connected to the pixel cells emitting light from the blue (B) fluorescent material.

For example, when the frame is an odd number frame (the first frame), the negative scan pulses (−Vsrg, Vsb) are supplied to the odd number scan lines S1*rg*, S1*b*~Sm-1*rg*, Sm-1*b* (the odd number scan lines connected to the pixel cells emitting light from the red (R), green (G) and blue (B) fluorescent materials).

In this respect, the RG scan pulse (−2Vsrg) has a greater voltage than that of the B scan pulse (−Vsb).

The positive scan pulses (+2Vsrg, +Vsb) are supplied to the even number scan lines S2*rg*, S2*b*~Smrg and Smb. The RG scan pulse (+2*srg*) has a greater voltage than that of the B scan pulse (+Vsb).

Meanwhile, if the frame is an even number frame (the second frame), the positive scan pulses (+Vsrg, +Vsb) are supplied to the even number scan lines S2*rg*, S2*b*_~mrg and Smb (the even number scan lines connected to the pixel cells emitting light from the red (R), green (G) and blue (B) fluorescent materials). In this respect, the RG scan pulse (+2Vsrg) has a greater voltage than that of the B scan pulse (+Vsb). The negative scan pulses (−2Vsrg, −Vsb) are supplied to the even number scan lines (S1*rg*, S1*b*~Sm-1*rg* and Sm-1*b*). In this respect, the RG scan pulse (−2Vsrg) has a greater voltage than that of the B scan pulse (−Vsb).

Therefore, since the red (R) and green (G) fluorescent materials have the higher threshold voltage than that of the blue (B) fluorescent material, a higher voltage than the voltage (scan pulse) supplied to the blue (B) pixel cell is supplied to the red (R) and green (G) pixel cells.

Namely, as shown in FIGS. 30 and 31, it is noted that the red (R) and the green (G) scan pulses (±Vsrg) have the greater voltage than that of the blue (B) scan pulse (±Vsb).

Accordingly, the EL display device and its driving method in accordance with the fifth embodiment of the present invention has the advantages that by supplying the optimum scan pulse and data pulse to the pixel cells emitting light from the fluorescent materials of the electroluminescent panel, a durability of the pixel cells can be lengthened, and a power consumption can be reduced by using the doubler circuit.

Figure 32:
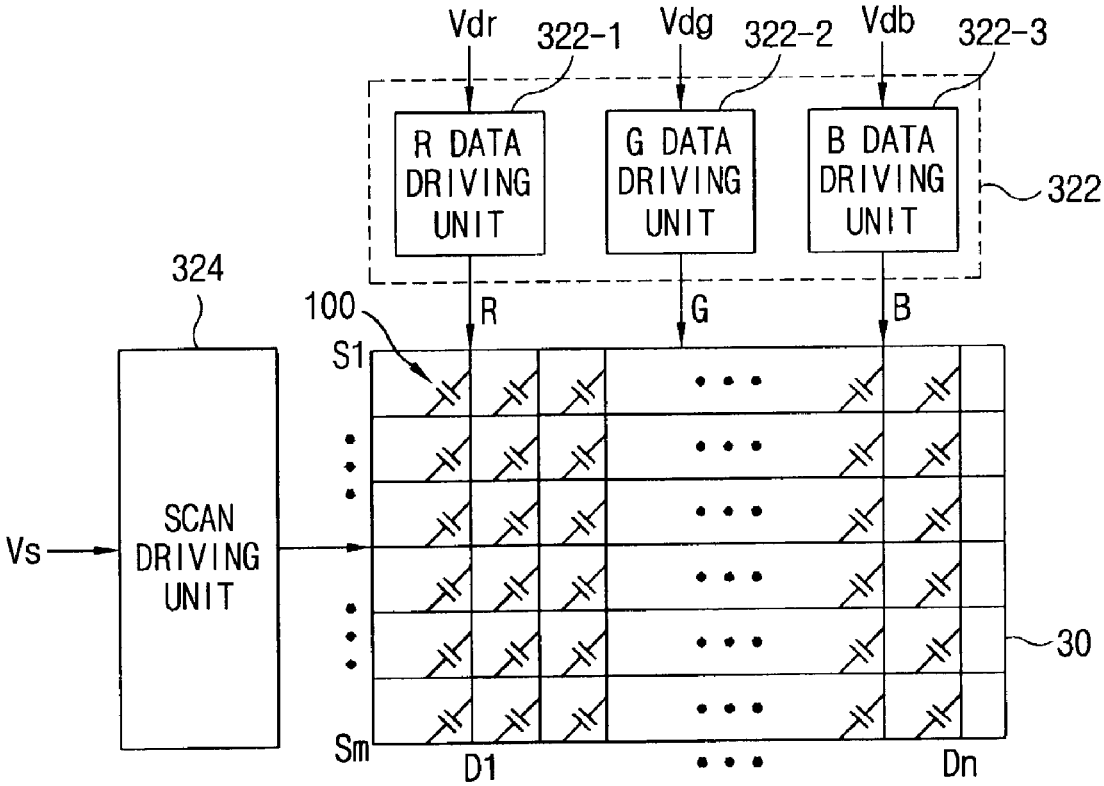
FIG. 32 is a block diagram of a driving apparatus of an EL display device in accordance with a sixth embodiment of the present invention.

FIG. 32 is a block diagram of a driving apparatus of an EL display device in accordance with a sixth embodiment of the present invention.

As shown in FIG. 32, an EL display device in accordance with a sixth embodiment of the present invention includes: a data driving unit 322 for supplying a data pulse with a voltage corresponding to a threshold voltage of each pixel cell to data lines D1~Dn connected to pixel cells emitting light from red, green and blue fluorescent materials; and a scan driving unit 324 for supplying a scan pulse synchronized with the data pulse to scan lines S1~Sm.

The pixel cell 100 is positioned at a cross point of the data lines D1~Dn and the scan lines S1~Sm, and turned on/off by an electric field between a scan electrode which receives a positive and a negative scan pulses (+Vs, −Vs) supplied after their polarities are reversed by the frame unit at every line from the scan driving unit 324 and a data electrode that positive data pulses (−Vdr, −Vdg, −Vdg) and negative data pulses (+Vdr, +Vdg, +Vdg) with different sizes are supplied to each data line (D1~Dn) connected to pixel cells emitting light from red (R), green (G) and blue (B) fluorescent materials from the data driving unit 322.

Figure 33:
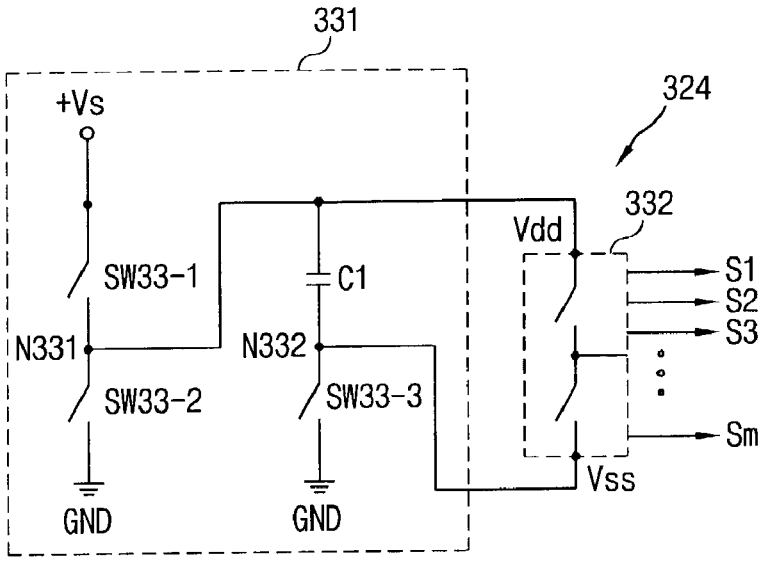
FIG. 33 is a circuit diagram of a scan driving unit of FIG. 32.

FIG. 33 is a circuit diagram of a scan driving unit of FIG. 32.

As shown in FIG. 33, the scan driving unit 324 includes: a scan pulse supply unit 331 for generating a positive and a negative scan pulses (+Vs, −Vs) by using a single voltage source (+Vs); and a scan drive IC 332 for sequentially supplying the positive and negative scan pulses (+Vs, −Vs) supplied after their polarities are reversed by the frame unit from the scan pulse supply unit 331, to the scan lines S1~Sm.

The scan pulse supply unit 331 includes: first and second switching devices SW33-1 and SW33-2 respectively installed between the ground voltage source GND and the single voltage source +Vs; a capacitor (C) installed between the first node N331 and the second node N332; and a third switching device SW33-3 installed between the capacitor (C) and the ground voltage source GND.

The first switching device SW33-1 is turned on when the positive scan pulse +Vs is supplied to the scan lines S1~Sm, and the second switching device SW33-2 is turned on when the negative pulse (−Vs) is supplied to the scan lines S1~Sm.

The third switching device SW33-3 is turned on when the positive scan pulse (+Vs) is supplied to the scan lines S1~Sm, and turned off when the negative scan pulse (−Vs) is supplied to the scan lines S1~Sm.

The capacitor (C) charges the voltage supplied from the single voltage source (+Vs).

The scan drive IC 332 includes a plurality of switching devices (not shown) and supplies a positive and a negative scan pulses (+Vs, −Vs) supplied from the scan pulse supply unit 331 to the scan line S1~Sm.

The operation of the scan driving unit 324 will now be described.

First, when the first and third switching devices SW33-1 and SW33-3 are turned on in order to supply scan pulses having mutually different polarities at every adjacent scan line (the odd number scan lines and even number scan lines), the positive scan pulse (+Vs) (voltage) supplied from the single voltage source (+Vs) is charged in the capacitor C1 through the first switching device SW33-1, and the charged scan pulse (+Vs) (voltage) is supplied to the power supply terminal Vdd of the scan drive IC 332. Accordingly, the positive scan pulse (+Vs) is sequentially supplied to the scan lines S1~Sm through the scan drive IC 332.

Thereafter, when the second switching device SW33-2 is turned on and the third switching device SW33-3 is turned off in order to reverse the polarity of the positive scan pulse (+Vs), the voltage charged in the capacitor C1 is maintained as it is whereas only the polarity level is shifted to a negative polarity. Accordingly, the negative scan pulse (−Vs) is sequentially supplied to the scan lines S1~Sm through the scan drive IC 332.

The data driving unit 322 will now be described in detail with reference to FIG. 34.

Figure 34:
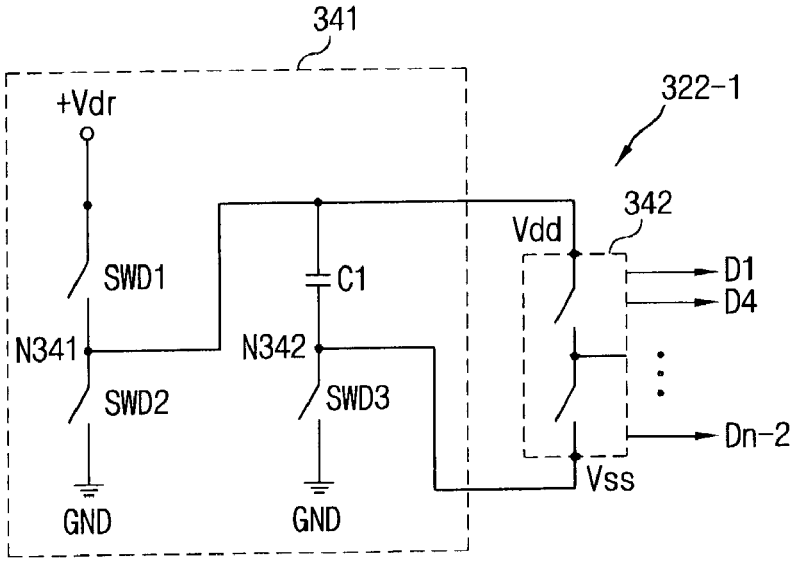
FIG. 34 is a circuit diagram of a data driving unit of FIG. 32.

FIG. 34 is a circuit diagram of a data driving unit of FIG. 32 in accordance with a sixth embodiment of the present invention.

That is, FIG. 32 is a circuit diagram showing the red (R) data driving unit 322-1 among the red (R), green (G) and blue (B) data driving units 322-1, 322-2 and 322-3 of the data driving unit 322.

As shown in FIG. 34, the red (R) data driving unit 322-1 includes an R data pulse supply unit 341 for generating a positive and a negative red (R) data pulses (+Vdr, −Vdr) by using a single voltage (+Vdr); and a B data drive IC 342 for simultaneously supplying the positive and negative red (R) data pulses (+Vdr, −Vdr) supplied after being reversed by the frame unit at every line from the R data pulse supply unit 341, to the red (R) data lines D1, D4~Dn-2.

The red (R) data pulse (+Vdr, −Vdr) is a data pulse supplied to a data line connected to a pixel cell emitting light from a red fluorescent material, and the red (R) data line signifies a data line connected to a pixel cell emitting light from the red fluorescent material.

The R data pulse supply unit 341 includes: first and second switching devices SWD1 and SWD2 respectively installed between a ground voltage source GND and the single voltage source +Vdr with a first node N341 therebetween; a capacitor (C) installed between first node N341 and second node N342; and a third switching device SWD3 installed between the capacitor (C) and the ground voltage source GND.

The first switching device SWD1 is turned on when the positive red (R) data pulse (+Vdr) is supplied to the red (R) data line D1 and D4~Dn-2, and the second switching device SWD2 is turned on when the negative red (R) data pulse (−Vdr) is supplied to the data lines D1 and D4~Dn-2).

The third switching device SWD3 is turned on when the positive red (R) data pulse (+Vdr) is supplied to the data lines D1 and D4~Dn-2 and turned off when the negative red (R) data pulse (−Vdr) is supplied thereto.

The capacitor (C1) charges the voltage supplied from the single voltage source (+Vdr).

The red (R) data drive IC 342 includes a plurality of switching devices (not shown) so as to supply the positive and negative red (R) data pulse (+Vdr, −Vdr) supplied after being reversed at every line by the frame unit from the R data pulse supply unit 341, to the red (R) data lines D1 and D4~Dn-2.

For example, in the red (R) data driving unit 322-1, the first and third switching devices SWD1 and SWD3 are turned on in order to supply the data pulses (+Vdr, −Vdr) of which polarities are reversed by the frame unit at every line, the positive scan pulse (+Vdr) supplied from the single voltage source (+Vdr) is charged in the capacitor C1 through the first switching device SWD1, and the charged voltage is supplied to the power supply terminal Vdd of the red (R) data drive IC 342, thereby generating the positive red (R) data pulse (+Vdr). Accordingly, the positive red (R) data pulse (+Vdr) is supplied to the red (R) data lines D1 and D4~Dn-2 through the red (R) data drive IC 342.

Thereafter, in order to reverse the polarity of the positive red (R) data pulse (+Vdr), when the second switching device SWD2 is turned on and the third switching device SWD3, is turned off, the voltage charged in the capacitor C1 is maintained as it is and only the polarity is shifted to the negative polarity. Accordingly, the negative red (R) data pulse (−Vdr) is supplied to the red (R) data lines D1 and Dr~Dn-2 through the red (R) data drive IC 342.

Consequently, in this manner, the red (R) data driving unit 322-1 can simultaneously supply the positive and negative red (R) data pulses (+Vdr, −Vdr) to the red (R) data lines D1 and D4~Dn-2 by using the single voltage source (+Vdr).

Meanwhile, the green (G) data driving unit 322-2 and the blue (B) data driving unit 322-3 respectively supply a positive and a negative green (G) data pulses (+Vdg, −Vdg) and a positive and a negative blue (B) data pulses (+Vdb, −Vdb) to the green (G) data lines D2 and D5~Dn-2 and the blue (B) data lines D3 and D6~Dn according to the same construction and operation with the red (R) data driving unit 322-1.

The green (G) data lines D2 and D5~Dn-2 are data lines connected to pixel cells emitting light from the green fluorescent material, and the blue (B) data lines D3 and D6~Dn are data lines connected to pixel cells emitting light from the blue fluorescent material.

The green (G) data pulses (+Vdg, −Vdg) are data pulses supplied to data lines connected to pixel cells emitting light from the green fluorescent material, and the blue (B) data pulses (+Vdb, −Vdb) are data pulses supplied to data lines connected to pixel cells emitting light from the blue fluorescent material.

The voltages (+Vdr, +Vdg, +Vdb) supplied to the red (R), green (G) and blue (B) data driving units 322-1, 322-2 and 322-3 of the data driving unit 322 are supplied to be corresponded to threshold voltages of each fluorescent material.

For example, if 200V is applied to the pixel cell emitting light from the red fluorescent material, 180V is applied to the pixel cell emitting light from the green fluorescent material and 150V is applied to the pixel cell emitting light from the blue fluorescent material.

That is, each data driving unit 322-1, 322-2 and 322-3 supplies a voltage (data pulse) corresponding to the threshold voltage (Vth) of each (R, G, B) fluorescent material (a threshold voltage of the pixel cell emitting light from the fluorescent materials).

Figure 35:
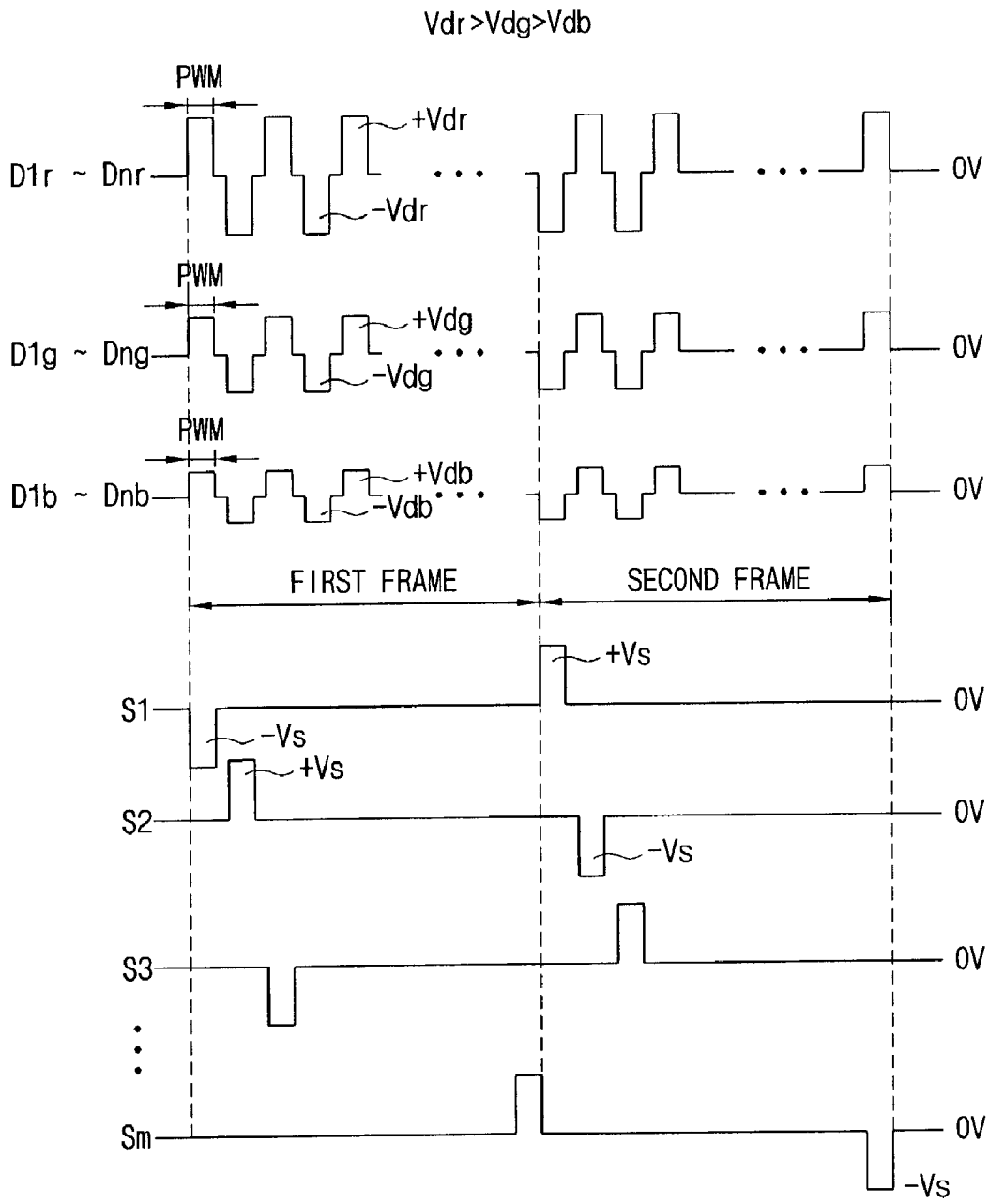
FIG. 35 show waveforms for driving the EL display device of FIG. 32.

FIG. 35 show waveforms for driving the EL display device of FIG. 32.

As shown in FIG. 35, a driving method of an EL display device in accordance with the sixth embodiment of the present invention is that scan pulses (+Vs, −Vs) with different polarities at every adjacent scan line (the odd number scan lines and the even number scan lines) by the frame unit (first frame and second frame) are sequentially supplied to scan lines S1~Sm, data pulses ±Vdr, ±Vdg and ±Vdb with different sizes at every adjacent data line (the odd number data lines and the even number data lines) are supplied to data lines (D1*r*, 1*g*, 1*b*~Dnr, ng and nb of each red (R), green (G) and blue (B) pixel cell in synchronization with the scan pulses (+Vs, −Vs).

The data pulses ±Vdr, ±Vdg and ±Vdb are reversed by the frame unit and have mutually different polarities at every adjacent data line.

The red (R), green (G) and blue (B) pixel cells are pixel cells each emitting light from the red (R), green (G) and blue (B) fluorescent materials.

For example, in case that the frame is an odd frame (first frame), the scan driving unit 324 supplies a negative scan pulse (−Vs) to the odd scan lines and supplies a positive scan pulse (+Vs) to the even number scan lines.

Meanwhile, in case that the frame is an even frame (second frame), the scan driving unit 324 supplies a positive scan pulse (+Vs) to the odd number scan lines and a negative scan pulse (−Vs) to the even number scan lines.

The data pulses ±Vdr, ±Vdg and ±Vdb in synchronization with the positive and negative scan pulses (+Vs, −Vs) have mutually different voltage sizes at every red (R) data lines D1*r*~Dnr, the green (G) data lines D1*g*~Dng and the blue (B) data lines D1*b*~Dnb.

That is, the data pulses ±Vdr, ±Vdg and ±Vdb with mutually different voltage sizes are supplied to the red (R) data line (D1*r*~Dnr), green (G) data lines D1*g*~dng) and blue (B) data lines D1*b*~Dnb).

Figure 36:
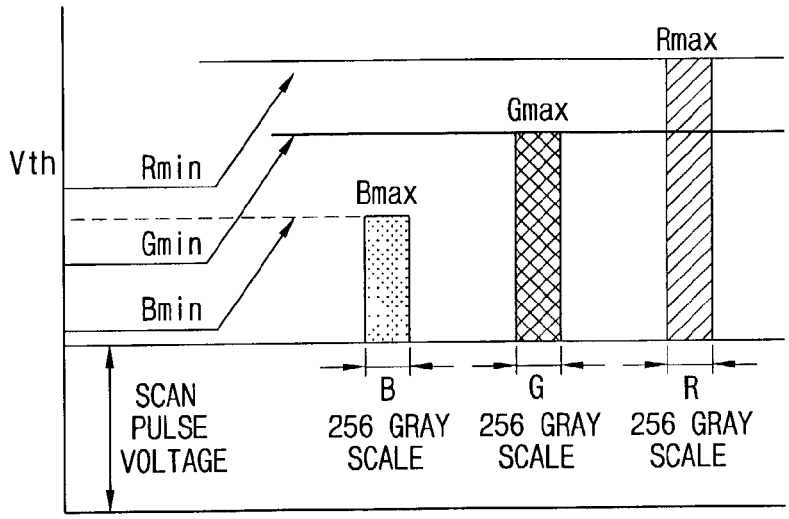
FIG. 36 is a graph showing voltages of data pulses supplied to each pixel cell of red, green and blue in accordance with the sixth embodiment of the present invention.

FIG. 36 is a graph showing voltages of data pulses supplied to each pixel cell of red, green and blue in accordance with the sixth embodiment of the present invention.

That is, the data pulses ±Vdr, ±Vdg and ±Vdb modulate a pulse width for a gray scale expression of an EL display device.

As shown in FIG. 36, the left side shows threshold voltages (Vth) and the right side shows that, after a scan pulse voltage is supplied, a data pulse voltage is separately supplied differently and gray scales are implemented while controlling a data pulse width.

For example, for a 256 gray scale expression, the pulse width is controlled by using a pulse width modulation (PWM) method.

In other words, data pulse voltages with mutually different sizes are supplied to each red (R), green (G) and blue (B) data line and the width of the data pulse is modulated and supplied, so that 256 gray scales can be expressed.

Meanwhile, a doubler circuit is additionally installed to double a voltage supplied to each of the red (R), green (G) and blue (B) data driving units 322-1, 322-2 and 322-3 of the data driving unit 322 and the scan driving unit 324 in accordance with the sixth embodiment of the present invention as shown in FIG. 32, which will now be described in detail with reference to FIG. 37.

Figure 37:
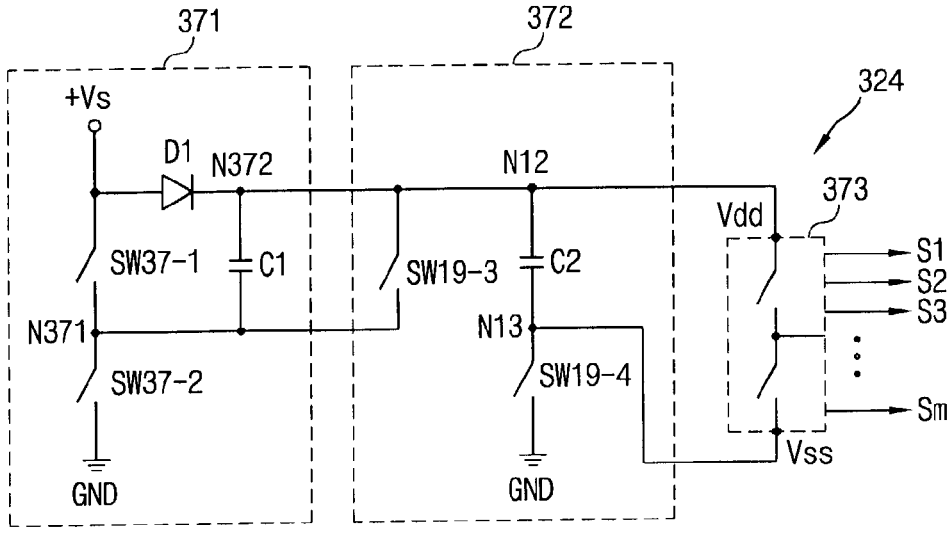
FIG. 37 is a circuit diagram of a doubler circuit additionally installed in the scan driving unit in accordance with the sixth embodiment of the present invention.

FIG. 37 is a circuit diagram of a doubler circuit additionally installed in the scan driving unit in accordance with the sixth embodiment of the present invention.

As shown in FIG. 37, the scan driving unit 324 includes: a doubler circuit 371 for receiving a single voltage (+Vs) and doubling it; a scan pulse supply unit 372 for shifting a polarity level of the doubled voltage (+Vs) by the line unit and generating a doubled positive scan pulse (+2Vs) and negative scan pulse (−2Vs); and a scan drive IC 373 for sequentially supplying the doubled positive pulse (+2Vs) and negative scan pulse (−2Vs) supplied from the scan pulse supply unit 372, to scan lines S1~Sm-1.

The doubler circuit 371 includes: a single voltage source (+Vs); first and second switching devices SW37-1 and SW37-2 installed between the single voltage source (+Vs) and a ground voltage source GND; a first capacitor C1 installed between the first node N371 and second node N372 between the first and second switching devices SW37-1 and SW37-2; and a diode D1 installed between the single voltage source (+Vs) and the first capacitor C1.

The single voltage source Vs supplies a voltage for generating the doubled positive pulse (+2Vs) and negative scan pulse (−2Vs) to the doubler circuit 371.

The first and second switching devices SW37-1 and SW37-2 are alternately switched by a control signal to supply the single voltage (+Vs) to the first capacitor C1.

The first capacitor C1 doubles the voltage (+Vs) supplied from the single voltage source (+Vs) according to the alternate switching operation of the first and second switching devices SW37-1 and SW37-2.

The diode D1 cuts off a reverse voltage supplied from the single voltage source (+Vs).

The doubling process of the doubling circuit 371 is the same with the doubling process of the first doubler circuit 194, descriptions of which are thus omitted.

The red (R), green (G) and blue (B) data driving units 322-1, 322-2 and 322-3 each with the doubler circuit 371 additionally installed therein have the same constructions and operations. Thus, the red (R) data driving unit 322-1 with the doubler circuit will now be representatively described with reference to FIG. 38.

Figure 38:
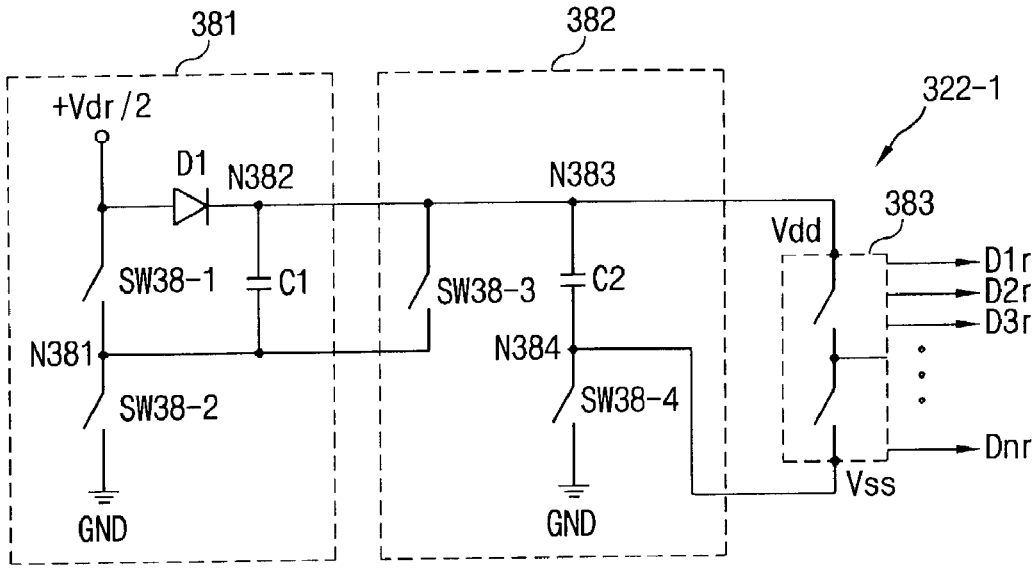
FIG. 38 is a circuit diagram of a red data driving unit with the doubler circuit in accordance with the sixth embodiment of the present invention.

FIG. 38 is a circuit diagram of a red data driving unit with the doubler circuit in accordance with the sixth embodiment of the present invention.

As shown in FIG. 38, the red (R) data driving unit 322-1 includes: a doubler circuit 381 for receiving a single low voltage +Vdr/2 and doubling it; a data pulse supply unit 382 for shifting a polarity level of the doubled voltage (+Vdr) by the data line unit and generating doubled positive and negative data pulses (+2Vdr, −2Vdr); and a red (R) data drive IC 383 for sequentially supplying the doubled positive and negative data pulses (+2Vdr, −2Vdr) received from the data pulse supply unit 382, to data lines D1*r*~Dnr.

The doubler circuit 381 includes a single low voltage source (+Vdr/2); first and second switching devices SW38-1 and SW 38-2 installed between the single low voltage source (+Vdr/2) and a ground voltage source GND; a first capacitor C1 installed between first node N381 and second node N382; and a diode D1 installed between the single low voltage source (+Vdr/2) and the first capacitor C1.

The first and second switching devices SW38-1 and SW38-2 are alternately switched by the control signal and supplies the single low voltage (+Vdr/2) to the first capacitor C1.

The first capacitor C1 doubles the low voltage (+Vdr/2) supplied from the single low voltage source (+Vdr/2) as the first and second switching devices SW38-1 and SW38-2 are alternately switched.

The diode D1 cuts off a reverse voltage supplied to the single low voltage source (+Vdr/2).

The operation of the doubler circuit of the red (R) data driving unit 322-1 will now be described in detail.

First, when the second switching device SW38-2 is turned on by the control signal, the low voltage (+Vdr/2) supplied from the single low voltage source (+Vdr/2) is charged in the first capacitor C1 and flows on the second node N382.

Thereafter, when the second switching device SD2 is turned off and the first switching device SW38-1 is turned on, the low voltage (+Vdr/2) supplied from the single low voltage source (+Vdr/2) and the low voltage (+Vdr/2) charged in the first capacitor C1 are added and doubled voltage (+Vdr) flows on the second node N382.

The data pulse supply unit 382 reverses a polarity level of the doubled voltage (+Vdr) to be the opposite at every red (R) data line D1*r*~Dnr by the frame unit and supplies it to the red (R) data drive IC 383.

The data pulse supply unit 382 includes a third switching device SW38-3 connected between an output line of the doubler circuit 381 and the second switching device SW38-2; a second capacitor C2 installed between the third switching device SW 38-3 and a fourth node N384; and a fourth switching device SW38-4 installed between the second capacitor C2 and a ground voltage source GND.

The third switching device SW38-3 discharges the voltage charged in the second capacitor C2 to the ground voltage source GND through the second switching device SW38-2, so that when the doubled negative data pulse (−Vdr) is supplied to the red (R) data lines D1*r*~Dnr, the third switching device SW38-3 is turned on.

The fourth switching device SW38-4 is turned on when the doubled positive data pulse (+Vdr) is supplied to the red (R) data lines D1*r*~Dnr.

The second capacitor C2 charges the doubled voltage (+Vdr) supplied from the doubler circuit 381.

The operation of the red (R) data driving unit 322-1 will now be described in detail.

First, in case that the negative data pulse (−Vdr) is supplied to the red (R) data drive IC 383, the third switching device SW38-3 and the second switching device SW38-2 are turned on and the fourth switching device SW38-4 is turned off.

At this time, the voltage of the third node N383 flows to the ground voltage source GND through the third switching device SW38-3 and the second switching device SW38-2, so that the voltage value of the third node is the same as the ground voltage value.

The voltage charged in the second capacitor C2 flows at the fourth node N384. A polarity (level) of the voltage flowing at the fourth node N384 is shifted to a negative polarity. Accordingly, the negative data pulse (−Vdr) is supplied to the red (R) data drive IC 383, and at this time, the first switching device SW38-1 is turned off.

In case that the doubled positive data pulse (+Vdr) is supplied to the red (R) data drive IC 383, the first and second switching device SW38-1 and SW38-2 of the doubler circuit 381 are alternately turned on and the generated doubled voltage (+Vdr) is charged in the second capacitor C2.

Thereafter, the third switching device SW38-3 and the fourth switching device SW38-4 are turned on. Then, the voltage (+Vdr) charged in the second capacitor is supplied to the power supply terminal Vdd of the red (R) data drive IC 383, and the ground terminal Vss receives a ground voltage as it is connected to the ground voltage source GND through the fourth switching device SW38-4. Accordingly, the doubled positive data pulse +Vdr is supplied to the red (R) data drive IC 383.

The red (R) data drive IC 383 simultaneously supplies the positive data pulse (+Vdr) and the negative data pulse (−Vdr) supplied after being reversed to be the opposite by the frame unit at every red (R) data line D1*r*~Dnr from the data pulse supply unit 382, to the red (R) data lines D1*r*~Dnr, for which the red (R) data drive IC 383 includes a plurality of switching devices (not shown) which are simultaneously turned on by a control signal.

Green (G) and blue (B) data pulses with mutually different polarities in each data line by the frame unit are respectively supplied from the green (G) data driving unit and the blue (B) data driving unit to each green (G) data lines D1*g*~Dng and the blue (B) data lines D1*b*~Dnb.

Driving voltages with mutually different sizes are supplied to the red (R) data driving unit 322-1, the green (G) data driving unit 322-2 and the blue (B) data driving unit 322-3 each having the doubler circuit.

That is, a half of voltage corresponding to the threshold voltage of each of the red (R), green (G) and blue (B) fluorescent materials is supplied to the red (R) data driving unit 322-1, the green (G) data driving unit 322-2 and the blue (B) data driving unit 322-3. Accordingly, since the half voltage is used by being doubled, a power consumption can be reduced.

In the EL display device and its driving method in accordance with the sixth embodiment of the present invention, the single low voltage is doubled to be used or non-doubled voltage is used, and in this respect, in order to reduce a power consumption of the data driving unit and the scan driving unit, it is preferred to use the doubled voltage.

As so far described, the driving apparatus and method of the EL display device in accordance with the present invention have many advantages.

That is, for example, first, a power consumption can be reduced by generating the positive or negative pulse by using a single power source.

Secondly, by supplying the positive or negative scan pulse and data pulse to the pixel cells in a manner that the pulses are mutually reversed per frame, the electric charge charged in the pixel cells can be completely removed and the uniform (the optimum) voltage (data pulse/scan pulse) can be supplied.

Thirdly, since the data lines and the scan liens are classified by even numbers and odd numbers and data pulses and scan pulses with mutually different polarities at every line and field are supplied to pixel cells, the constantly uniform voltage can be supplied to the pixel cells.

Fourthly, since the low voltage is used by being doubled by the doubler circuit, the power consumption can be reduced to ¼ compared to that of the conventional art.

Fifthly, since the voltage corresponding to the threshold voltage of each pixel cell emitting light from the red, green and blue fluorescent materials, that is, the data pulses with mutually different sizes and modulated pulse widths, are supplied to each pixel cell, a luminance, a chromaticity and color uniformity can be improved.

Lastly, since the scan pulses with mutually different sizes and polarities are reversed by the frame unit and supplied to each adjacent scan line, the electric charges charged in the pixel cells in the previous frame are removed, and accordingly, the voltage can be constantly uniformly supplied to the pixel cells. Thus, the phenomenon that the luminance between the data/scan lines is not uniform can be removed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A driving apparatus of an electroluminescent display device comprising:

a plurality of pixel cells formed between a plurality of scan lines and data lines;

a scan driving unit for receiving a voltage from a single scan voltage source and sequentially supplying to the plurality of scan lines a first scan pulse having a first polarity in a first frame or field and for sequentially supplying to the scan lines a second scan pulse having a second polarity opposite to the first polarity in a second frame or field such that a last scan pulse of the first scan pulse in the first frame or field substantially coincides with a beginning pulse of the second scan pulse in the second frame or field; and a data driving unit for receiving a voltage from a single data voltage source and supplying a data pulse to the data lines, wherein the data driving unit supplying the data pulse having the second polarity at a same time the scan driving unit supplying the first scan pulse having the first polarity, and the data driving unit supplying another data pulse having the first polarity at a same time the scan driving unit supplying the second scan pulse having the second polarity.

2. The apparatus of claim 1, wherein the scan driving unit comprises:

a scan pulse generator for charging a voltage inputted from the single scan voltage source, reversing a polarity of the charged voltage by a certain unit and switching it to have a first or a second polarity; and a scan drive IC (Integrated Circuit) for sequentially supplying a scan pulse with a first or a second polarity to the scan lines.

3. The apparatus of claim 2, wherein the scan pulse generator comprises:

a first capacitor for charging an inputted voltage;

a first switching device installed between the single scan voltage source and a first terminal of the first capacitor and switching the voltage supplied from the single scan voltage source so as to be charged in the first capacitor;

a second switching device installed between the first terminal of the first capacitor and a ground voltage source and grounding the first capacitor to the ground voltage source; and a third switching device installed between a second terminal of the first capacitor and the ground voltage source and floating a voltage of the second terminal of the first capacitor.

4. The apparatus of claim 3, further comprising:

a doubler circuit for doubling the voltage of the single scan voltage source installed between the single scan voltage source and the scan pulse generator.

5. The apparatus of claim 4, wherein the doubler circuit comprises:

a third capacitor for charging the voltage supplied from the single scan voltage source;

a seventh switching device installed between the third capacitor and the ground voltage source and switching the voltage supplied from the single low voltage source so as to be charged in the third capacitor;

an eighth switching device installed between the third capacitor and the single voltage source and doubling the voltage charged in the third capacitor by integer times; and a first diode installed between the third capacitor and the single voltage source and cutting off a reverse voltage flowing to the single low voltage source.

6. The apparatus of claim 2, wherein the scan drive IC receives the scan pulse charged in the first capacitor and sequentially applies it to each scan line.

7. The apparatus of claim 2, wherein the scan pulse generator reverses a polarity of the voltage charged in the first capacitor by the unit of field, frame and/or line.

8. The apparatus of claim 7, wherein in case that the scan voltage is reversed by the line unit and supplied to the scan line, the scan driving unit includes odd line scan driving units and even line scan driving units formed at both sides of a panel.

9. The apparatus of claim 8, wherein the data driving unit includes odd line data driving units and even line data driving units formed at each panel, in order to supply a data pulse with the opposite polarity to the scan pulse.

10. The apparatus of claim 8, wherein the scan driving unit is controlled so that the a polarity of the scan pulse is reversed at every line and the size of the scan pulse is different for every frame.

11. The apparatus of claim 10, wherein the scan driving unit comprises:

a doubler circuit for doubling the voltage of the single voltage source by integer times;

a fifth capacitor for charging the voltage supplied directly from the doubler circuit or the single scan voltage source;

a scan pulse generator including a switching device for reversing a polarity of the voltage charged in the fifth capacitor and generating scan pulses with mutually different levels; and a scan driving IC for receiving the generated scan pulses and supplying the scan pulses with mutually different polarity and level to the odd scan lines and even scan lines.

12. The apparatus of claim 11, wherein the doubler circuit comprises:

a sixth capacitor for charging the voltage supplied from the single scan voltage source;

an eleventh switching device installed between the sixth capacitor and the ground voltage source and switched so that the voltage supplied from the single voltage source can be charged in the sixth capacitor;

a twelfth switching device installed between the sixth capacitor and the single voltage source and doubling the voltage charged in the sixth capacitor by integer times; and a third diode installed between the sixth capacitor and the single voltage source and cutting a reverse voltage flowing to the single low voltage source.

13. The apparatus of claim 12, wherein the switching device of the scan pulse generating unit comprises:

a thirteenth switching device connecting a first terminal of the fifth capacitor and a second terminal of the sixth capacitor; and a fourteenth switching device connected between a second terminal of the fifth capacitor and a ground voltage.

14. The apparatus of claim 11, wherein the data driving unit includes odd line data driving units and even line data driving units formed at an upper side and a lower side of a panel, to supply the data pulse to the data line.

15. The apparatus of claim 14, wherein the data driving unit comprises:

a data driving unit;

a doubler circuit for doubling the voltage inputted from the single voltage source; and a data driving IC for applying the doubled voltage to the data line so as to have the same polarity all the time.

16. The apparatus of claim 2, wherein the scan driving unit is controlled so that the polarity of the scan pulse is reversed and the size of the scan pulse is different for every red, green and blue data.

17. The apparatus of claim 16, wherein the scan driving unit is divided into a red and green line scan driving unit and a blue line scan driving unit formed at both sides of each panel.

18. The apparatus of claim 17, wherein each scan driving unit comprises:

a doubler circuit for doubling the voltage inputted from each single scan voltage source by integer times;

a scan pulse generator for charging the voltage supplied from the doubler circuit or the single voltage source, and reversing a polarity of the charged voltage to generate scan voltages with mutually different levels; and a scan driving IC for supplying the generated scan pulse to the red, green and blue scan lines so that each line has mutually different polarity and level.

19. The apparatus of claim 18, wherein the doubler circuit comprises:

a seventh capacitor for charging the voltage applied from the single scan voltage source;

a fifteenth switching device installed between the seventh capacitor and the ground voltage source and switching the voltage supplied from the single voltage source so as to be charged in the seventh capacitor;

a sixteenth switching device installed between the seventh capacitor and doubling the voltage charged in the seventh capacitor by integer times; and a fourth diode installed between the seventh capacitor and the single voltage source and cutting off a reverse voltage flowing to the single low voltage source.

20. The apparatus of claim 19, wherein the scan pulse generator comprises:

an eighth capacitor for charging the voltage supplied from the doubler circuit;

a seventeenth switching device for connecting a first terminal of the eighth capacitor and a second terminal of the seventh capacitor; and an eighteenth switching device connected between a second terminal of the eighth capacitor and the ground voltage source.

21. The apparatus of claim 16, wherein the data driving unit includes a red and green line data driving units and a blue line data driving unit formed at an upper side and a lower side of each panel, to supply the data pulse to the data line.

22. The apparatus of claim 21, wherein the data driving unit comprises:

a doubler circuit for doubling the voltage of the single voltage source by integer times;

a ninth capacitor for charging the voltage supplied from the ninth capacitor;

a data pulse generator including a switching for reversing a polarity of the voltage charged in the ninth capacitor and generating a data voltage; and a data driving IC for supplying the scan pulses with mutually different polarities as generated to the red, green and blue data lines.

23. The apparatus of claim 22, wherein the doubler circuit comprises:

a tenth capacitor for charging the voltage supplied from the single voltage source;

a nineteenth switching device installed between the tenth capacitor and the ground voltage source and switched so that the voltage supplied from the single voltage source can be charged in the tenth capacitor;

a twentieth switching device installed between the tenth capacitor and switched so that the voltage charged in the tenth capacitor can be doubled by integer times; and a fifth diode installed between the tenth capacitor and the single voltage source and cutting off a reverse voltage flowing to the single low voltage source.

24. The apparatus of claim 23, wherein the switching device of the data pulse generator comprises:

a nineteenth switching device for connecting a first terminal of the ninth capacitor and a second terminal of the tenth capacitor; and a twenty-first switching device connected between a second terminal of the ninth capacitance and the ground voltage.

25. The apparatus of claim 2, wherein the data driving unit includes a red data driving unit, green data driving unit and a blue data driving unit each having a voltage source with mutually different driving voltage by red, green and blue data.

26. The apparatus of claim 25, wherein each of the red, green and blue data driving units comprises:

a doubler circuit for receiving a voltage from the single voltage source and doubling it;

a data pulse generator for charging the voltage supplied from the doubler circuit, and reversing a polarity of the charged voltage to generate a data pulse so as to have the opposite polarity by lines and have mutually different data voltage for the red, green and blue data; and a data driving IC for supplying the generated data pulse to each of the red, green and blue data line.

27. The apparatus of claim 25, wherein the data pulse is pulse-width modulated.

28. The apparatus of claim 1, wherein the data driving unit comprises:

a data pulse generator for charging the voltage inputted from the single data voltage source, reversing a polarity of the charged voltage by a certain unit so as to have a voltage with a first or a second polarity; and a data drive IC for supplying the data pulse with the first or the second polarity to the data lines.

29. The apparatus of claim 28, wherein the data pulse generator comprises:

a second capacitor for charging the voltage inputted from the single data voltage source;

a fourth switching device installed between the single data voltage source and a first terminal of the second capacitor and switching the voltage supplied from the single voltage source so as to be charged in the second capacitor;

a fifth switching device installed between the first terminal of the second capacitor and a ground voltage source and grounding the second capacitor to the ground voltage source; and a sixth switching device installed between a second terminal of the second capacitor and floating a voltage of the second terminal of the second capacitor.

30. The apparatus of claim 29, wherein the data drive IC receives a data pulse charged in the second capacitor and applies it to each data line.

31. The apparatus of claim 28, further comprising:

a doubler circuit for doubling the voltage of the single data voltage source by integer times is installed between the single data voltage source and the data pulse generating unit.

32. The apparatus of claim 31, wherein the doubler circuit comprises:

a fourth capacitor for charging the voltage supplied from the single data voltage source;

a ninth switching device installed between the fourth capacitor and the ground voltage source and switched so that the voltage supplied from the single low voltage source can be charged in the fourth capacitor;

a tenth switching device installed between the fourth capacitor and the single voltage source and switching the voltage charged in the fourth capacitor so as to be doubled by integer times; and a second diode installed between the third capacitor and the single voltage source and cutting off a reverse voltage flowing to the single low voltage source.

33. The apparatus of claim 1, wherein a last pulse of the data pulse in the first frame or field substantially coincides with a beginning pulse of the data pulse in the second frame or field.

34. A driving apparatus of an electroluminescent display device comprising:

a plurality of pixel cells formed between a plurality of scan lines and data lines;

a scan driving unit for supplying to the scan lines a first scan pulse having a first polarity in a first frame or field and for supplying to the scan lines a second scan pulse having a second polarity opposite to the first polarity in a second frame or field, wherein the first and second scan pulses are sequentially supplied to the scan lines such that a last pulse in the first scan pulse substantially coincides with a beginning pulse in the second scan pulse; and a data driving unit for supplying a data pulse to the data lines, wherein the data driving unit supplies the data pulse to the data lines such that a polarity of the data pulse is opposite to a polarity of the first or second scan pulse in a respective frame or field.

35. The apparatus of claim 34, wherein a last pulse of the data pulse in the first frame or field substantially coincides with a beginning pulse of the data pulse in the second frame or field.

36. A driving apparatus of an electroluminescent display device comprising:

a plurality of pixel cells formed between a plurality of scan lines and data lines;

a scan driving unit for receiving a voltage from a single scan voltage source and sequentially supplying to the plurality of scan lines a first scan pulse having a first polarity in a first frame or field and for sequentially supplying to the scan lines a second scan pulse having a second polarity opposite to the first polarity in a second frame or field such that a last scan pulse of the first scan pulse in the first frame or field substantially coincides with a beginning pulse of the second scan pulse in the second frame or field; and a data driving unit for receiving a voltage from a single data voltage source and supplying a data pulse to the data lines, wherein the data driving unit supplies the data pulse to the data lines such that a polarity of the data pulse is opposite to a polarity of the first or second scan pulse in a respective frame or field.

* * * * *